US011019841B2

(12) United States Patent
Ebeling

(10) Patent No.: US 11,019,841 B2
(45) Date of Patent: Jun. 1, 2021

(54) TOBACCO HOPPER

(71) Applicant: Cordell E. Ebeling, Isanti, MN (US)

(72) Inventor: Cordell E. Ebeling, Isanti, MN (US)

( * ) Notice: Subject to any disclaimer, the term of this patent is extended or adjusted under 35 U.S.C. 154(b) by 0 days.

(21) Appl. No.: 16/584,450

(22) Filed: Sep. 26, 2019

(65) Prior Publication Data

US 2020/0015513 A1 Jan. 16, 2020

Related U.S. Application Data

(63) Continuation of application No. 14/822,592, filed on Aug. 10, 2015, now Pat. No. 10,485,263.

(60) Provisional application No. 62/035,253, filed on Aug. 8, 2014.

(51) Int. Cl.
*A24C 5/39* (2006.01)

(52) U.S. Cl.
CPC ..... *A24C 5/399* (2013.01); *A24C 5/397* (2013.01)

(58) Field of Classification Search
None
See application file for complete search history.

(56) References Cited

U.S. PATENT DOCUMENTS

| | | | | |
|---|---|---|---|---|
| 2,104,195 | A * | 1/1938 | Groeling | B65D 83/0847 229/121 |
| 3,735,915 | A * | 5/1973 | Fuss | B65D 5/726 222/571 |
| 4,151,946 | A | 5/1979 | Schmidt | |
| 2006/0272655 | A1 | 12/2006 | Thomas | |
| 2013/0228187 | A1 | 9/2013 | Yisha | |

* cited by examiner

*Primary Examiner* — Michael H. Wilson
*Assistant Examiner* — Katherine A Will
(74) *Attorney, Agent, or Firm* — Merchant & Gould P.C.

(57) ABSTRACT

A tobacco hopper that may be used with commercially available tobacco rolling machines. More specifically, this disclosure relates to tobacco hoppers that can be made from precut assembly kits, paper kits, cardboard kits, or other elements or material. The tobacco hopper may be position on or to the side of commercially available tobacco rolling machine. In some embodiments the tobacco hopper may be easily disposed after multiple uses.

16 Claims, 54 Drawing Sheets

TOBACCO HOPPER

CROSS REFERENCE TO RELATED APPLICATION(S)

This application is a continuation of U.S. application Ser. No. 14/822,592, filed on Aug. 10, 2015, now U.S. Pat. No. 10,485,263, entitled TOBACCO HOPPER, which claims priority to U.S. Provisional Application No. 62/035,253, filed on Aug. 8, 2014, entitled TOBACCO HOPPER, the disclosures of which are hereby incorporated by reference in their entireties.

BACKGROUND ART

Commercially manufactured cigarettes are paper tubes filled with shredded tobacco and a filter. They come pre-packaged in packs or cartons. Historically, smokers turn to commercially manufactured cigarettes for their tobacco and smoking needs. The rising cost of commercially available cigarettes, however, has forced smokers to look for more cost-friendly alternatives. One alternative is to roll cigarettes using manual or electronic tobacco rolling machines.

Rolling cigarettes is more economical than buying commercially manufactured cigarettes. Two cartons of cigarettes cost roughly $160. By rolling tobacco into cigarettes, smokers can obtain roughly two and a half cartons' worth of cigarettes for a fraction of the cost. Furthermore, smokers can determine the number of cigarettes they wish to roll in each instance rather than buying cigarette packs with a set number of cigarettes in each pack.

Various types of manual or electronic cigarette rolling machines exist in the market. Examples include the Top-O-Matic Cigarette rolling machine, Premier Supermatic Cigarette machine, Shargio Cig-a-matic Cigarette machine and many others. Operating a tobacco rolling machine is relatively straightforward. A smoker places loose tobacco onto the tobacco rolling machine, slides a generous amount of tobacco into the chamber on top of the tobacco rolling machine, places an empty cigarette tube over the exit chamber, and then by pressing a lever or button, packs the tobacco into the cigarette tube.

Though the process of rolling a cigarette is straightforward, it is also imprecise. To ensure that the tobacco is sufficiently packed in the cigarette tube, smokers generally load a generous amount of loose tobacco into the chamber. Consequently, loose tobacco often spills out and onto the table or the floor. When rolling several cigarettes at a time, the process quickly becomes messy.

Furthermore, excess tobacco dries up and accumulates inside and around the sides and chamber of the tobacco rolling machine. The excess tobacco is inadvertently packed into later cigarettes, thus adversely affecting the quality of those cigarettes since the excess tobacco is brittle in quality and cannot pack properly. Additionally, the residue accumulates, interferes with the rolling operation, and damages the tobacco rolling machine. As a result, smokers must periodically clean the inside components of the machine, which is an arduous task. Furthermore, excess tobacco is wasteful, and negates the financial benefit of rolling tobacco into cigarettes.

SUMMARY

In general terms, this disclosure relates to tobacco hoppers that can be used with commercially available tobacco rolling machines.

One aspect is a tobacco hopper made from a precut, paper assembly kit. Since the hopper is constructed from paper, it is disposable. Tobacco hoppers can help make the tobacco rolling process a clean, easy task that minimizes tobacco waste.

Another aspect is a tobacco hopper made from a metal, cardboard, or vacu-formed plastic.

Another aspect is a hopper that can be set on top of a tobacco rolling machine.

Another aspect is a hopper that is configured to be snapped in or along the chamber opening on top of a tobacco rolling machine.

Another aspect is a hopper that is configured to be arranged along the exit chamber of a tobacco rolling machine to collect excess tobacco.

Another aspect is a hopper that is configured to be arranged along the exit chamber of a tobacco rolling machine to collect and hold newly rolled cigarettes with a pivotal attachment for attaching to the various available machines profiles.

Yet another aspect is a hopper that provides sidewalls that can be fitted unto the sides of the tobacco rolling machine to contain tobacco within the region defined by the hopper sidewalls.

DETAILED DESCRIPTION

Figure 1:
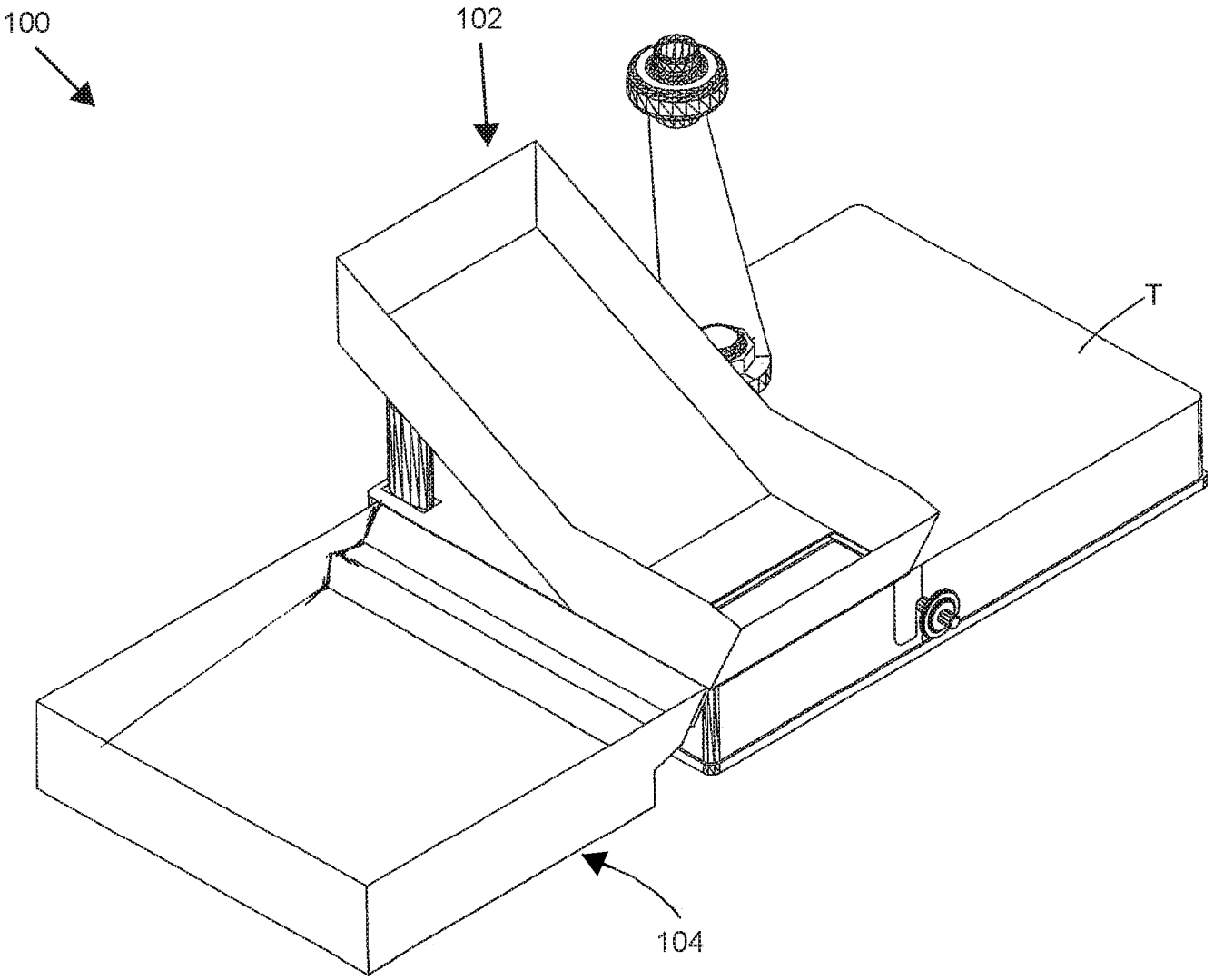
FIG. 1 is a perspective view of a top tobacco hopper and a side tobacco hopper where both the top and side tobacco hoppers are attached unto a tobacco rolling machine.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
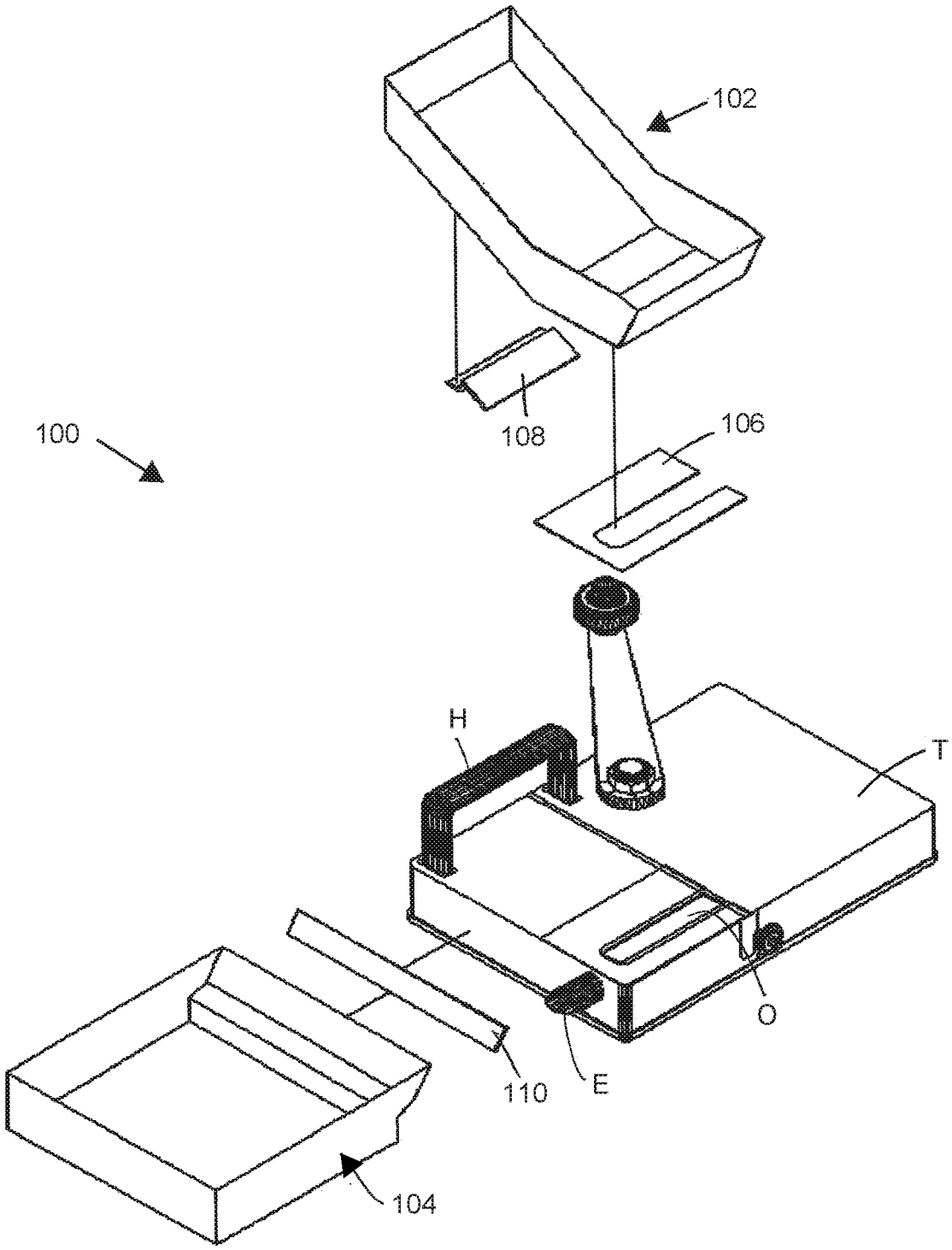
FIG. 2 is a perspective view of a top tobacco hopper and a side tobacco hopper where both the top and side tobacco hoppers are not attached unto a tobacco rolling machine.
Figure 3:
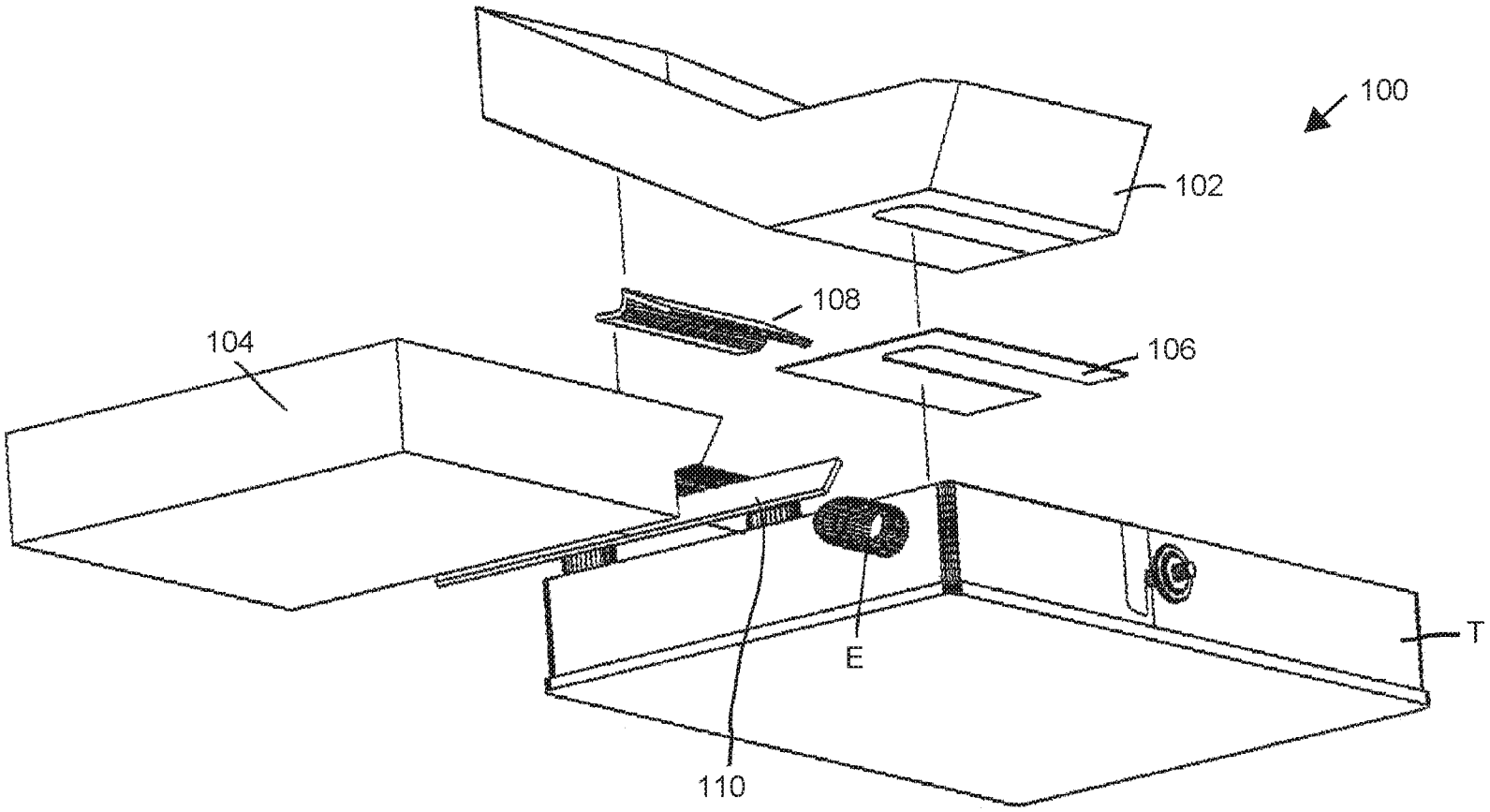
FIG. 3 is another perspective view of a top tobacco hopper and a side tobacco hopper where both the top and side tobacco hoppers are not attached unto a tobacco rolling machine.

FIG. 1 is a perspective view of a top tobacco hopper and a side tobacco hopper where both the top and side tobacco hoppers are attached unto a tobacco rolling machine. FIG. 2 is a perspective view of a top tobacco hopper and a side tobacco hopper where both the top and side tobacco hoppers are not attached unto a tobacco rolling machine. FIG. 3 is another perspective view of a top tobacco hopper and a side tobacco hopper where both the top and side tobacco hoppers are not attached unto a tobacco rolling machine.

As illustrated in FIGS. 1-3, the tobacco hopper system 100 includes a top tobacco hopper 102, and a side tobacco hopper 104. Also illustrated in FIG. 1 is a tobacco rolling machine T. In this embodiment, the top tobacco hopper 102 and the side tobacco hopper 104 are adhered to the tobacco rolling machine T through an adhering mechanism. In one embodiment, the adhering mechanisms are magnetic strips that are placed beneath both the top tobacco hopper and the protruding end of the side tobacco hopper. The magnetic strips are not visible in FIG. 1. Another variation of the adhering mechanism may be a screw or ball and lock that fit into the side of the tobacco rolling machine T or other adhesive or fastening material such as velcro or adhesive tape. In another embodiment, the top tobacco hopper 102 and the side tobacco hopper 104 are already in their final shape. The top tobacco hopper 102 and the side tobacco hopper 104 may be constructed from pre-cut metal, paper, cardboard, or vacu-formed plastic. Other construction material may also be possible. The tobacco rolling machine T may be an already commercially available machine.

As illustrated in FIGS. 2-3, the tobacco hopper system 100 also includes a top adhering mechanism 106, a fitting mechanism 108, and a side adhering mechanism 110. Also illustrated in FIGS. 2-3 is the handle H and the chamber opening O and the exit chamber E of the tobacco rolling machine T. The adhering mechanism 106 has an opening that lies on top of and corresponds to the chamber opening O. The fitting mechanism 108 fits snugly on top of the handle H and below the top tobacco hopper 102. The side adhering mechanism may have a pivotal attachment with a magnetic strip for attaching to the various profiles of tobacco rolling machines.

With the top tobacco hopper, a smoker can put a generous amount of loose tobacco into the top hopper 102 and into the chamber opening O of the tobacco rolling machine T. The location of the top tobacco hopper 102 ensures that excess tobacco is not lost or wasted. Any remaining tobacco can be recollected and reused.

Once a smoker compresses and packs the tobacco into the cigarette tube, any excess tobacco can be collected in the side tobacco hopper 104. The side tobacco hopper 104 is strategically placed such that it will catch and collect any excess tobacco from the exit chamber E of the tobacco rolling machine T. The side tobacco hopper 104 can also collect all rolled cigarettes that are ejected from the tobacco rolling machine. It is desirable to provide a hopper for both loading the tobacco into the chamber and for collecting any excess tobacco or residue once the filled cigarette tube is removed. The hoppers will both maximize the financial benefit of rolling cigarette but also maintain the condition of the tobacco rolling machine as it minimizes the collection of residue inside the machine. The hoppers will also improve the quality of the rolled cigarettes by minimizing the chance that any excess dried or brittle tobacco in the chamber be used for packing. The hoppers also allow a smoker to more accurately measure the amount of tobacco to be used in each tobacco rolling session.

Figure 4:
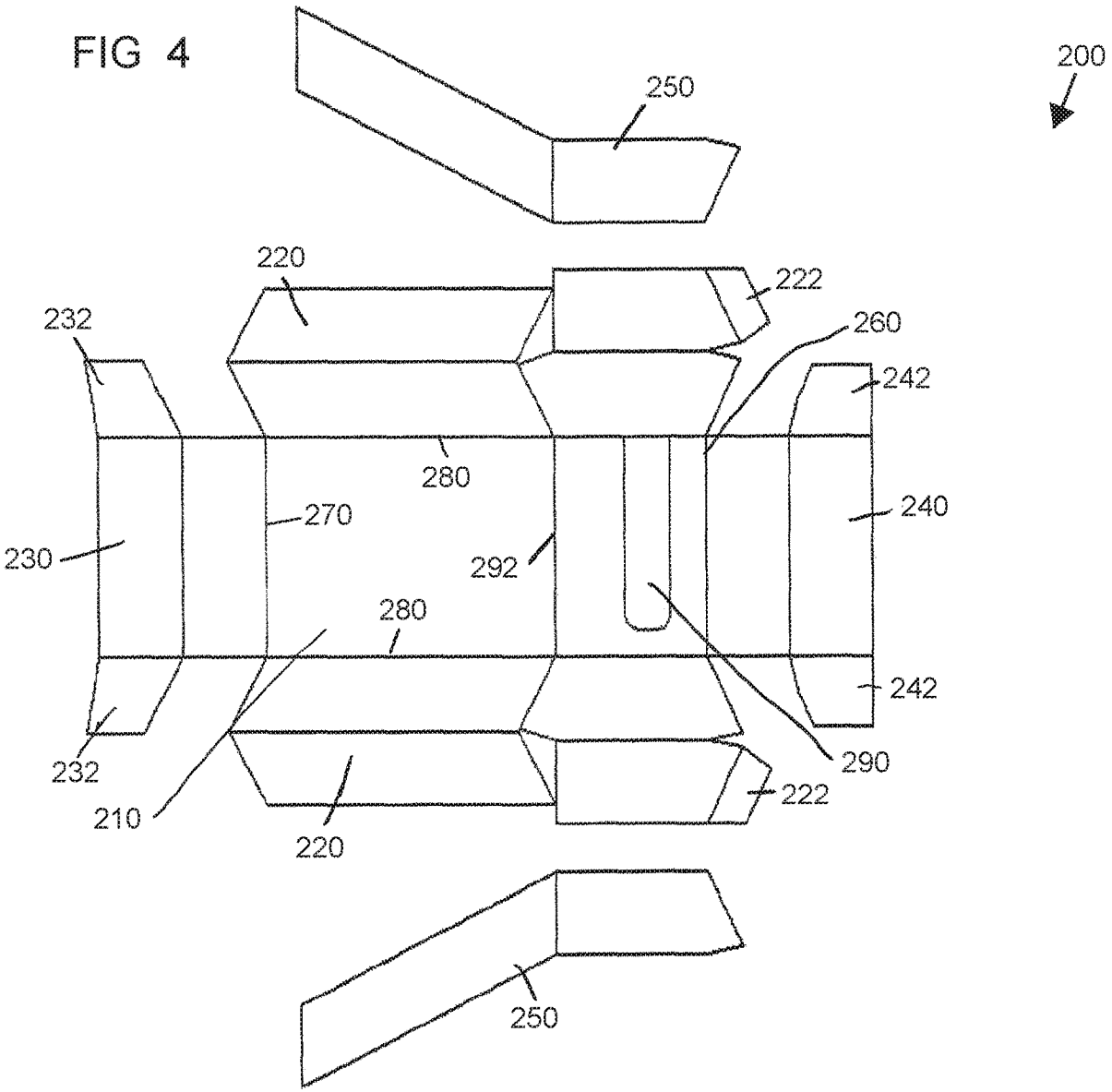
FIG. 4 is a top view of a foldable top tobacco hopper before assembly.

FIG. 4 is a top view of a foldable top tobacco hopper before assembly. In this exemplary embodiment, the top tobacco hopper 200 includes a base 210, side flanges 220, side flange tips 222, rear flange 230, rear flange tips 232, front flange 240, front flange tips 242, side insert 250, a front edge 260, a rear edge 270, side edges 280, an opening 290, and an incline folding line 292. The top tobacco hopper and its components will be described in greater detail below.

The top tobacco hopper 200 is folded from and made from the components illustrated in FIG. 4. Each flange is integrated along an edge of the base 210. The side flanges 220 are folded up and along the side edges 280. The rear flange 230 is folded up and along the rear edge 270. The front flange 240 is folded up and along the front edge 260. Once the front, side, and rear flanges are folded up and along their respective edges, the side flange tips 222 can be folded and interlocked into the space between the front flange 240 and the front flange tips 242. Similarly, the front flange tip 242 can be folded and interlocked into the space between the side flange 220 and side flange tips 222. The rear flange tips 232 can also be folded and interlocked into the space of the side flange 220. Once the front, side, and rear flanges are folded up, the side inserts 250 can be inserted into the side flanges to provide structural support. At that time, the top tobacco hopper can also be folded along the incline folding line 292. Once the top tobacco hopper 200 is folded along the incline folding line 292, the base 210 can be configured at an inclined position.

Once all flanges, tips, and inserts are in their correct position, the smoker can use a fastener to hold the top tobacco hopper in its correct configuration. Examples of fasteners can be tape, glue, staple, or any other commercially available material. In addition, the top tobacco hopper 200 may be constructed from a base with a perforated pattern; the perforated pattern indicating where the flanges and flange tips are to be folded. Furthermore, the edges of the flange tips may contain self-adhesive such as two-sided tapes that can fasten the top tobacco hopper 200 into its proper shape and into a complete and full configuration. In yet another embodiment, the base may be constructed with a non-slip material so as to create a non-slip base for the top tobacco hopper 200. Examples of a non-slip base may be rubber, polypropylene, plastic, non-slip polyester etc.

Figure 5:
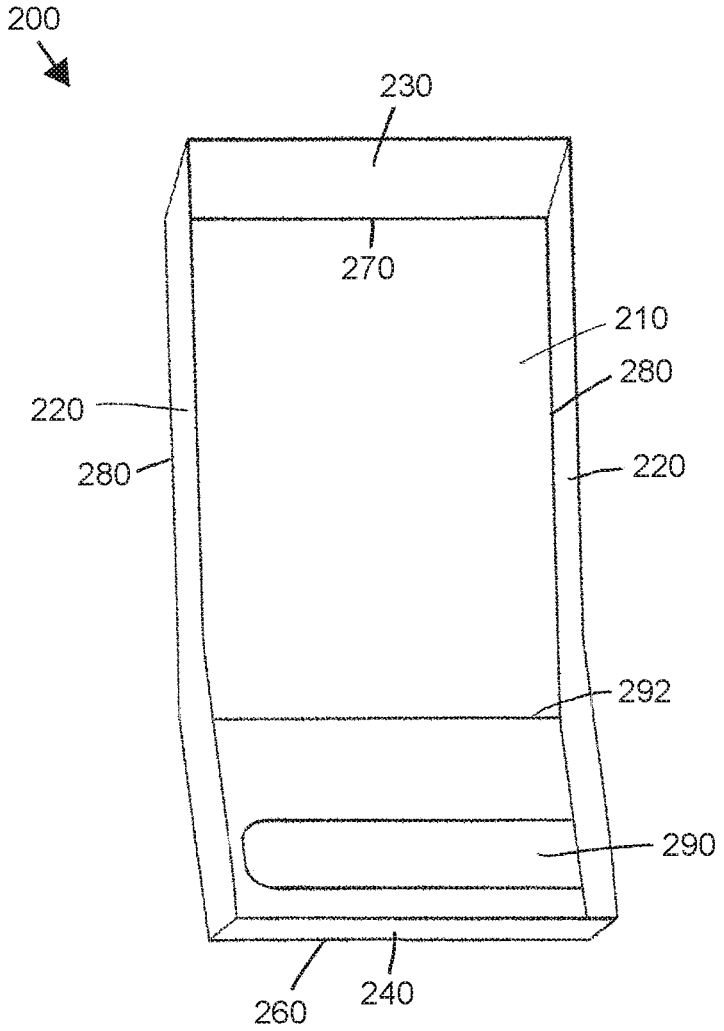
FIG. 5 is a perspective view of a folded top tobacco hopper.

FIG. 5 is a perspective view of a folded top tobacco hopper. FIG. 5 is the end-result of FIG. 4. As illustrated in FIG. 5, the side flanges 220 are folded up along side edges 280. Rear flange 230 is folded up along rear edge 270. Front flange 240 is folded up along front edge 260. The top tobacco hopper is also folded up along the incline folding line 292. Thus, the tobacco hopper 200 takes an inclined configuration where the rear of the portion of the base 210 is inclined at an angle with respect to the front portion of the base. The front flange tips, side flange tips, and rear flange tips are not visible in FIG. 5 because they are inserted in the corners between their respective flanges. Similarly, the side insert 250 is underneath the side flange 220 and provides structural support for the inclined configuration.

Figure 6:
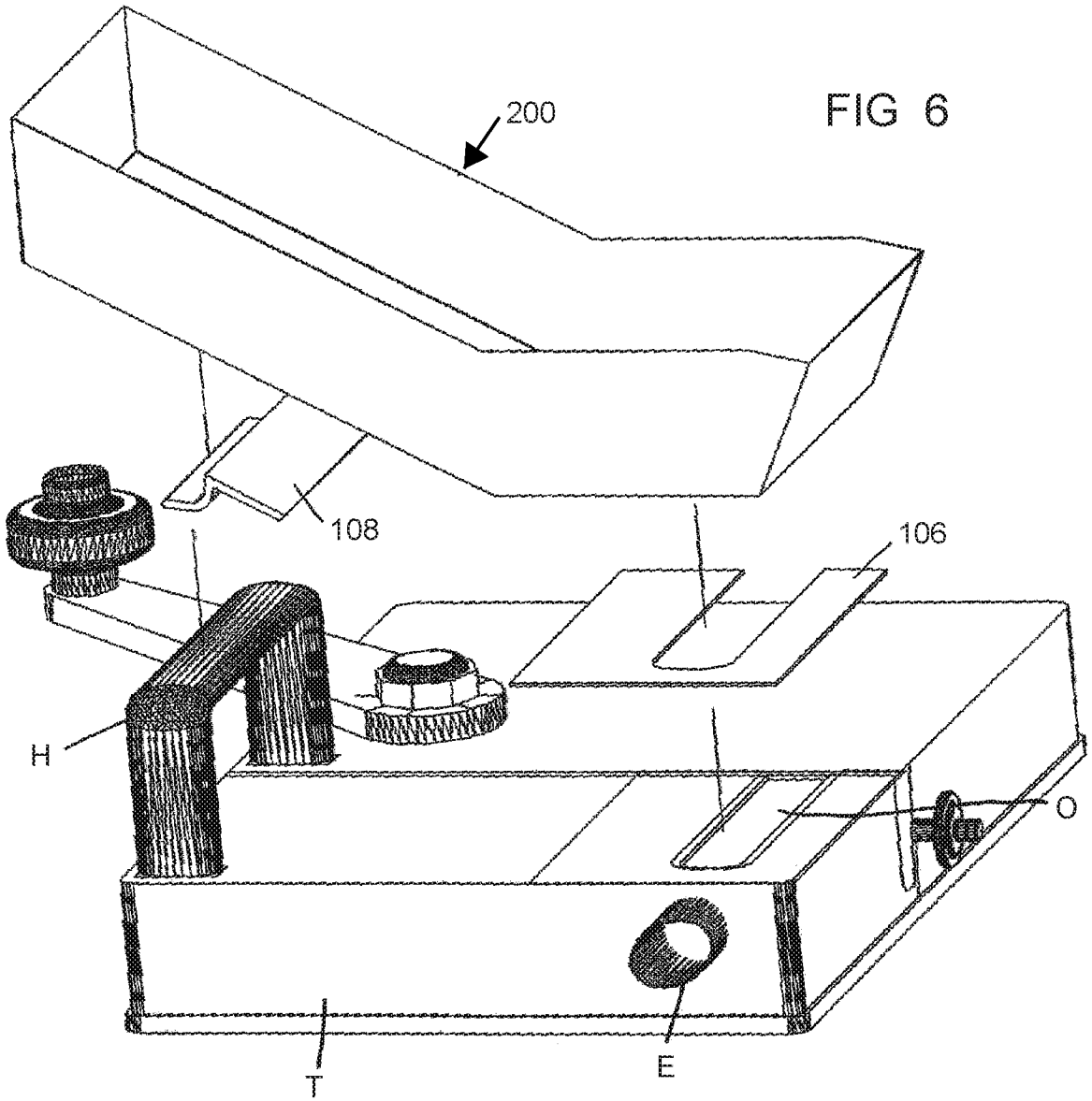
FIG. 6 is a perspective view of a folded top tobacco hopper and a tobacco rolling machine.

FIG. 6 is a perspective view of a folded top tobacco hopper 200 and a tobacco rolling machine T. As illustrated in FIG. 6, the top tobacco hopper 200 aligns with the fitting mechanism 108, and the top adhering mechanism 106. Also illustrated are the tobacco rolling machine T, the handle H, the chamber opening O, and the exit chamber E. As illustrated, the top adhering mechanism 106 aligns with the chamber opening O such that the adhering mechanism 106 does not obstruct the chamber opening O. The fitting mechanism 108 also fits snugly onto the handle H. Both the fitting mechanism 108 and the top adhering mechanism 106 can be adhered or fastened to the top tobacco hopper 200. Any adhering material or fastener may be used such as tape, glue, staple, or any other commercially available material. The top adhering mechanism 106 may also be used in conjunction with any screws, bolts, nuts, and handle of the tobacco rolling machine to ensure a more secure or permanent fit. Furthermore, the top adhering mechanism may be constructed from a non-slip material so as to form as non-slip surface for the top tobacco hopper 200. Examples of a non-slip base may be rubber, polypropylene, plastic, non-slip polyester etc. The top adhering mechanism may also be constructed from a magnetic material, and thus employs magnetic force as a means to secure the top tobacco hopper to the tobacco rolling machine.

Figure 7:
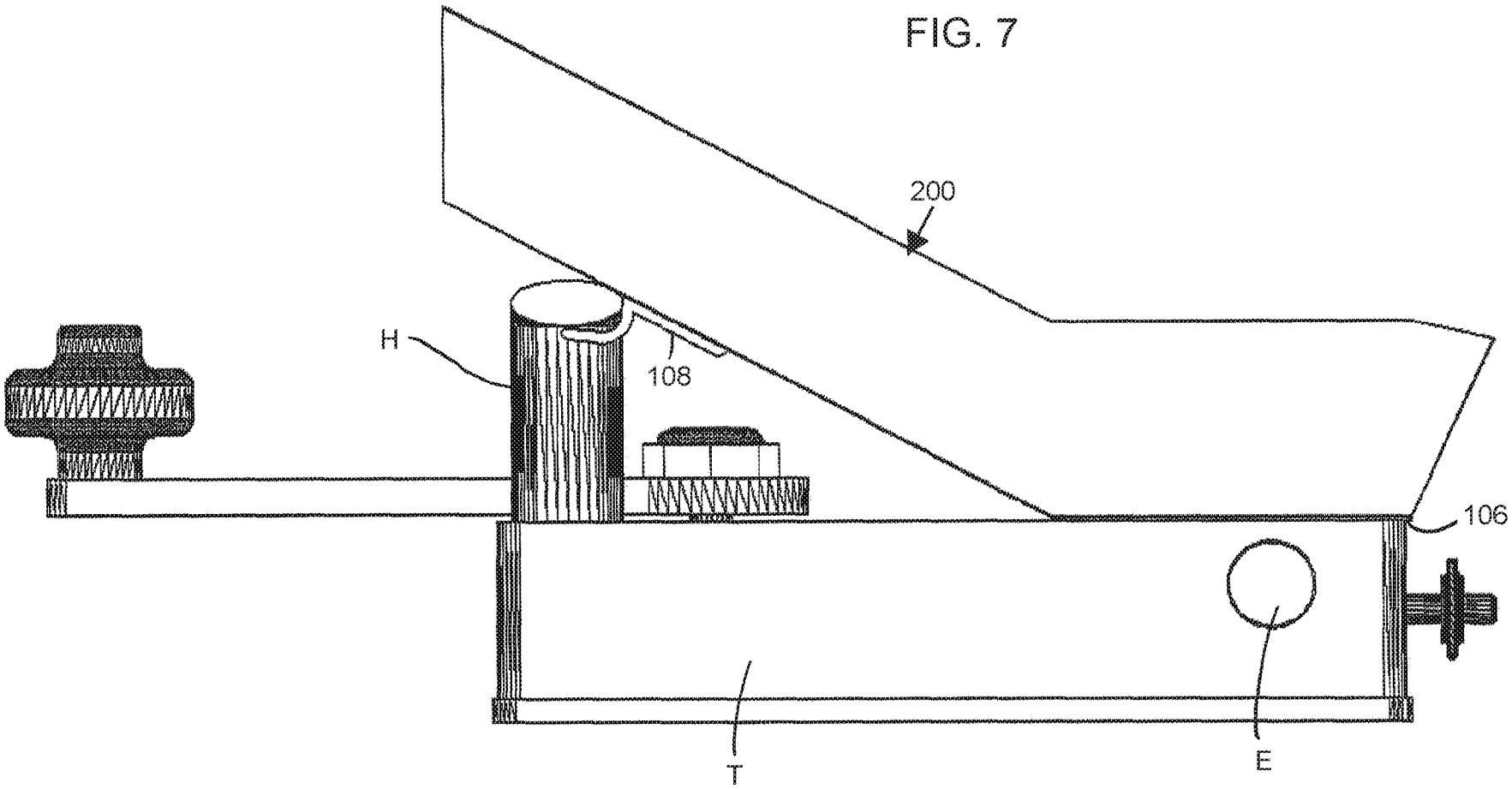
FIG. 7 is a side view of a folded top tobacco hopper attached unto a tobacco rolling machine.

FIG. 7 is a side view of a folded top tobacco hopper 200 attached unto a tobacco rolling machine T. As illustrated in FIG. 7, the top tobacco hopper 200 sits on top of the tobacco rolling machine T. The fitting mechanism 108 sits snug on the handle H while supporting the base of the top tobacco hopper 200. The adhering mechanism 106 sits under the top tobacco hopper 200 and connects the tobacco hopper 200 to the tobacco rolling machine T. The exit chamber E remains unobstructed and a smoker can place tobacco into the chamber without fear of excess tobacco spilling onto the tobacco rolling machine T or elsewhere.

Figure 8:
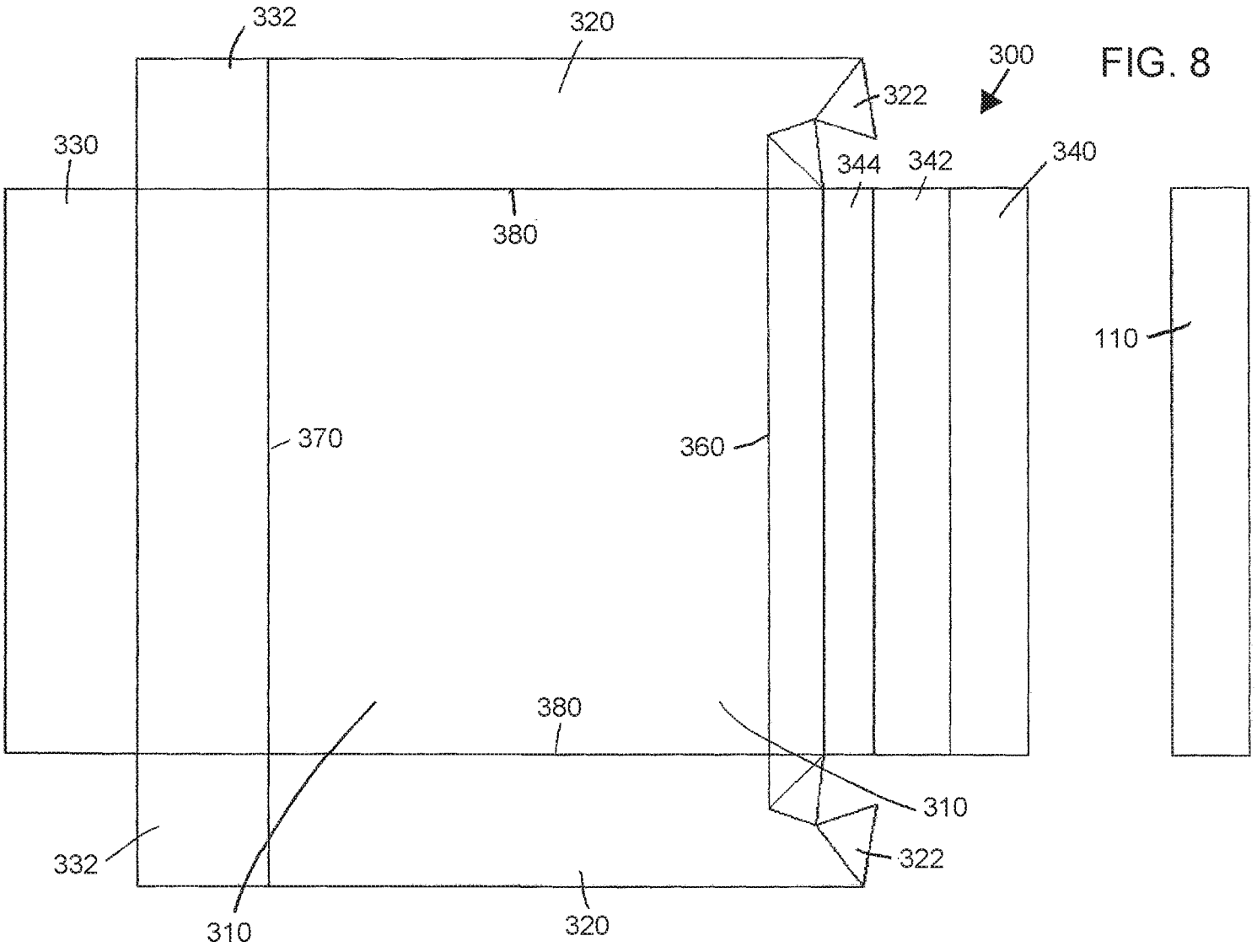
FIG. 8 is a top view of a pre-folded side tobacco hopper.

FIG. 8 is a top view of a pre-folded side tobacco hopper. In this exemplary embodiment, the side tobacco hopper 300 includes a base 310, side flanges 320, side flange tips 322, rear flange 330, rear flange tips 332, front flange 340, 342, and 344, a front edge 360, a rear edge 370, and a side edge 380, and a side adhering mechanism 110. The side tobacco hopper and its components will be described in greater detail below.

The side tobacco hopper 300 is folded from and made from the components illustrated in FIG. 8. Each flange is integrated along an edge of the base 310. The side flanges 320 are folded up and along the side edges 380. The rear flange 330 is folded up and along the rear edge 370. The front flange 340 is folded up and along the front edge 360. Once the front, side, and rear flanges are folded up and along their respective edges, the side flange tips 322 can be folded and interlocked into the space between the front flanges 340, 342, and 344. Once the front, side, and rear flanges are folded up, the side adhering mechanism 110 may be adhered to the bottom portion of the front flange 340. Any adhering material or fastener may be used such as tape, glue, staple, or any other commercially available material. The side adhering mechanism 110 may also be held in place by the weight of the tobacco rolling machine by having brackets or other tools be configured under the tobacco rolling machine. In addition, the side tobacco hopper 300 may be constructed from a base with a perforated pattern; the perforated pattern indicating where the flanges and flange tips are to be folded. Furthermore, the edges of the flange tips may contain self-adhesive such as two-sided tapes that can fasten the side tobacco hopper 300 into its proper shape and into a complete and full configuration. In yet another embodiment, the base may be constructed with a non-slip material so as to create a non-slip base for the side tobacco hopper 300. Examples of a non-slip base may be rubber, polypropylene, plastic, non-slip polyester etc.

Figure 9:
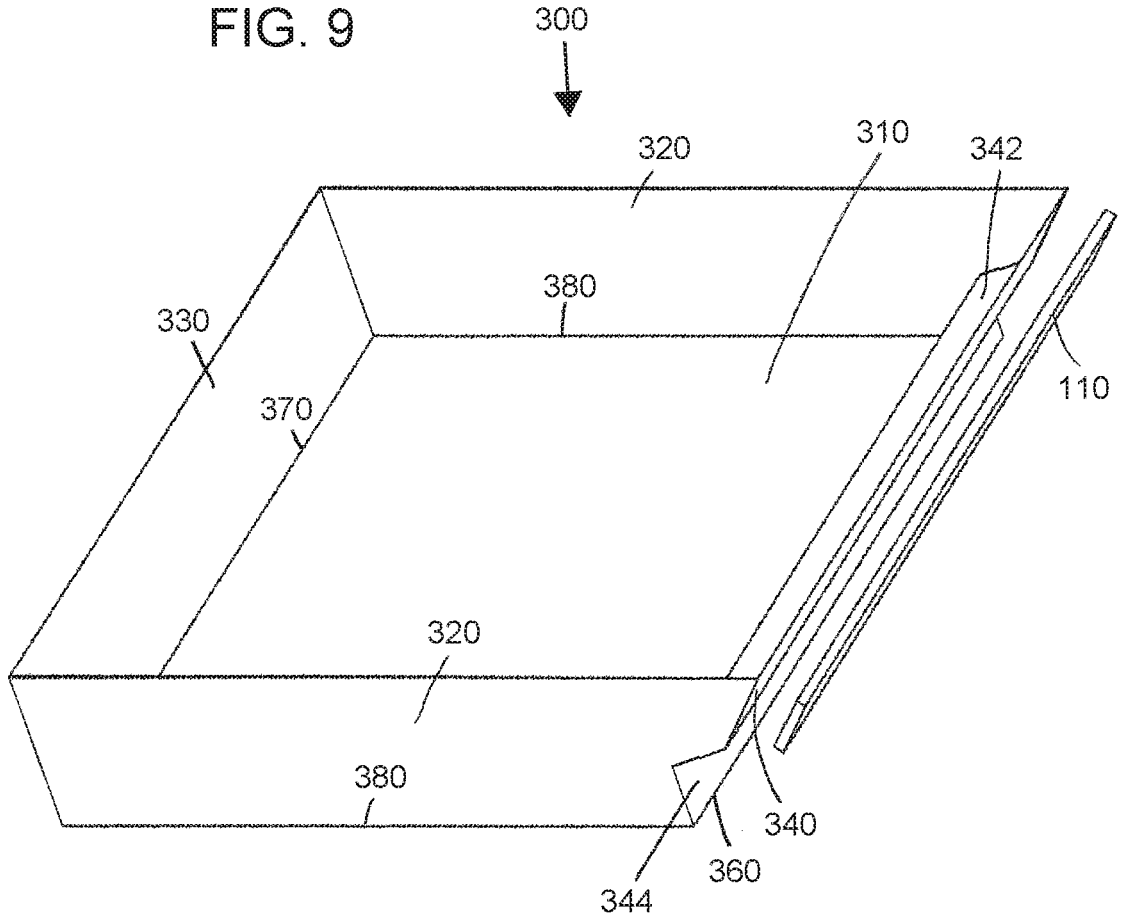
FIG. 9 is a perspective view of a folded side tobacco hopper.

FIG. 9 is a perspective view of a folded side tobacco hopper. FIG. 9 is the end-result of folding the pre-folded tobacco hopper in FIG. 8. As illustrated in FIG. 9, the side flanges 320 are folded up along side edge 380. Rear flange 330 is folded up along rear edge 370. Front flange 340, 342, and 344 are folded up along front edge 360. The side flange tips 332 are not visible in FIG. 9 because they are inserted in the corners between their respective flanges. As illustrated in FIG. 9, the side adhering mechanism 110 aligns with the front flange 340.

Figure 10:
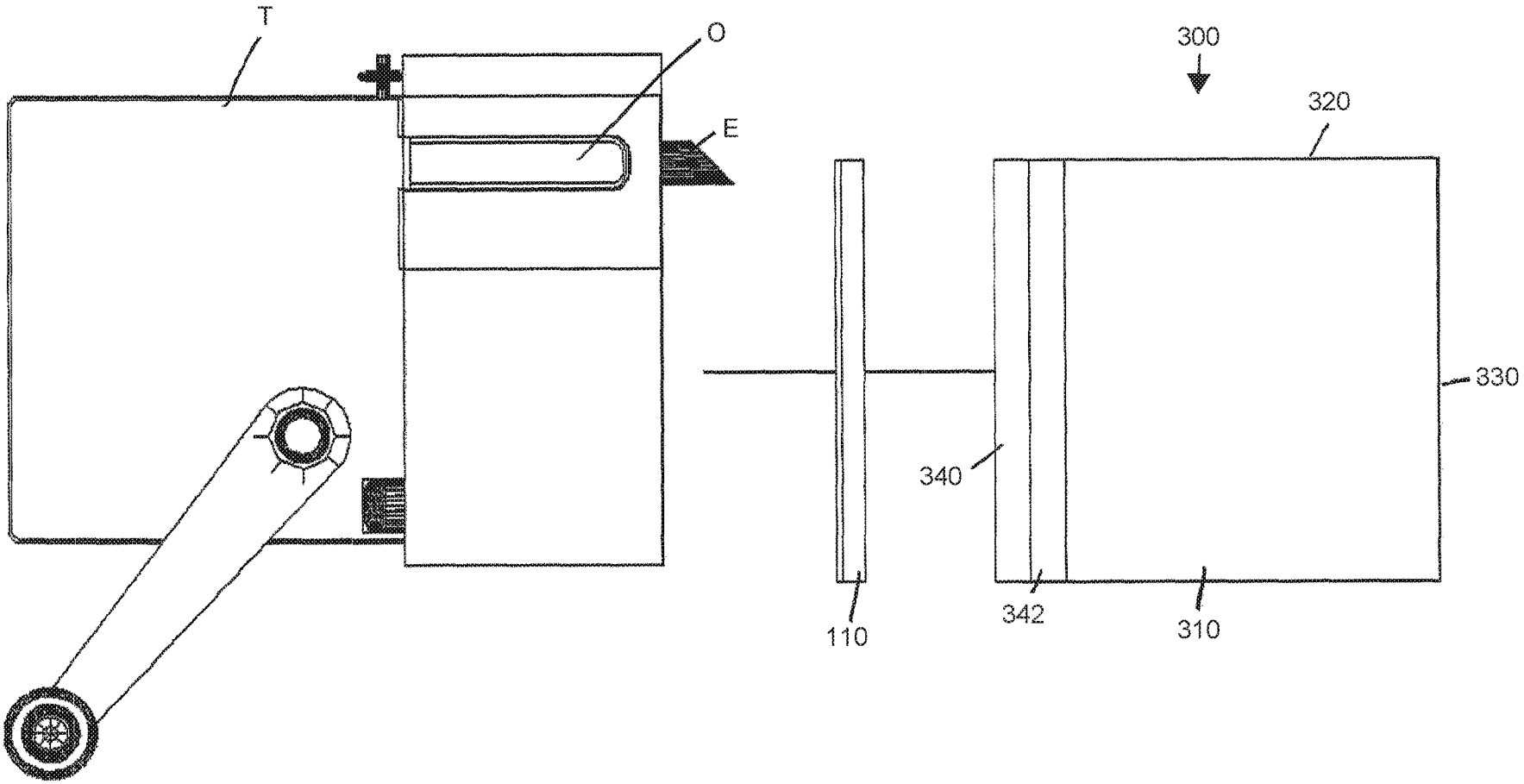
FIG. 10 is a top view of a folded side tobacco hopper and a tobacco rolling machine.

FIG. 10 is a top view of a folded side tobacco hopper and a tobacco rolling machine T. As illustrated in FIG. 10, the side tobacco hopper 300 aligns with the side mechanism 110. Also illustrated are the tobacco rolling machine T, the chamber opening O, and the exit chamber E. As illustrated, the side adhering mechanism 110 aligns with the exit chamber E such that the side adhering mechanism 110 does not obstruct the exit chamber E. The exit chamber E remains unobstructed and a smoker can place tobacco into the chamber opening O without fear of excess tobacco spilling elsewhere. The side adhering mechanism 110 can be adhered or fastened to the side tobacco hopper 300. Any adhering material or fastener may be used such as tape, glue, staple, or any other commercially available material.

Figure 11:
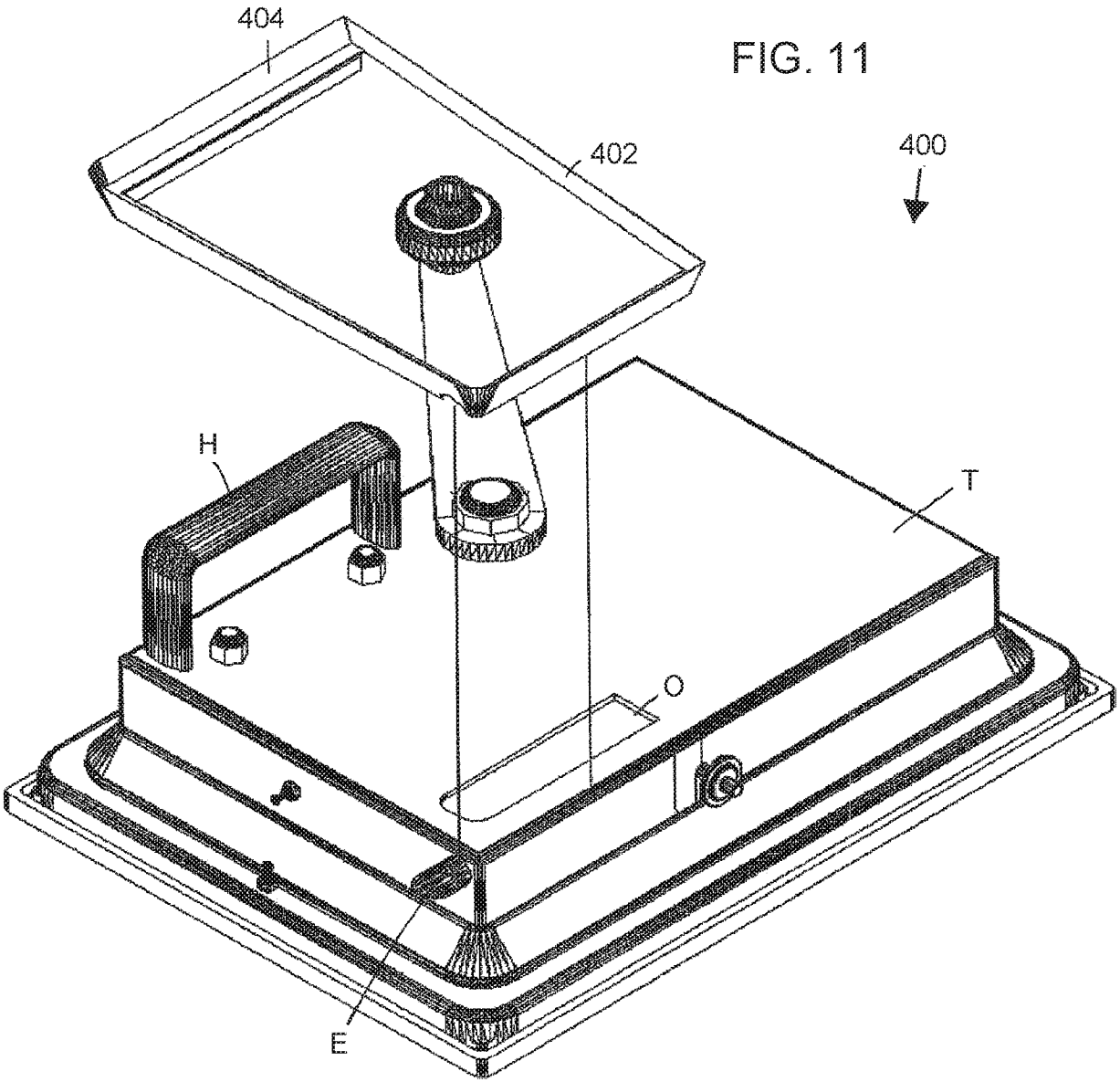
FIG. 11 is a perspective view of another embodiment of a top tobacco hopper.
Figure 12:
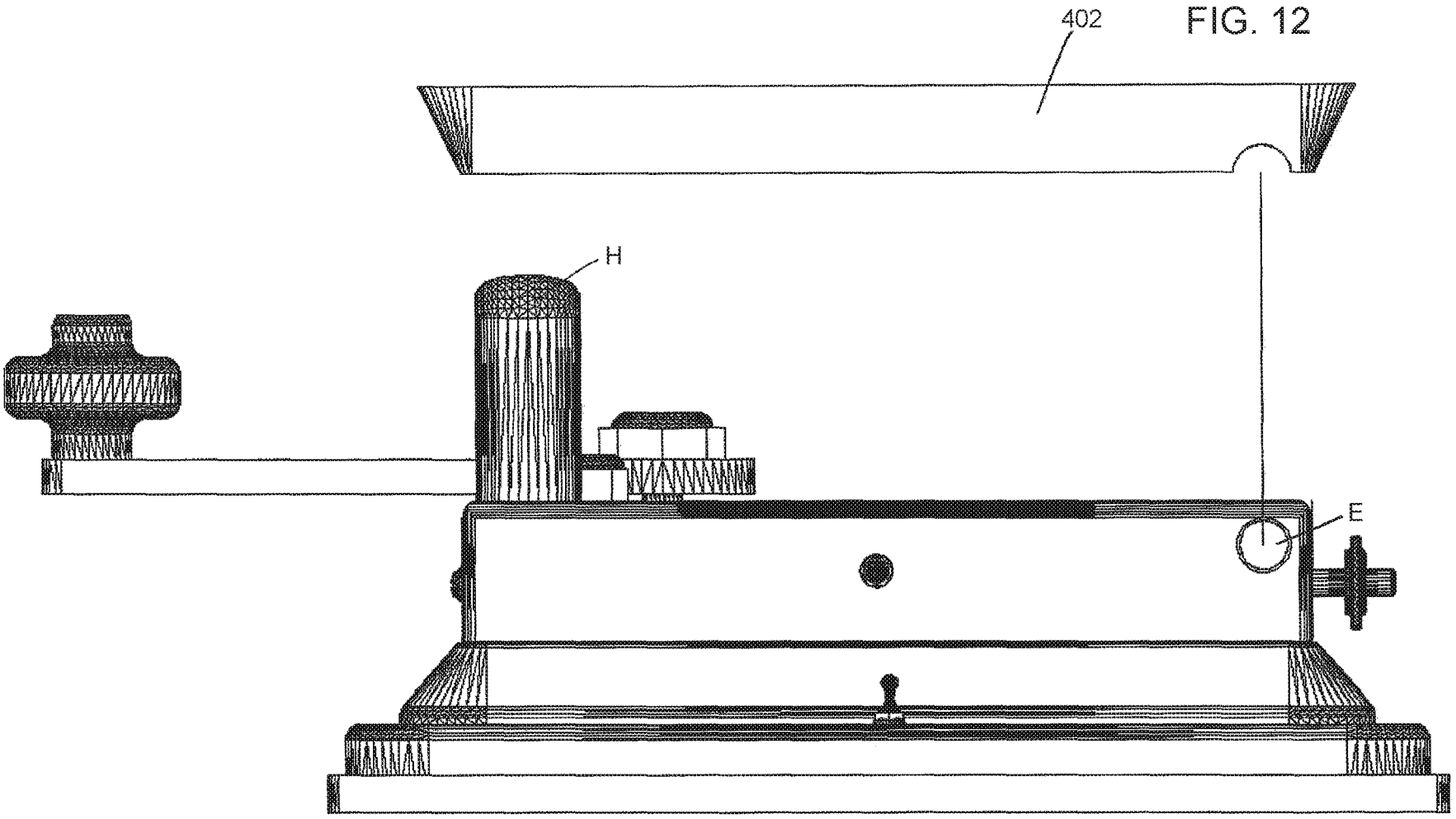
FIG. 12 is a side view of another embodiment of a top tobacco hopper.
Figure 13:
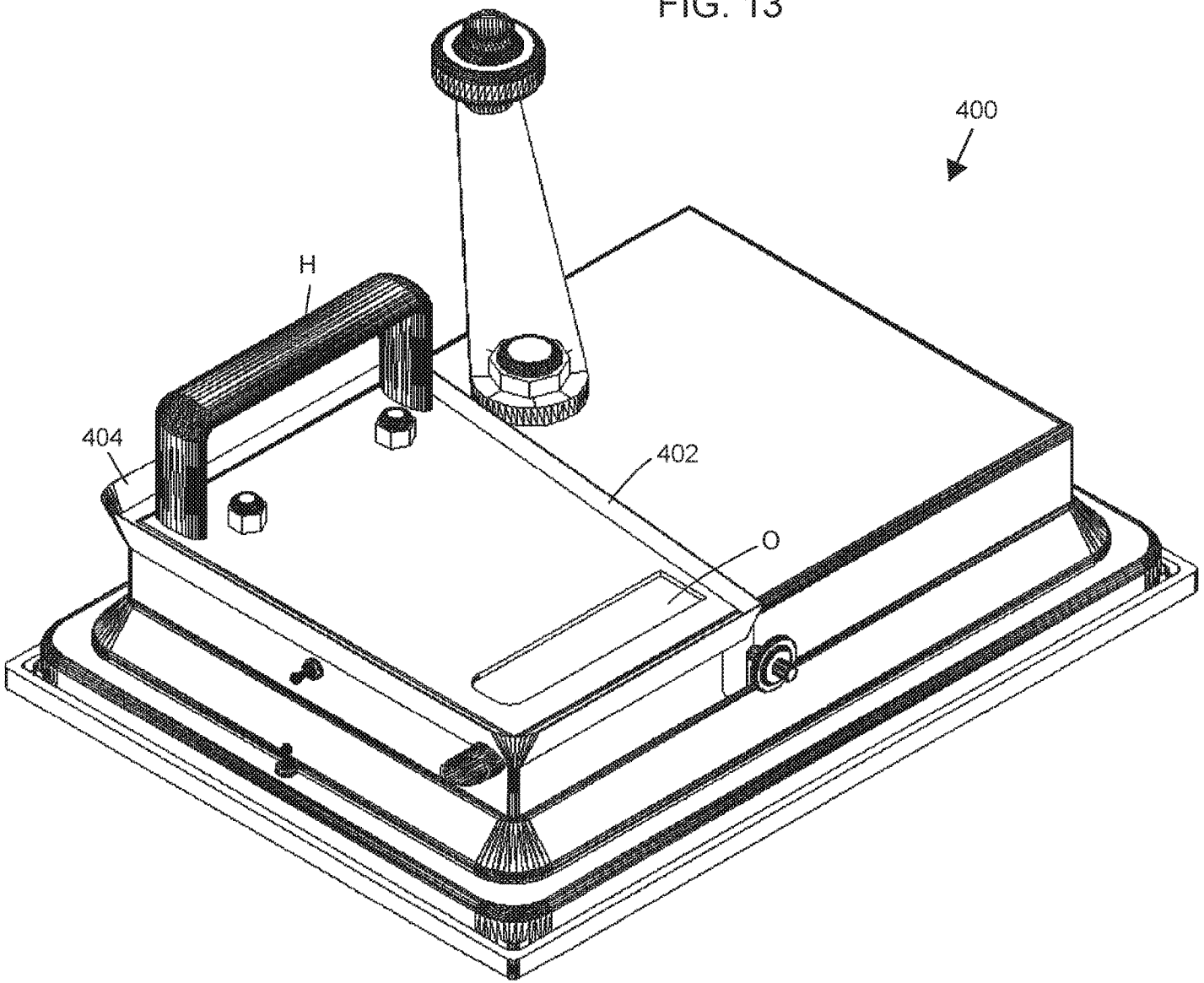
FIG. 13 is a perspective view of another embodiment of a top tobacco hopper placed on the tobacco rolling machine.
Figure 14:
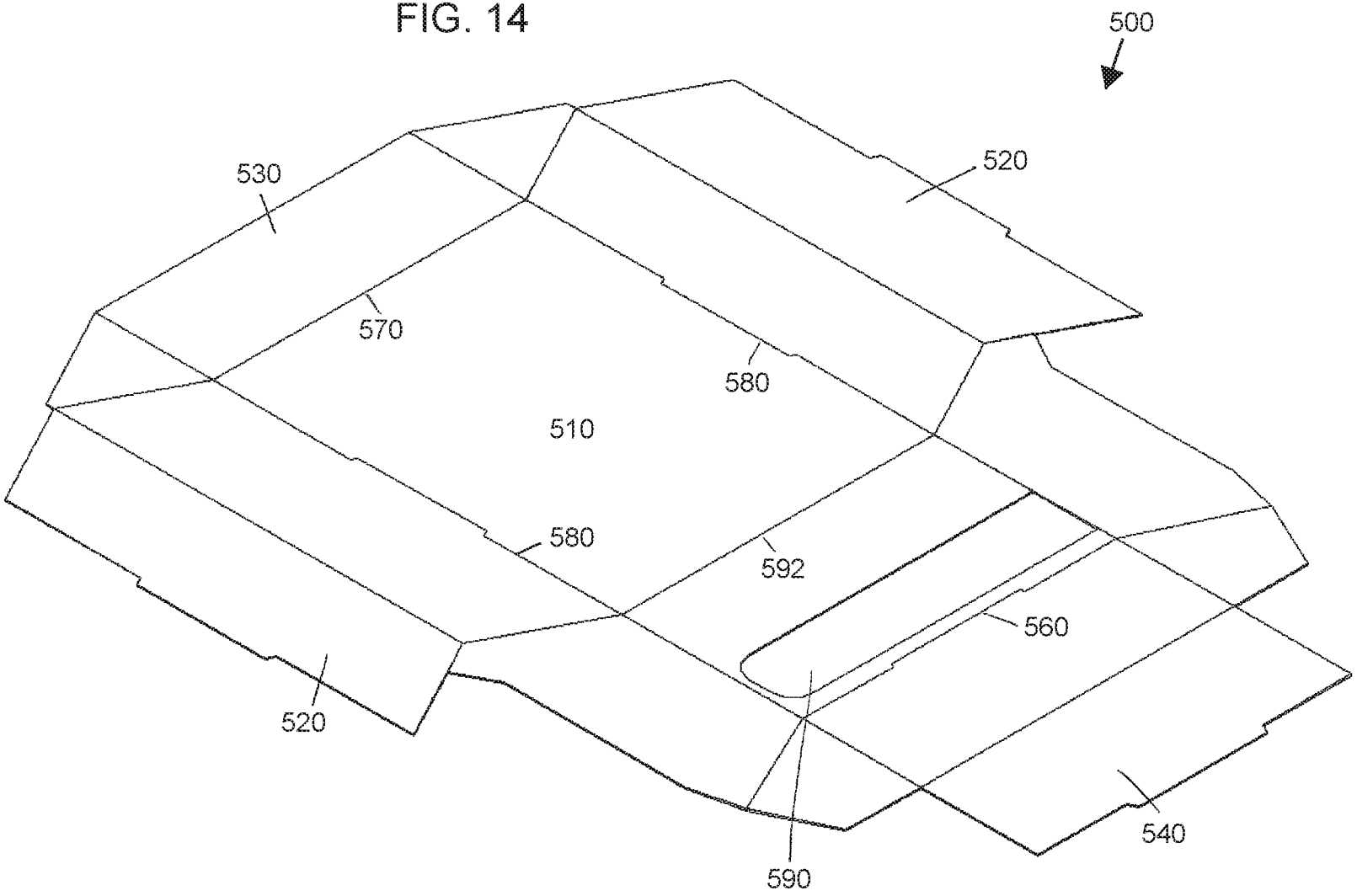
FIG. 14 is a perspective view of another embodiment of a top tobacco hopper and illustrate the process of assembling the top tobacco hopper.
Figure 15:
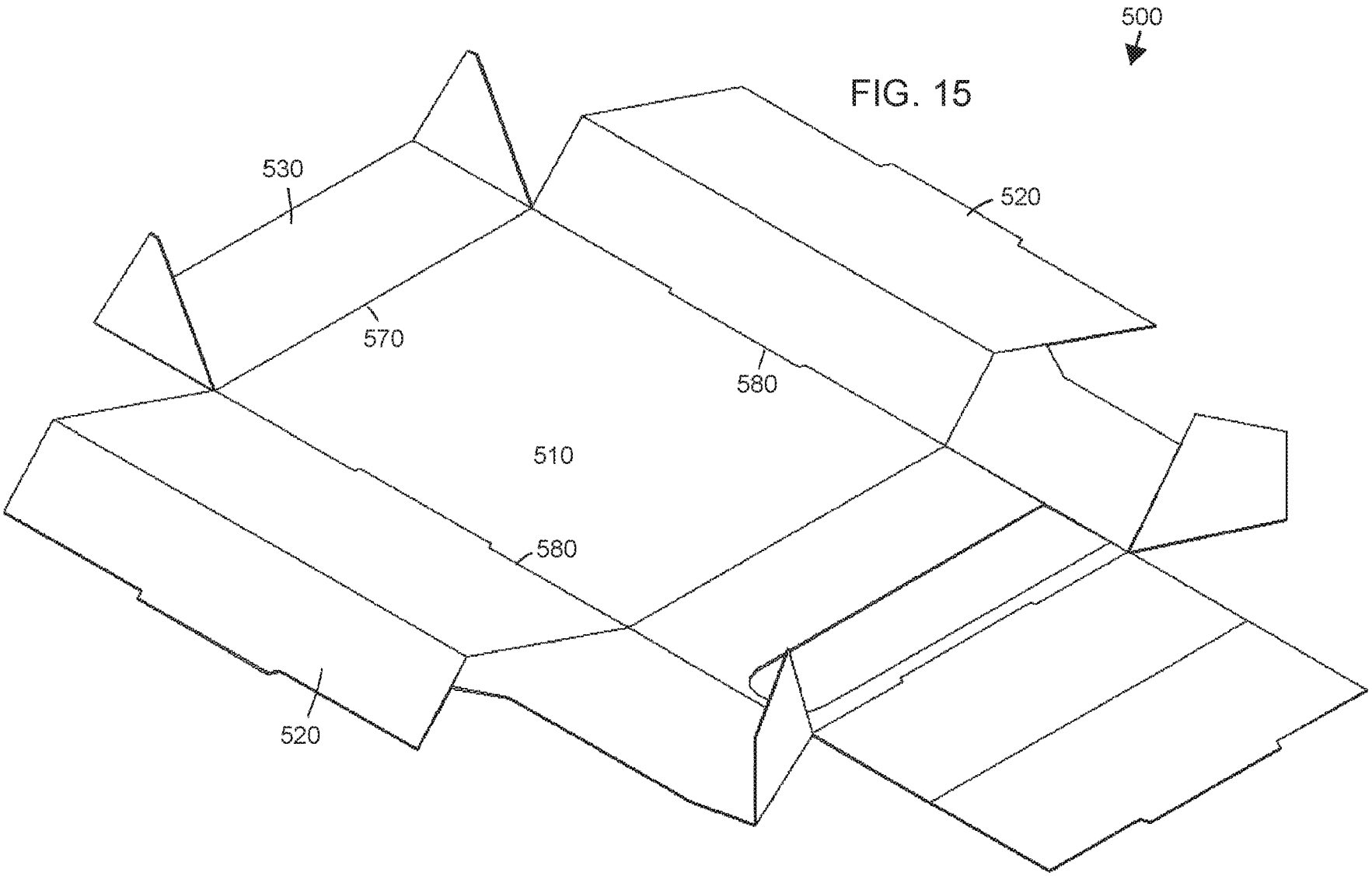
FIG. 15 is another perspective view of the embodiment of a top tobacco hopper and illustrates the process of assembling the top tobacco hopper from FIG. 14.
Figure 16:
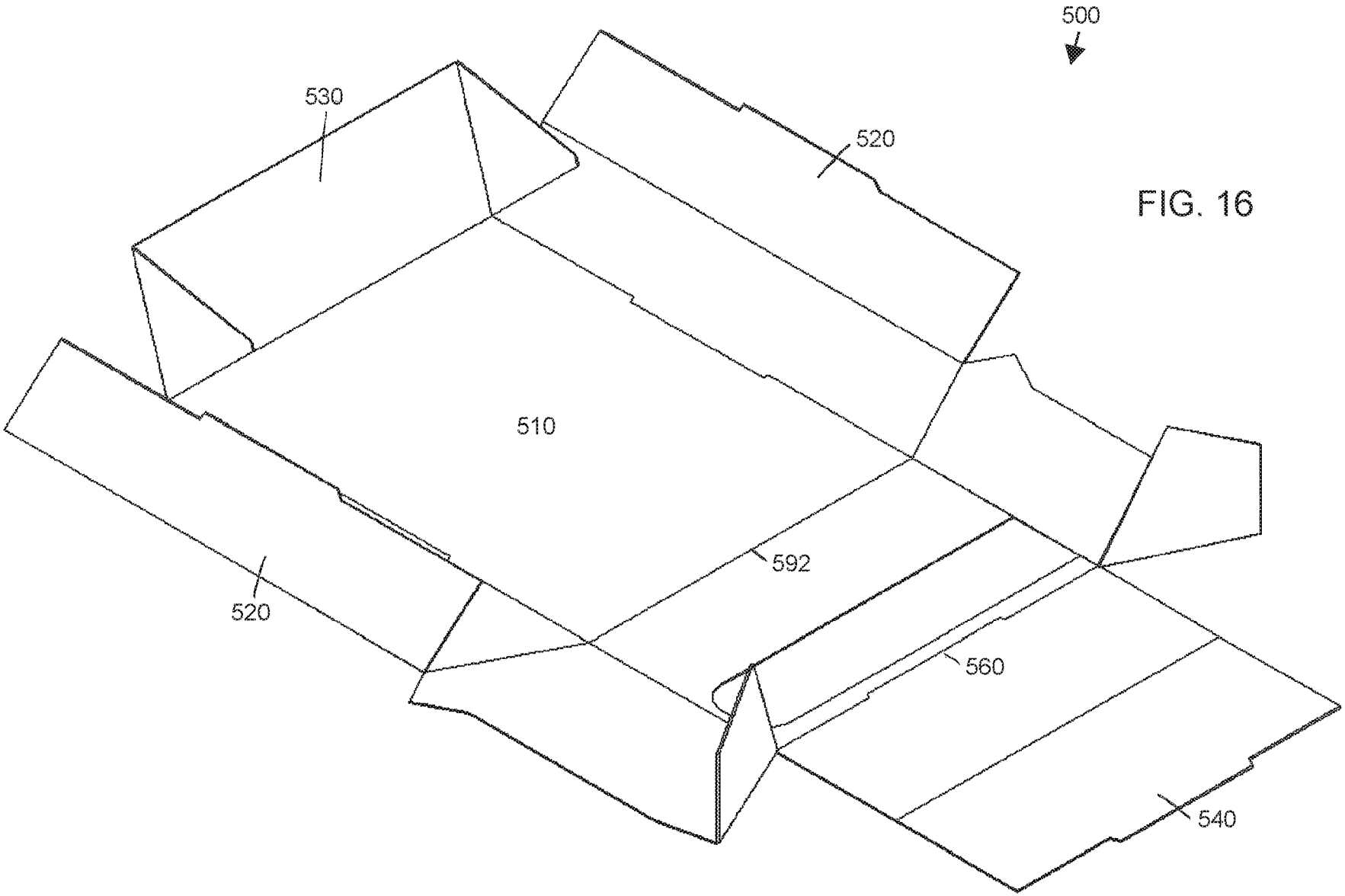
FIG. 16 is another perspective view of the embodiment of a top tobacco hopper and illustrates the process of assembling the top tobacco hopper from FIG. 14.
Figure 17:
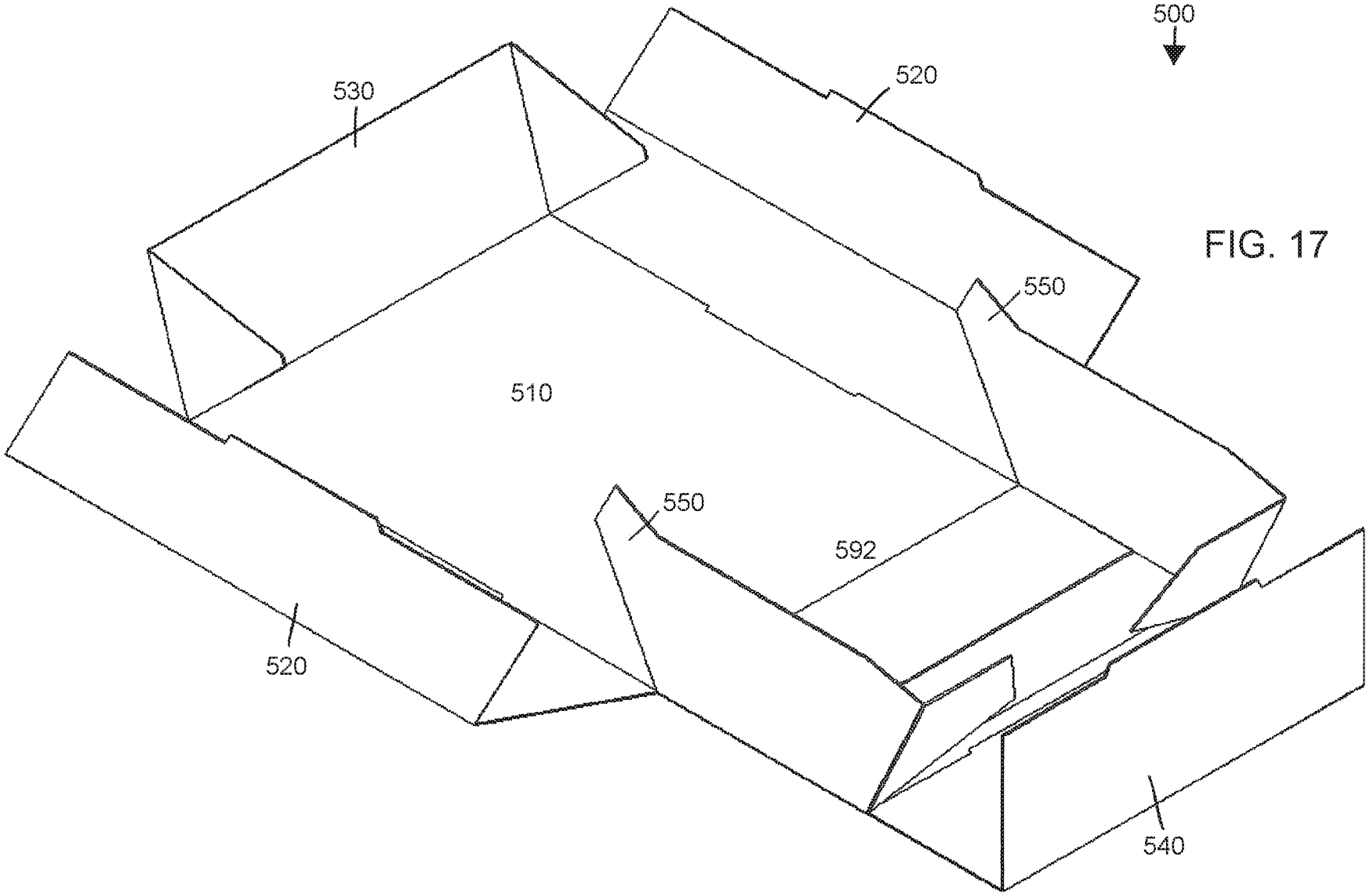
FIG. 17 is another perspective view of the embodiment of a top tobacco hopper and illustrates the process of assembling the top tobacco hopper from FIG. 14.
Figure 18:
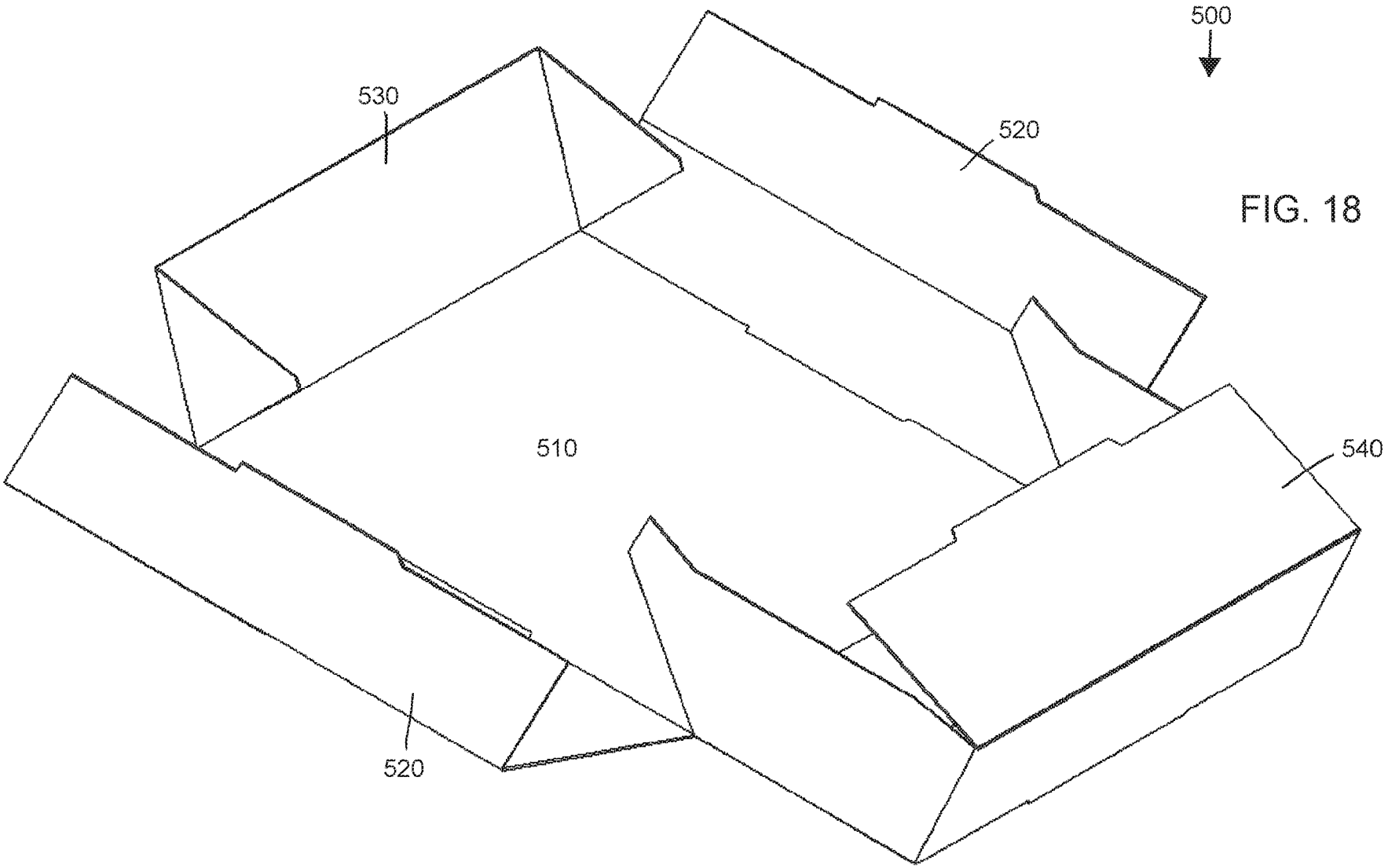
FIG. 18 is another perspective view of the embodiment of a top tobacco hopper and illustrates the process of assembling the top tobacco hopper from FIG. 14.
Figure 19:
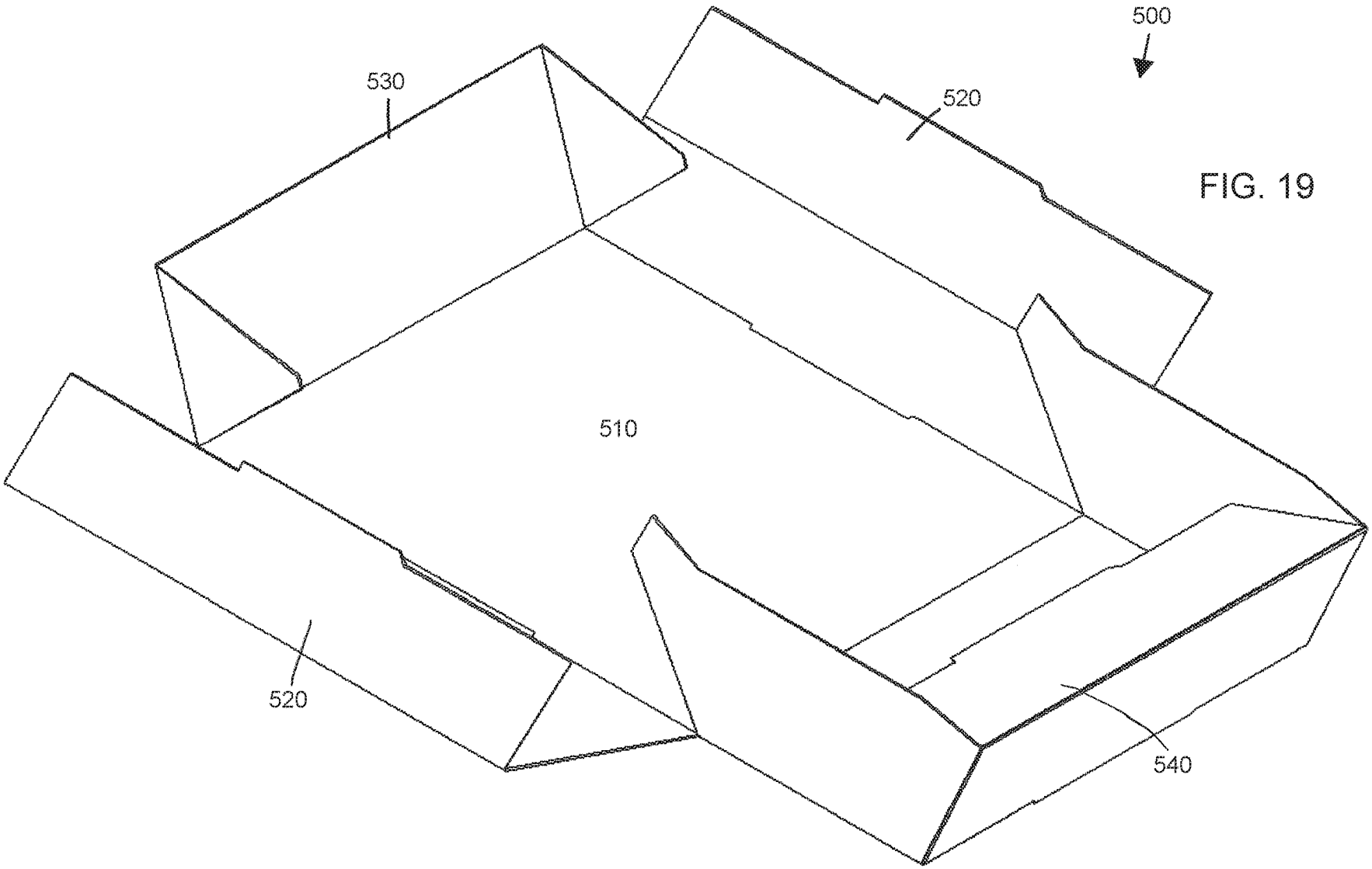
FIG. 19 is another perspective view of the embodiment of a top tobacco hopper and illustrates the process of assembling the top tobacco hopper from FIG. 14.
Figure 20:
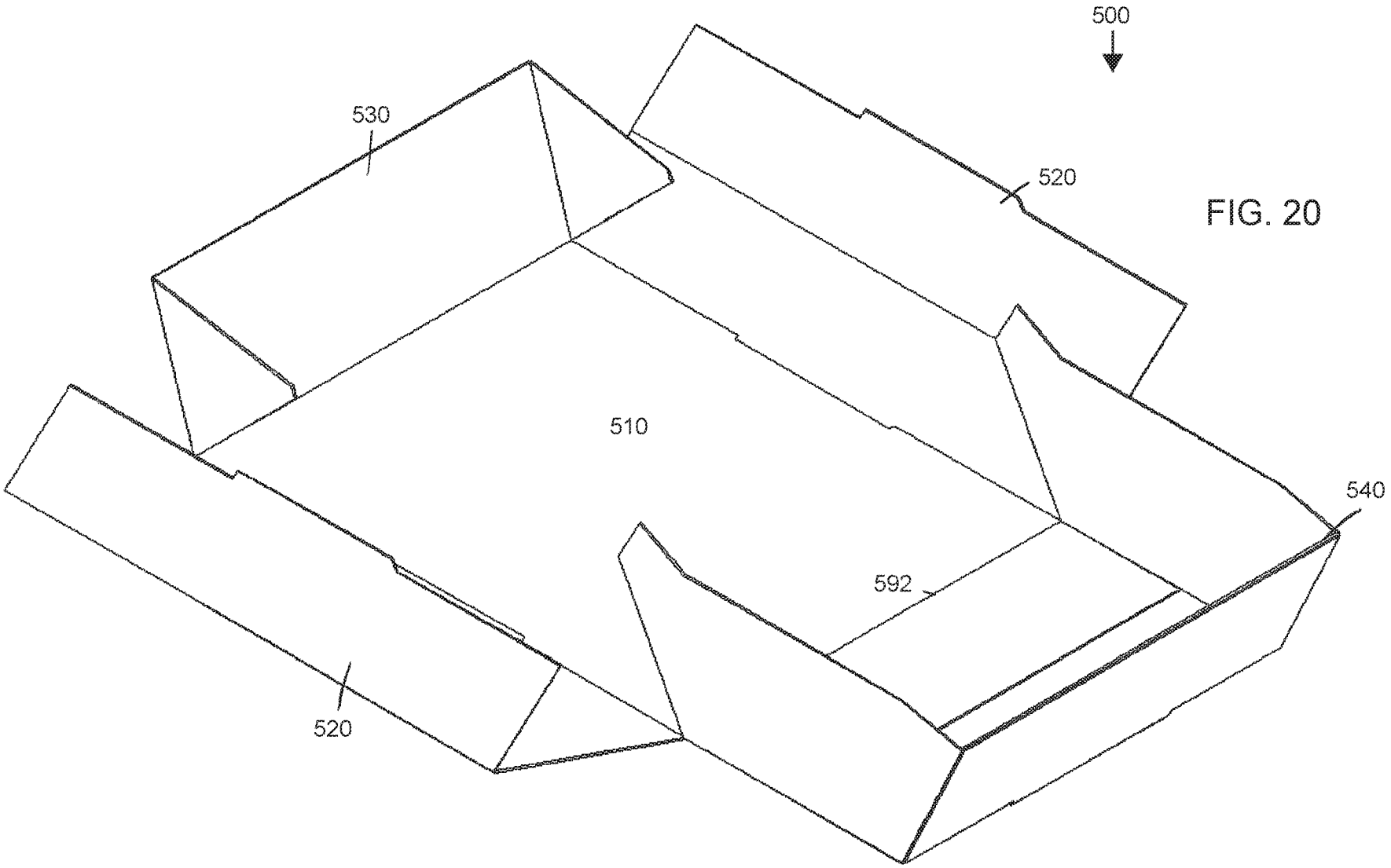
FIG. 20 is another perspective view of the embodiment of a top tobacco hopper and illustrates the process of assembling the top tobacco hopper from FIG. 14.
Figure 21:
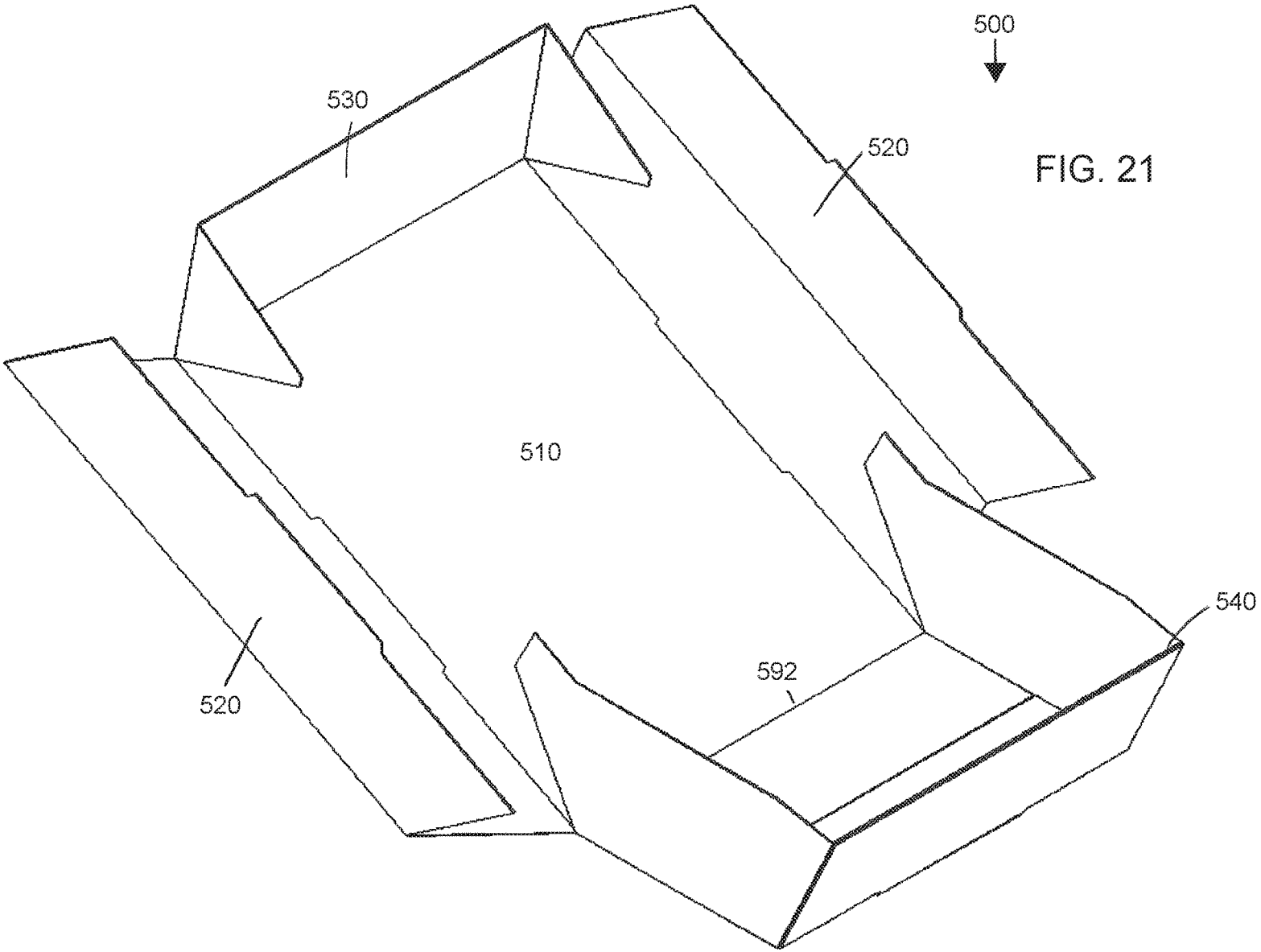
FIG. 21 is another perspective view of the embodiment of a top tobacco hopper and illustrates the process of assembling the top tobacco hopper from FIG. 14.
Figure 22:
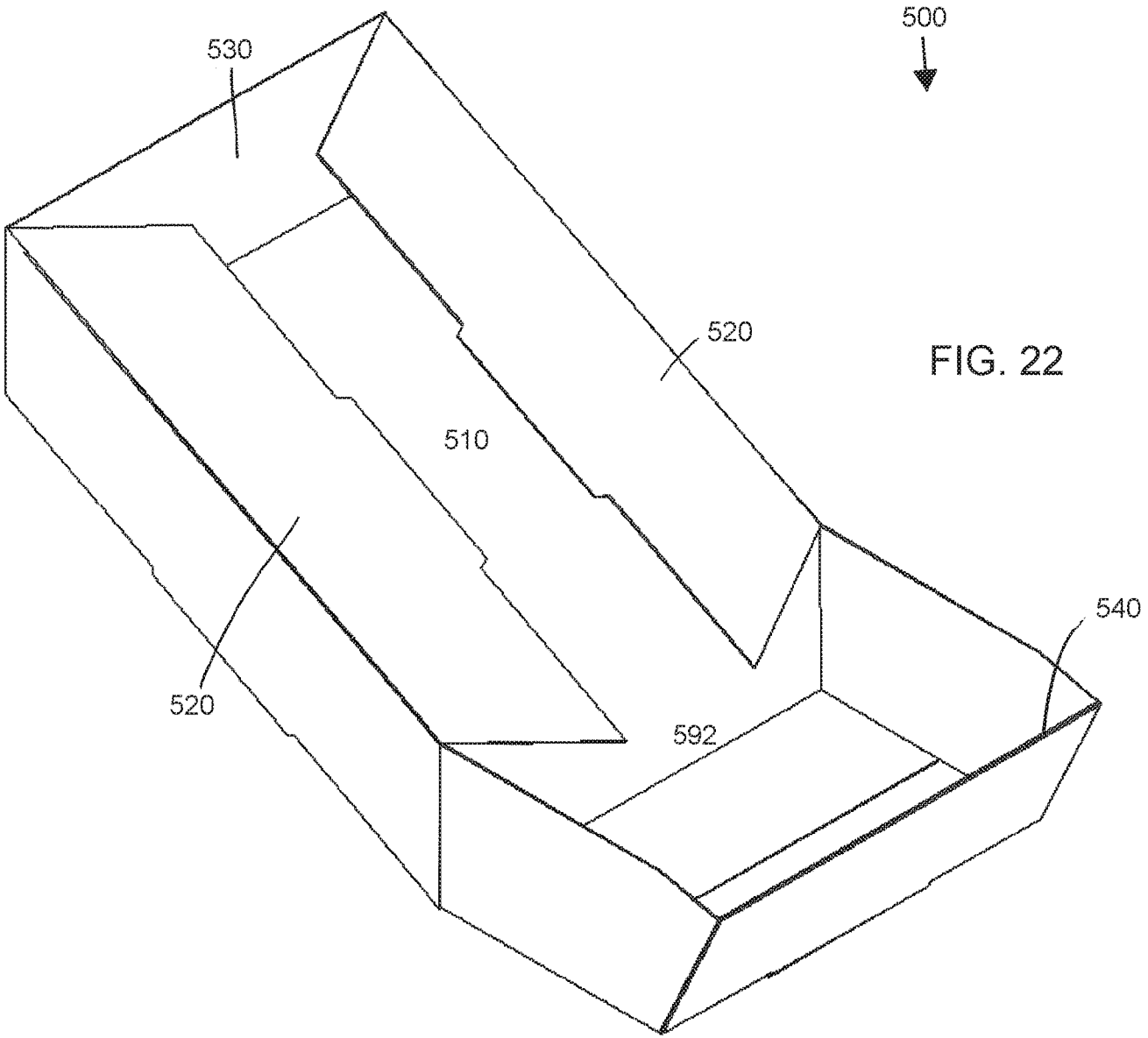
FIG. 22 is another perspective view of the embodiment of a top tobacco hopper and illustrates the process of assembling the top tobacco hopper from FIG. 14.
Figure 23:
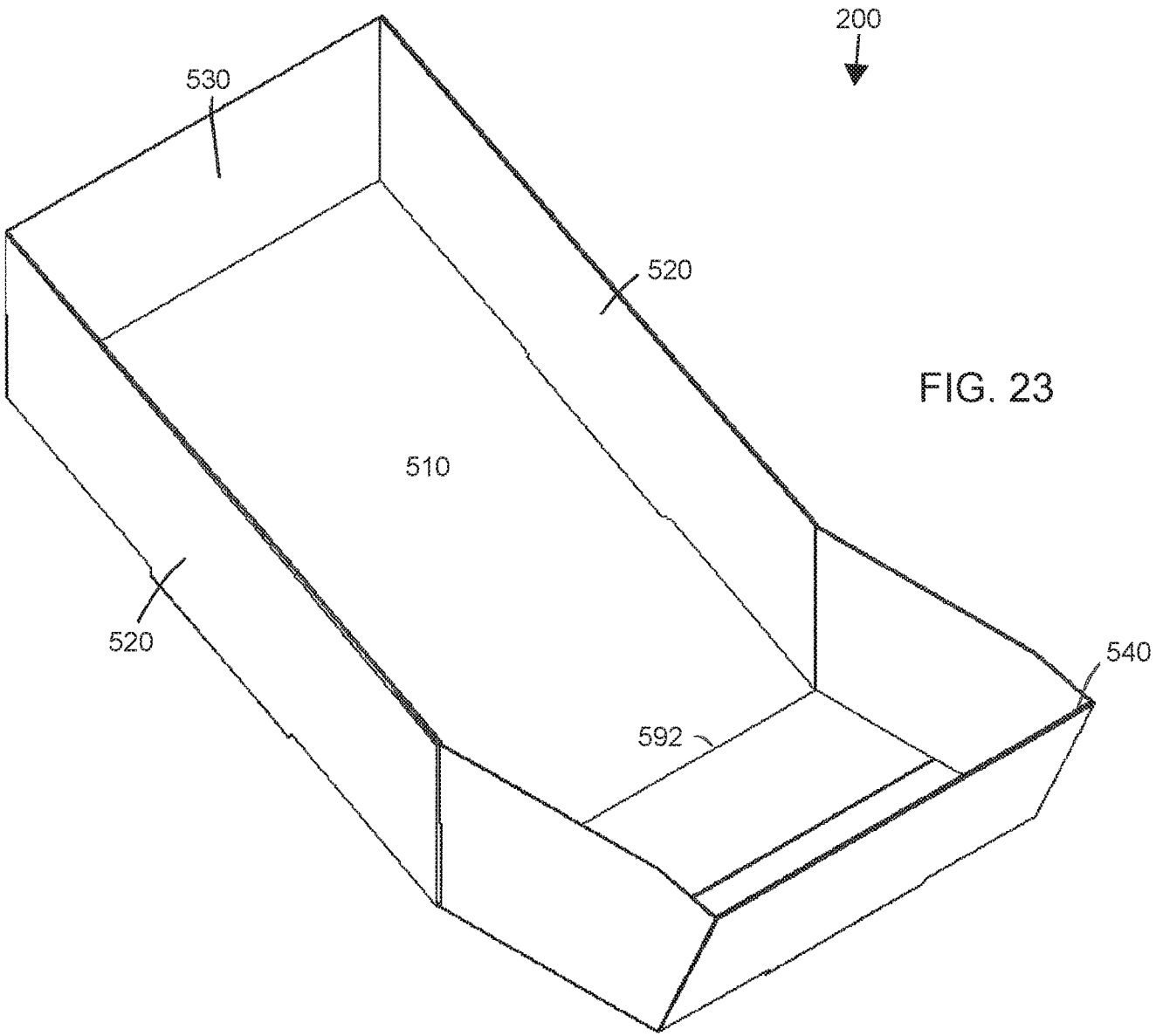
FIG. 23 is another perspective view of the embodiment of a top tobacco hopper and illustrates the process of assembling the top tobacco hopper from FIG. 14.

FIG. 11 is a perspective view of a top tobacco hopper where the top tobacco hoppers contains only sidewalls and can be fitted unto the sides of the tobacco rolling machine. FIG. 12 is a side view of a top tobacco hopper and its alignment with respect to the tobacco rolling machine. FIG. 13 is another perspective view of a top tobacco hopper where the top tobacco hopper is set unto a tobacco rolling machine.

As illustrated in FIGS. 11-13, the tobacco hopper system 400 includes a top tobacco hopper 402 with sidewalls and front wall 404. Also illustrated in FIG. 1 is a tobacco rolling machine T. In this embodiment, the top tobacco hopper 402 lacks a base; instead, the top tobacco hopper 402 contains sidewalls and a front wall 404. The top tobacco hopper 402 is adhered to the tobacco rolling machine T through an adhering mechanism or can be pressure fitted onto the tobacco rolling machine. In this embodiment, the adhering mechanisms may be magnetic strips or two-sided adhesive tape. The adhering mechanism may also be constructed from a non-slip surface such that the top hopper does not easily move when set unto the tobacco rolling machine T. Examples of a non-slip base may be rubber, polypropylene, non-slip plastic, or non-slip polyester etc. In this embodiment, the top tobacco hopper 402 is already configured in their final shape. In another embodiment, the top tobacco hopper 402 may be constructed from pre-cut metal, cardboard, or vacu-formed plastic. Other construction material may also be possible. The tobacco rolling machine T may be an already commercially available machine.

As illustrated in FIGS. 12-13, the tobacco hopper system 400 aligns with the tobacco rolling machine T such that the top tobacco hopper can be set the handle H and the tobacco opening O. The top tobacco hopper 402 also aligns with the exit chamber E. In one embodiment, the top tobacco hopper 402 may be pressure fitted along the sides of the tobacco rolling machine.

With the top tobacco hopper, a smoker can put a generous amount of loose tobacco into the top hopper 402 and into the chamber opening O of the tobacco rolling machine T. The location of the top tobacco hopper 402 stays within the area of the sidewalls and front wall.

FIGS. 14-25 are a perspective view of another embodiment of a top tobacco hopper and illustrate the process of assembling the top tobacco hopper.

In this exemplary embodiment, the top tobacco hopper 500 includes a base 510, side flanges 520, rear flange 530, front flange 540, a front edge 560, side flanges tips 550, a rear edge 570, side edges 580, an opening 590, and an incline folding line 592. The top tobacco hopper and its components will be described in greater detail below.

The top tobacco hopper 500 is folded from and made from the components illustrated in FIGS. 14-25. Each flange is integrated along an edge of the base 510. The side flanges 520 are folded up and along the side edges 580. The rear flange 530 is folded up and along the rear edge 570. The front flange 540 is folded up and along the front edge 560. Once the front, side, and rear flanges are folded up and along their respective edges, the front flange can be folded and interlocked with the side flange. Similarly, the side flange can be folded and interlocked between the side and the rear flanges and over the side flange tips 550. The rear flange can also be folded and interlocked with the side flange. The top tobacco hopper can also be folded along the incline folding line 592. Once the top tobacco hopper 500 is folded along the incline folding line 592, the base 510 can be configured at an inclined position. The side flange tips 550 helps secure the inclined configuration of the top tobacco hopper.

Once all flanges are in their correct position, the smoker can use a fastener to hold the top tobacco hopper in its correct configuration. Examples of fasteners can be tape, glue, staple, or any other commercially available material. Furthermore, the edges of the flange tips may contain self-adhesive such as two-sided tapes that can fasten the top tobacco hopper 500 into its proper shape and into a complete and full configuration. The flanges may also support themselves without fasteners because once they are interlocked, they can support the correct configuration of the hopper. In addition, the top tobacco hopper 500 may be constructed from a base with a perforated pattern; the perforated pattern indicating where the flanges and flange tips are to be folded. In yet another embodiment, the base may be constructed with a non-slip material so as to create a non-slip base for the top tobacco hopper 500. Examples of a non-slip base may be rubber, polypropylene, plastic, non-slip polyester etc.

Figure 24:
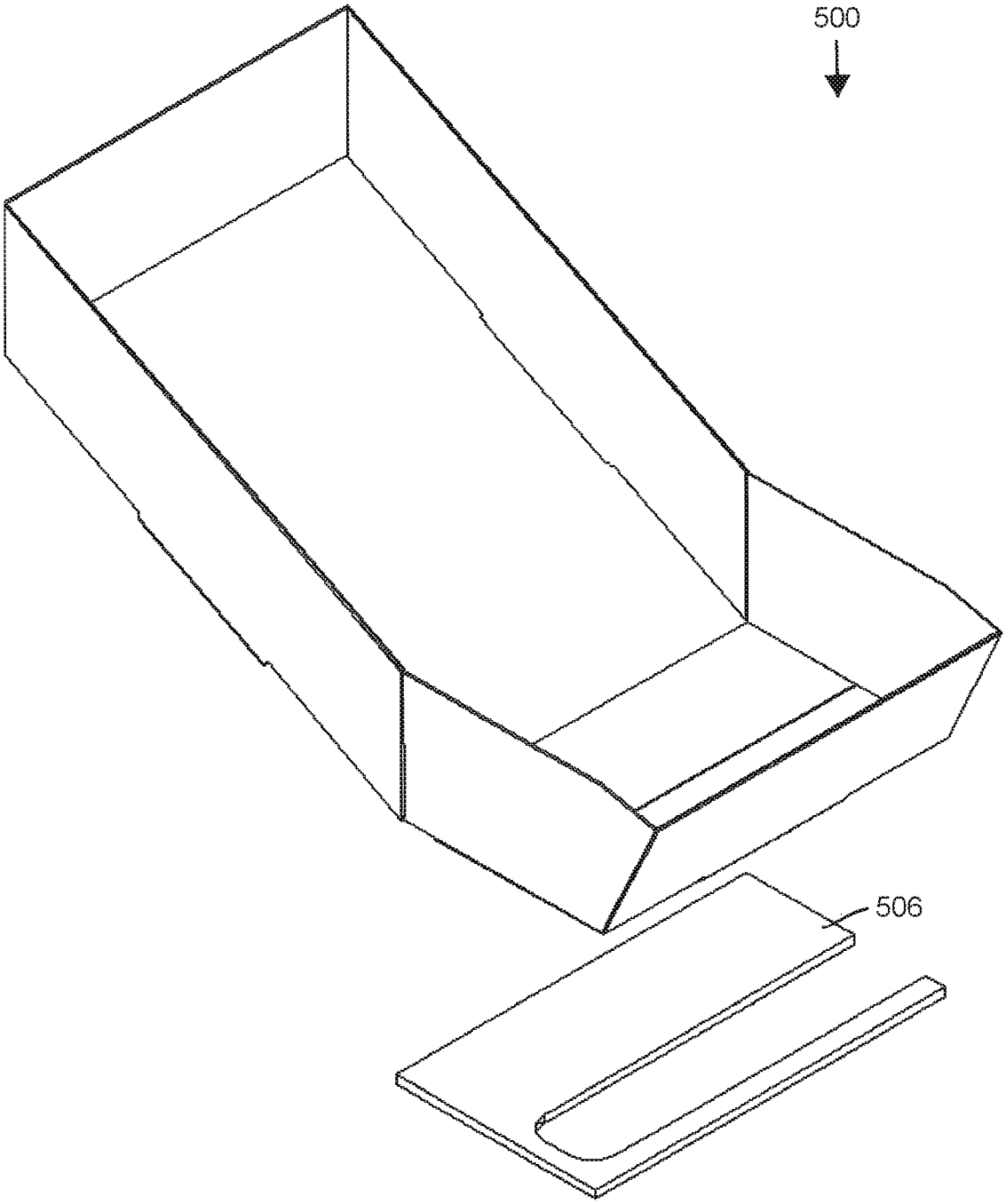
FIG. 24 is another perspective view of the embodiment of a top tobacco hopper and illustrates the process of assembling the top tobacco hopper from FIG. 14.
Figure 25:
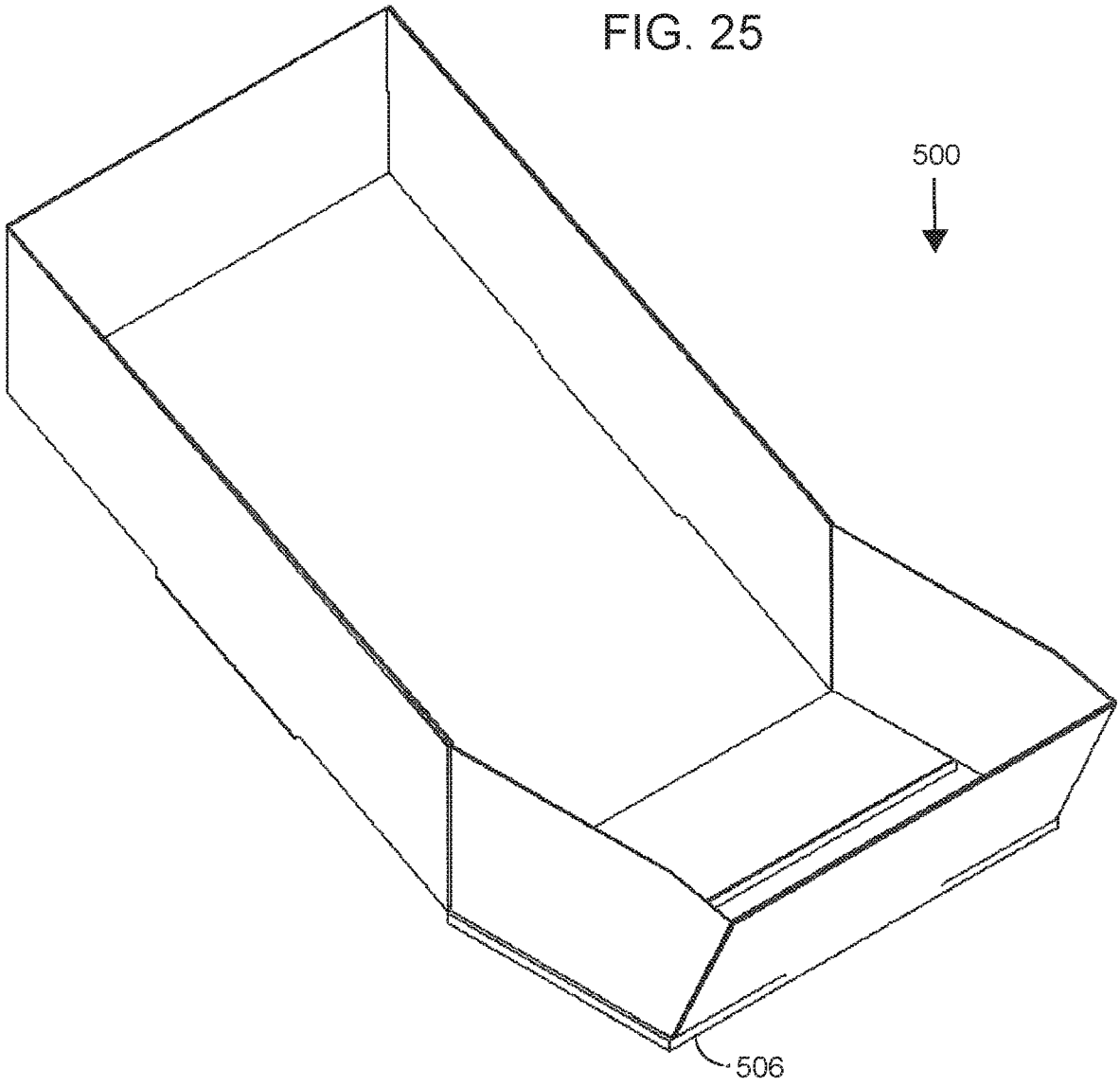
FIG. 25 is another perspective view of the embodiment of a top tobacco hopper and illustrates the process of assembling the top tobacco hopper from FIG. 14.
Figure 26:
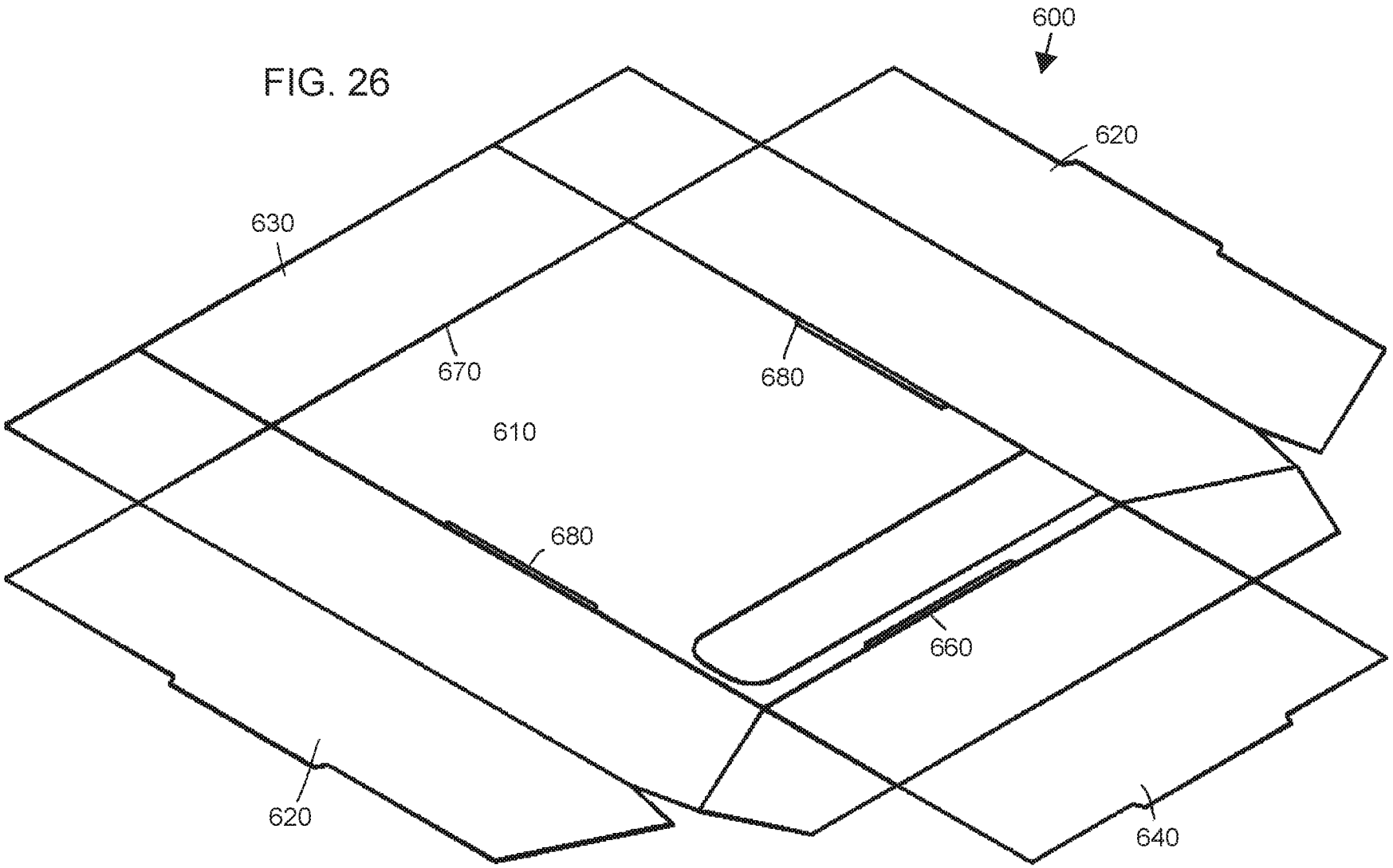
FIG. 26 is a perspective view of another embodiment of a top tobacco hopper and illustrate the process of assembling the top tobacco hopper.
Figure 27:
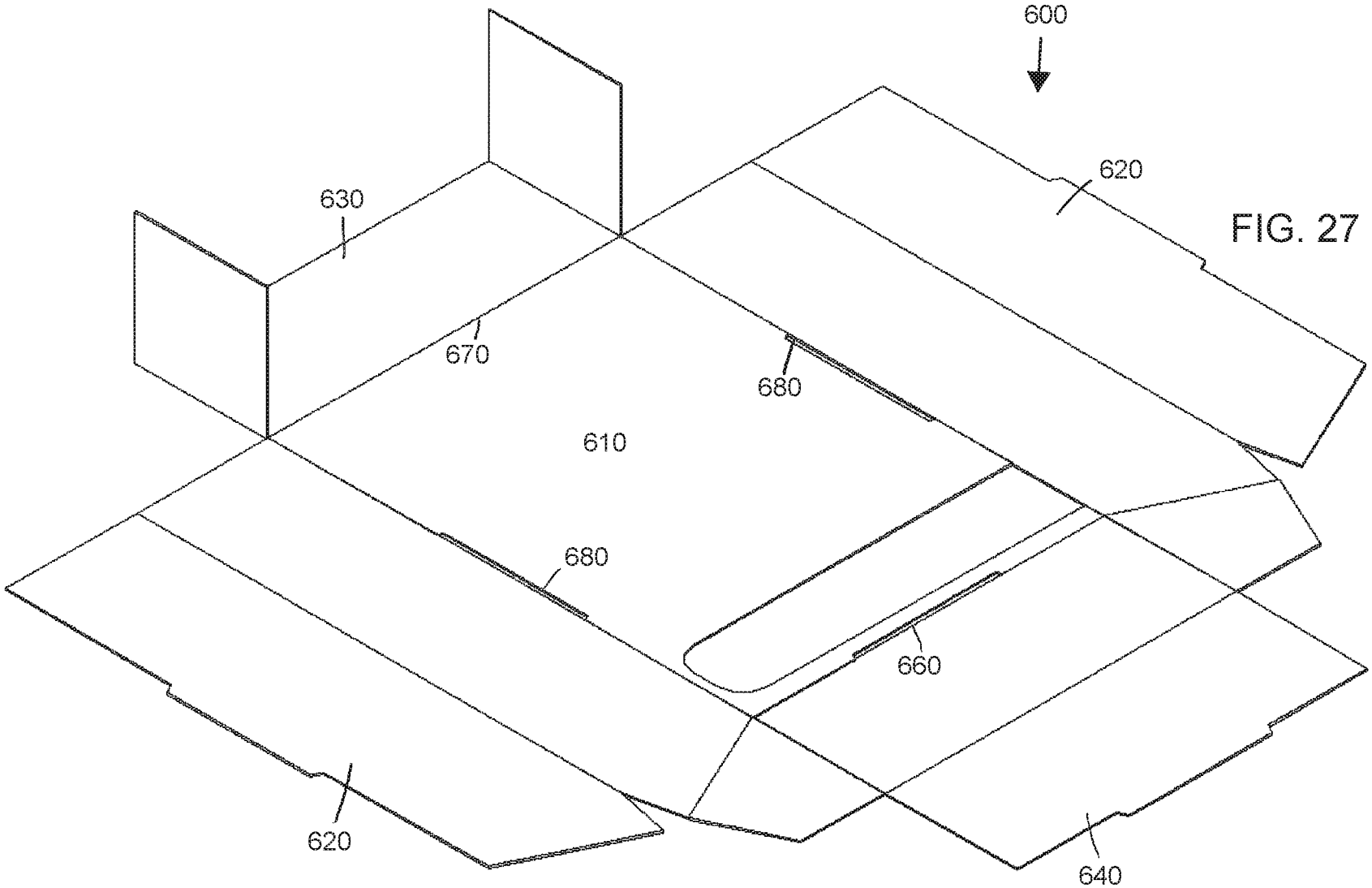
FIG. 27 is another perspective view of the embodiment of a top tobacco hopper and illustrates the process of assembling the top tobacco hopper from FIG. 26.
Figure 28:
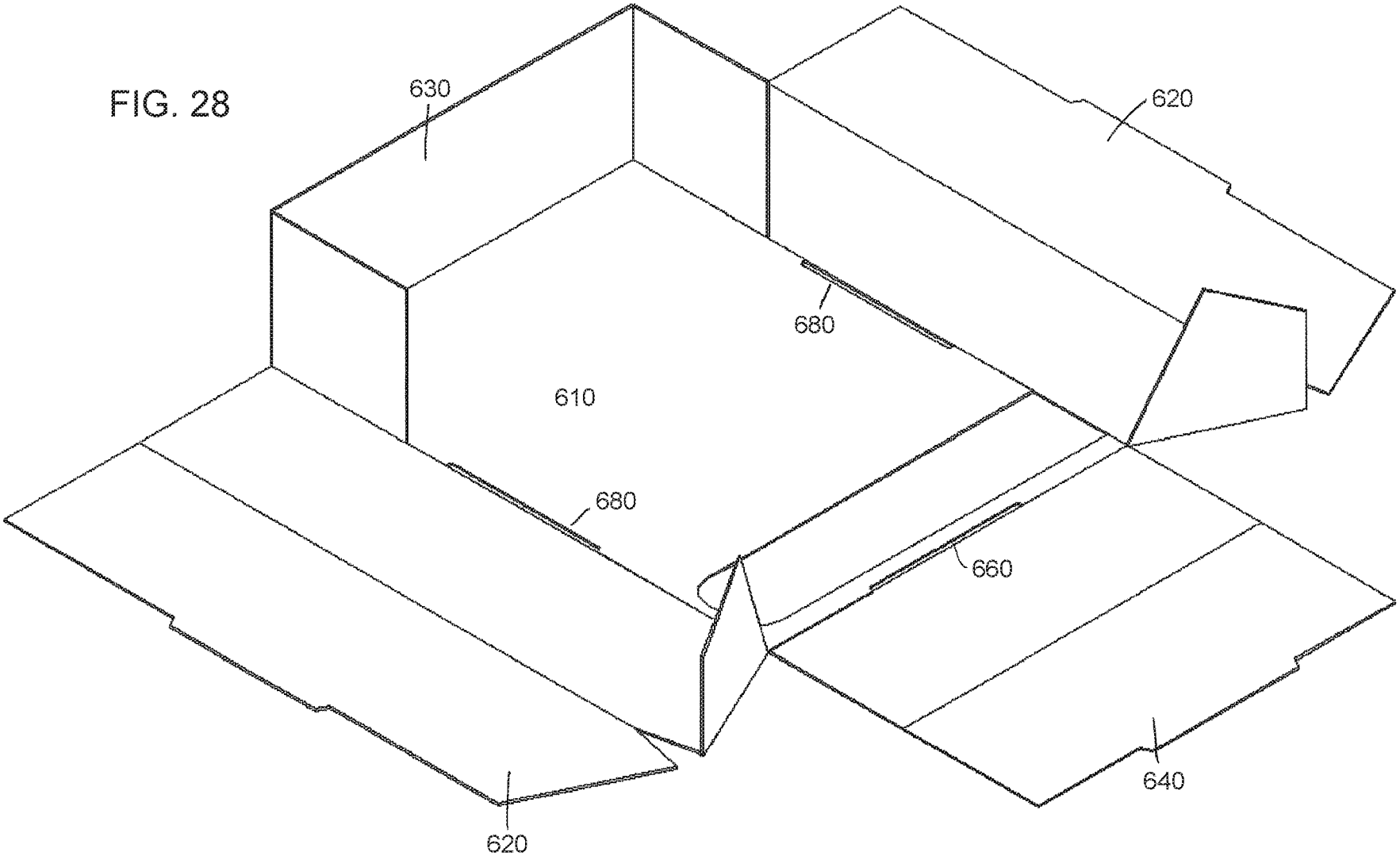
FIG. 28 is another perspective view of the embodiment of a top tobacco hopper and illustrates the process of assembling the top tobacco hopper from FIG. 26.
Figure 29:
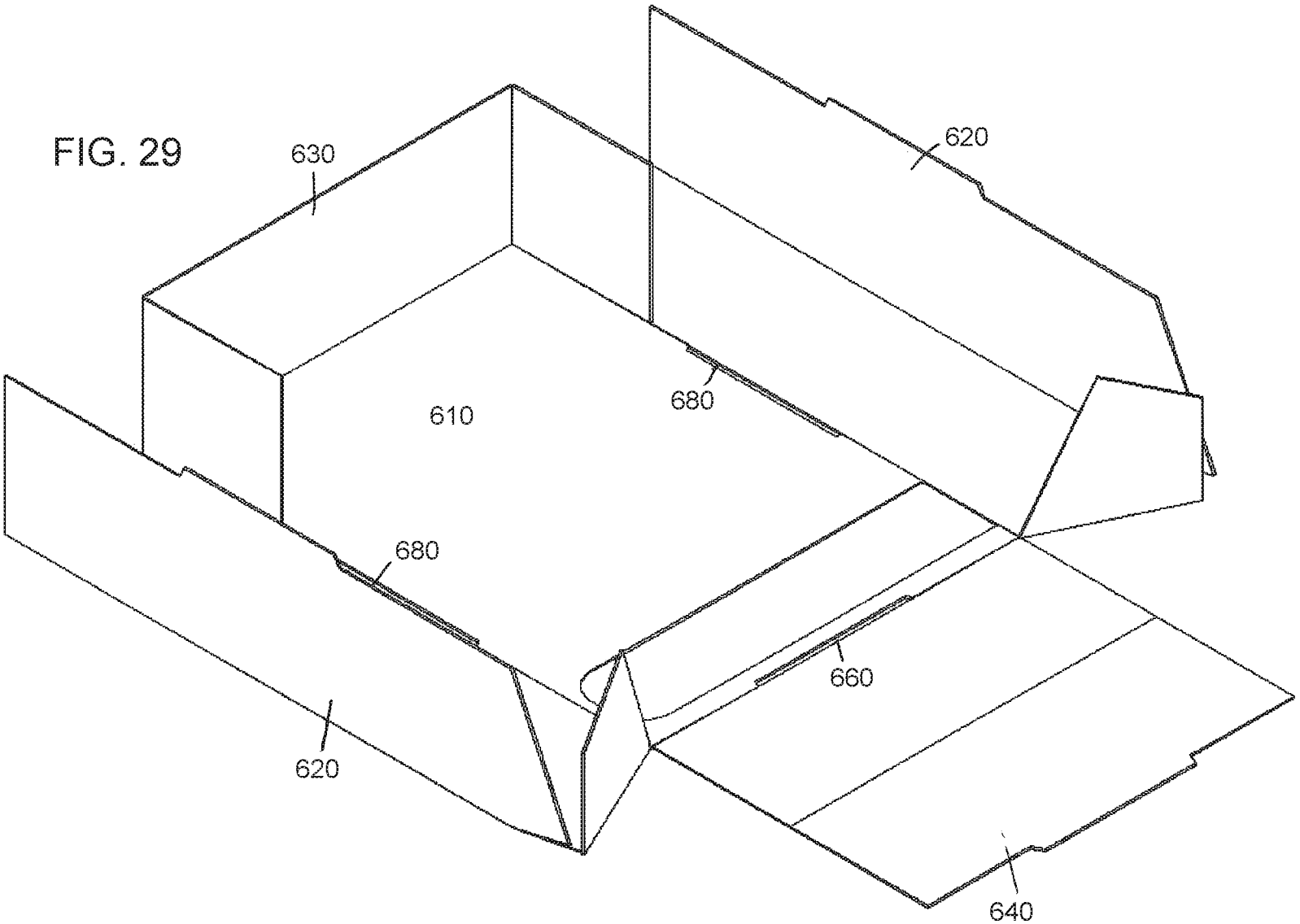
FIG. 29 is another perspective view of the embodiment of a top tobacco hopper and illustrates the process of assembling the top tobacco hopper from FIG. 26.
Figure 30:
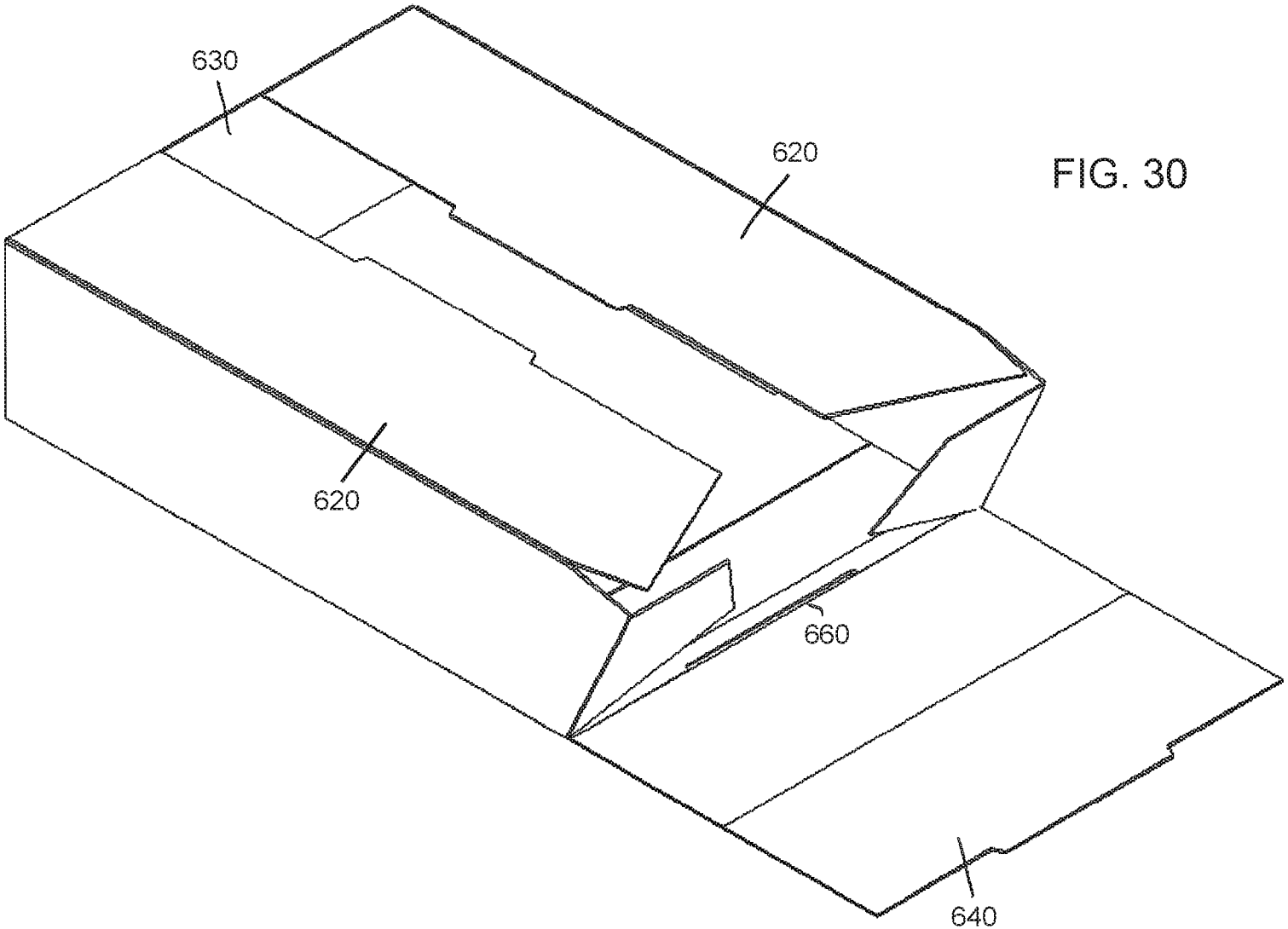
FIG. 30 is another perspective view of the embodiment of a top tobacco hopper and illustrates the process of assembling the top tobacco hopper from FIG. 26.
Figure 31:
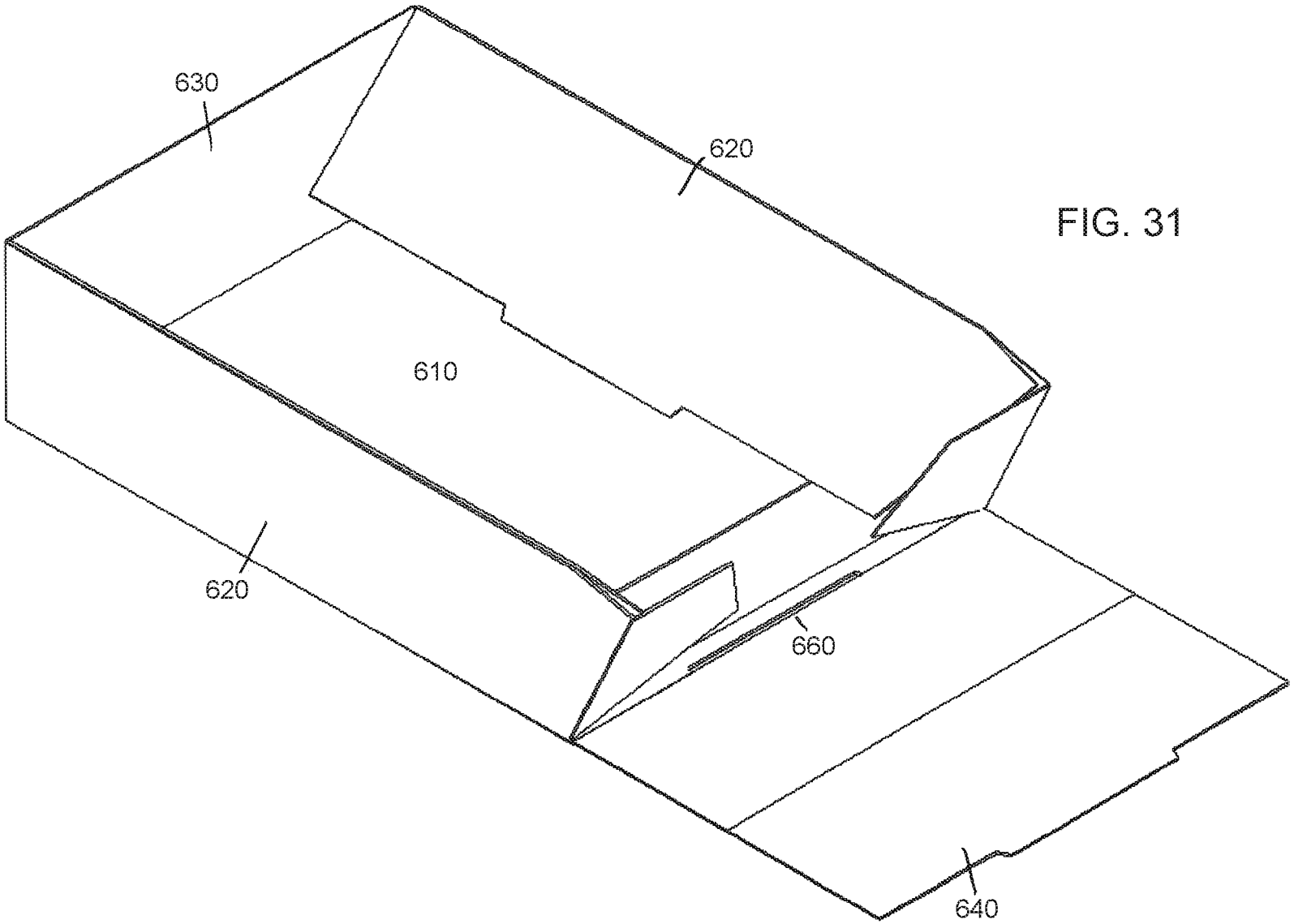
FIG. 31 is another perspective view of the embodiment of a top tobacco hopper and illustrates the process of assembling the top tobacco hopper from FIG. 26.
Figure 32:
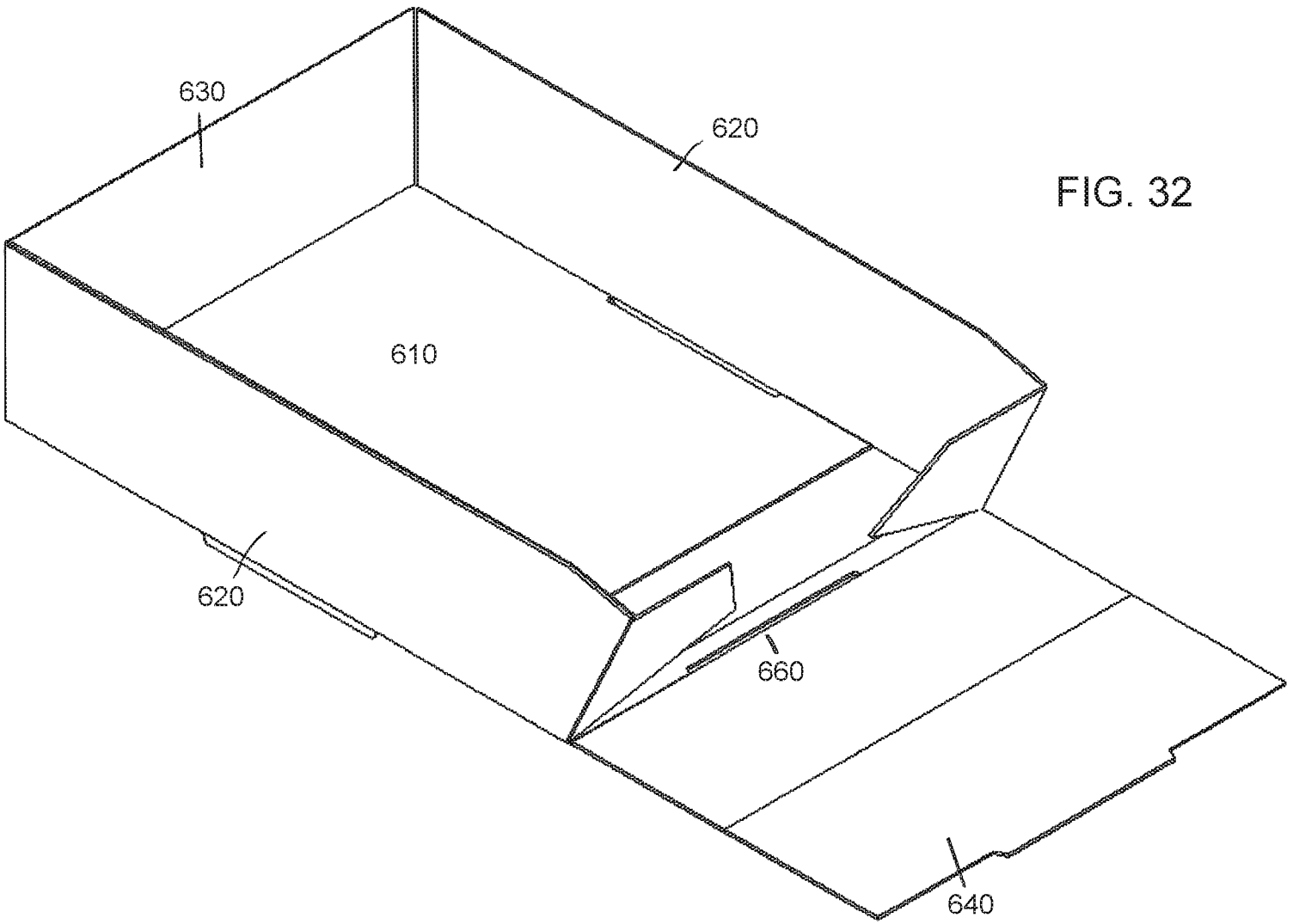
FIG. 32 is another perspective view of the embodiment of a top tobacco hopper and illustrates the process of assembling the top tobacco hopper from FIG. 26.
Figure 33:
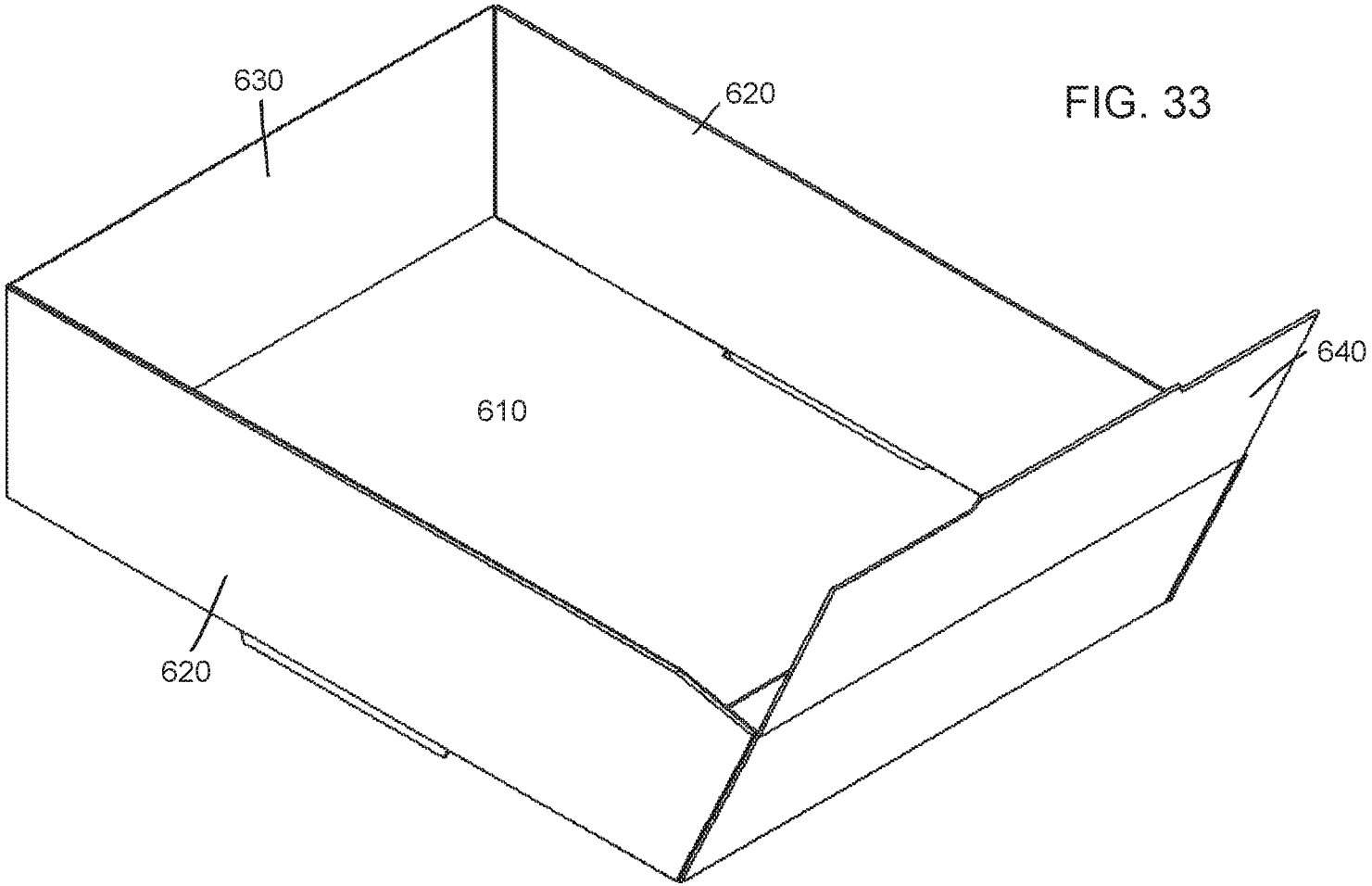
FIG. 33 is another perspective view of the embodiment of a top tobacco hopper and illustrates the process of assembling the top tobacco hopper from FIG. 26.
Figure 34:
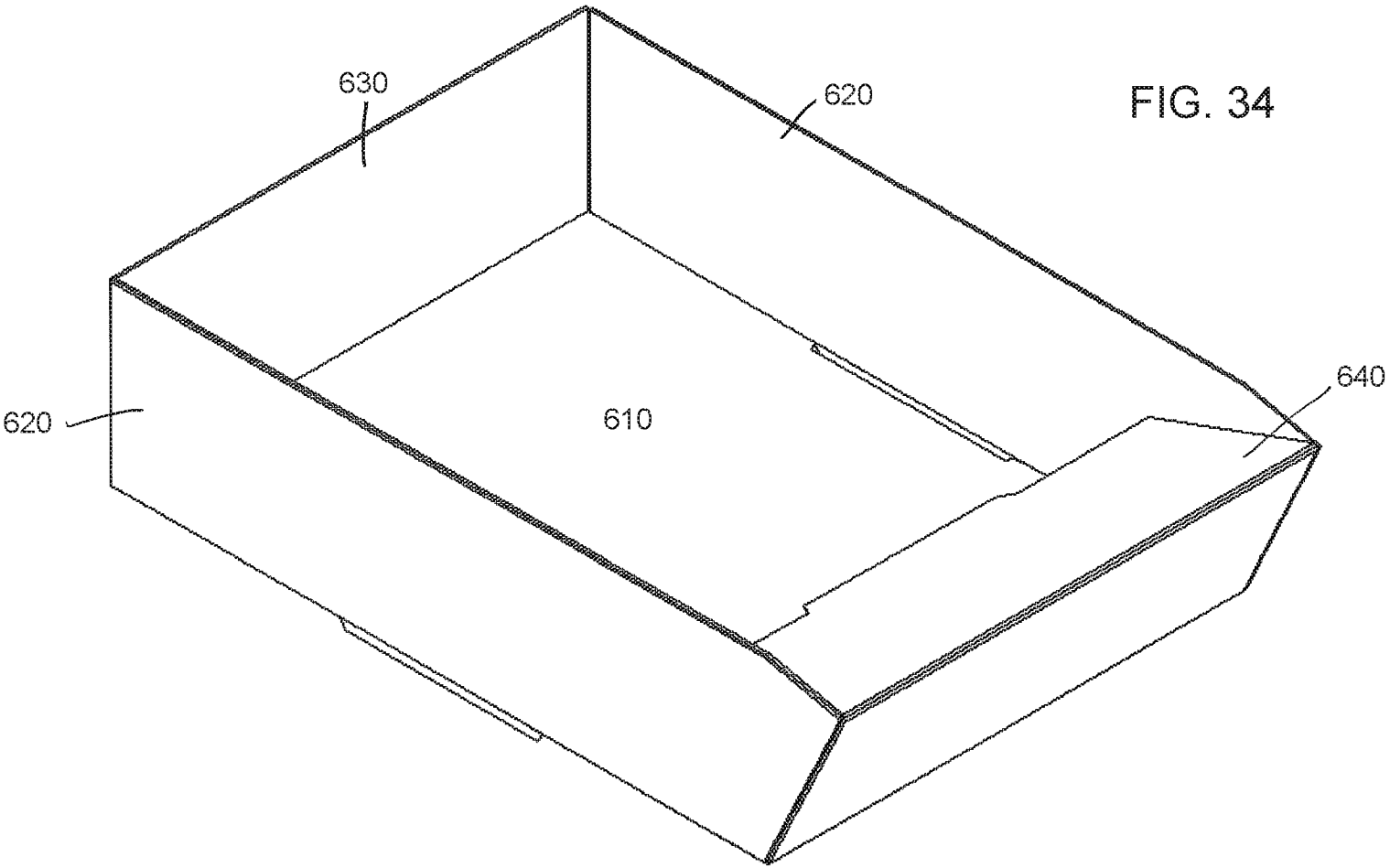
FIG. 34 is another perspective view of the embodiment of a top tobacco hopper and illustrates the process of assembling the top tobacco hopper from FIG. 26.
Figure 35:
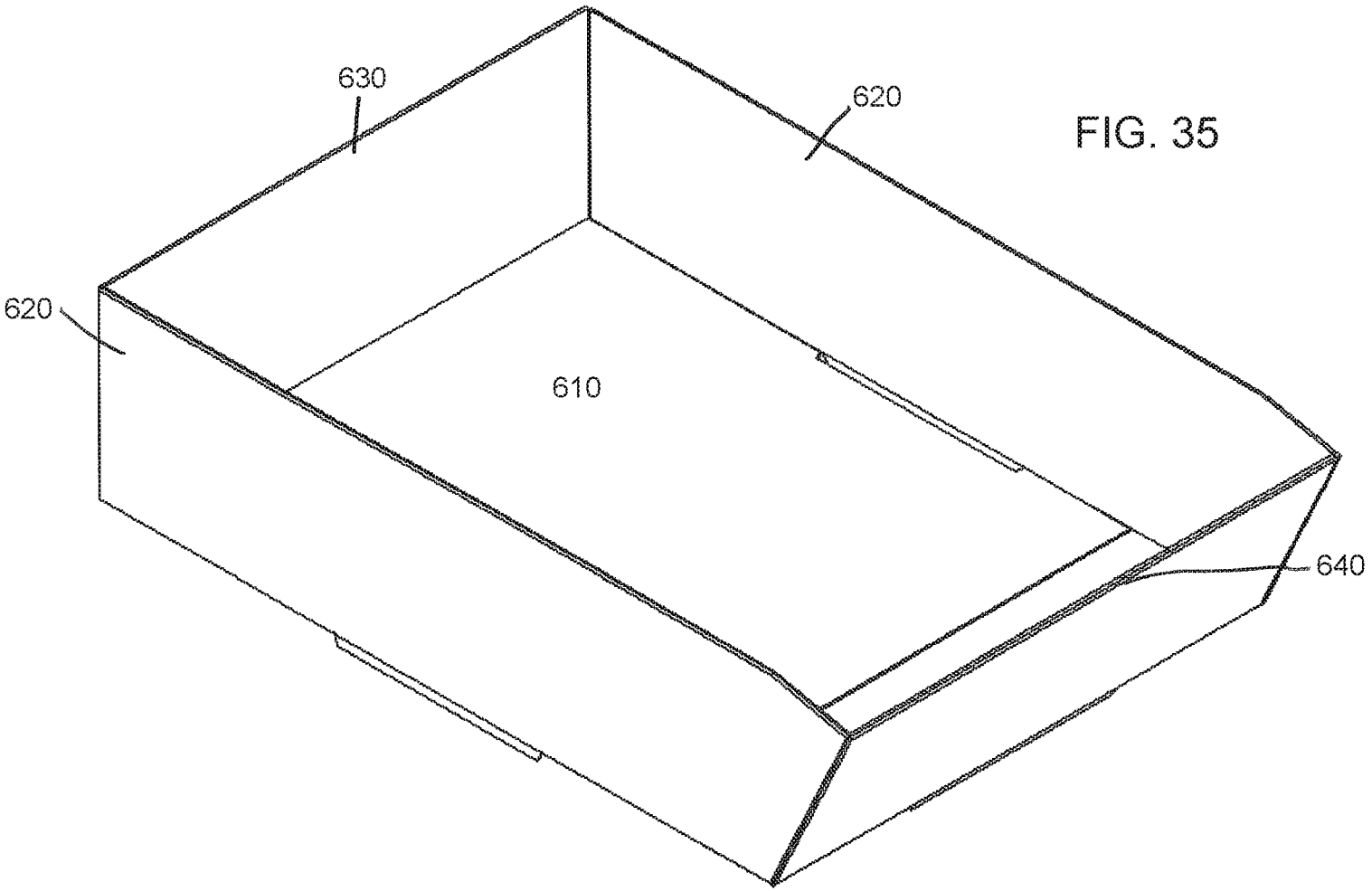
FIG. 35 is another perspective view of the embodiment of a top tobacco hopper and illustrates the process of assembling the top tobacco hopper from FIG. 26.

As illustrated in FIGS. 24-25, the tobacco hopper system 500 also includes a top adhering mechanism 506. The adhering mechanism 106 has an opening that lies on top of and corresponds to the chamber opening O in FIG. 2.

FIGS. 26-35 are a perspective view of another embodiment of a top tobacco hopper and illustrate the process of assembling the top tobacco hopper.

In this exemplary embodiment, the top tobacco hopper 600 includes a base 610, side flanges 620, rear flange 630, front flange 640, a front edge 660, a rear edge 670, and side edges 680. The top tobacco hopper and its components will be described in greater detail below.

The top tobacco hopper 600 is folded from and made from the components illustrated in FIGS. 26-35. Each flange is integrated along an edge of the base 610. The side flanges 620 are folded up and along the side edges 680. The rear flange 630 is folded up and along the rear edge 670. The front flange 640 is folded up and along the front edge 660. Once the front, side, and rear flanges are folded up and along their respective edges, the front flange can be folded and interlocked with the side flange. Similarly, the side flange can be folded and interlocked between the side and the rear flanges. The rear flange can also be folded and interlocked with the side flange. In this embodiment, the base 610 can be configured at a flat position.

Once all flanges are in their correct position, the smoker can use a fastener to hold the top tobacco hopper in its correct configuration. Examples of fasteners can be tape, glue, staple, or any other commercially available material. In addition, the top tobacco hopper 600 may be constructed from a base with a perforated pattern; the perforated pattern indicating where the flanges and flange tips are to be folded. Furthermore, the edges of the flange tips may contain self-adhesive such as two-sided tape that can fasten the top tobacco hopper 600 into its proper shape and into a complete and full configuration. The flanges may also support themselves without fasteners because once they are interlocked, they can support the correct configuration of the hopper. In yet another embodiment, the base may be constructed with a non-slip material so as to create a non-slip base for the top tobacco hopper 600. Examples of a non-slip base may be rubber, polypropylene, plastic, non-slip polyester etc.

Figure 36:
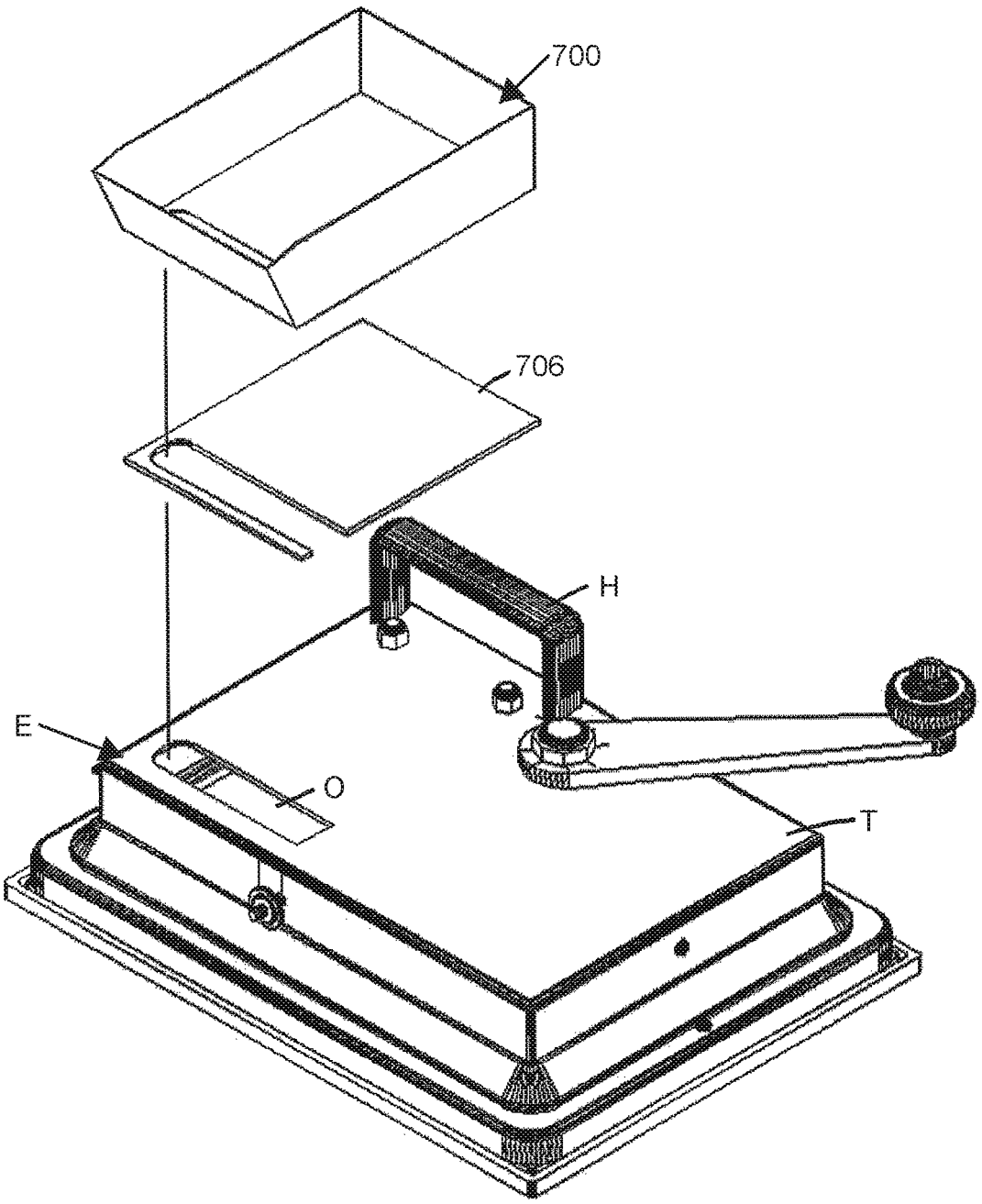
FIG. 36 is a perspective view of a folded top tobacco hopper and a tobacco rolling machine and a full top adhering mechanism.

FIG. 36 is a perspective view of a folded top tobacco hopper and a tobacco rolling machine and a full top adhering mechanism.

FIG. 36 is a perspective view of a folded top tobacco hopper 700 and a tobacco rolling machine T. As illustrated in FIG. 36, the top tobacco hopper 700 aligns with a full top adhering mechanism 706. Also illustrated are the tobacco rolling machine T, the handle H, the chamber opening O, and the exit chamber E. As illustrated, the full top adhering mechanism 706 aligns with the chamber opening O such that the adhering mechanism 706 does not obstruct the chamber opening O. The top adhering mechanism 706 can be adhered or fastened to the top tobacco hopper 700. Any adhering material or fastener may be used such as tape, glue, staple, or any other commercially available material. The top adhering mechanism 706 may also be used in conjunction with any screws, bolts, nuts, and handle of the tobacco rolling machine to ensure a more secure or permanent fit. Furthermore, the top adhering mechanism may be constructed from a non-slip material so as to form as non-slip surface for the top tobacco hopper 700. Examples of a non-slip base may be rubber, polypropylene, plastic, non-slip polyester etc. The top adhering mechanism may also be constructed from a magnetic material, and thus employs magnetic force as a means to secure the top tobacco hopper to the tobacco rolling machine. Furthermore, the top adhering mechanism may also be constructed from other adhesive or fastening materials such as velcro or adhesive tape.

Figure 37:
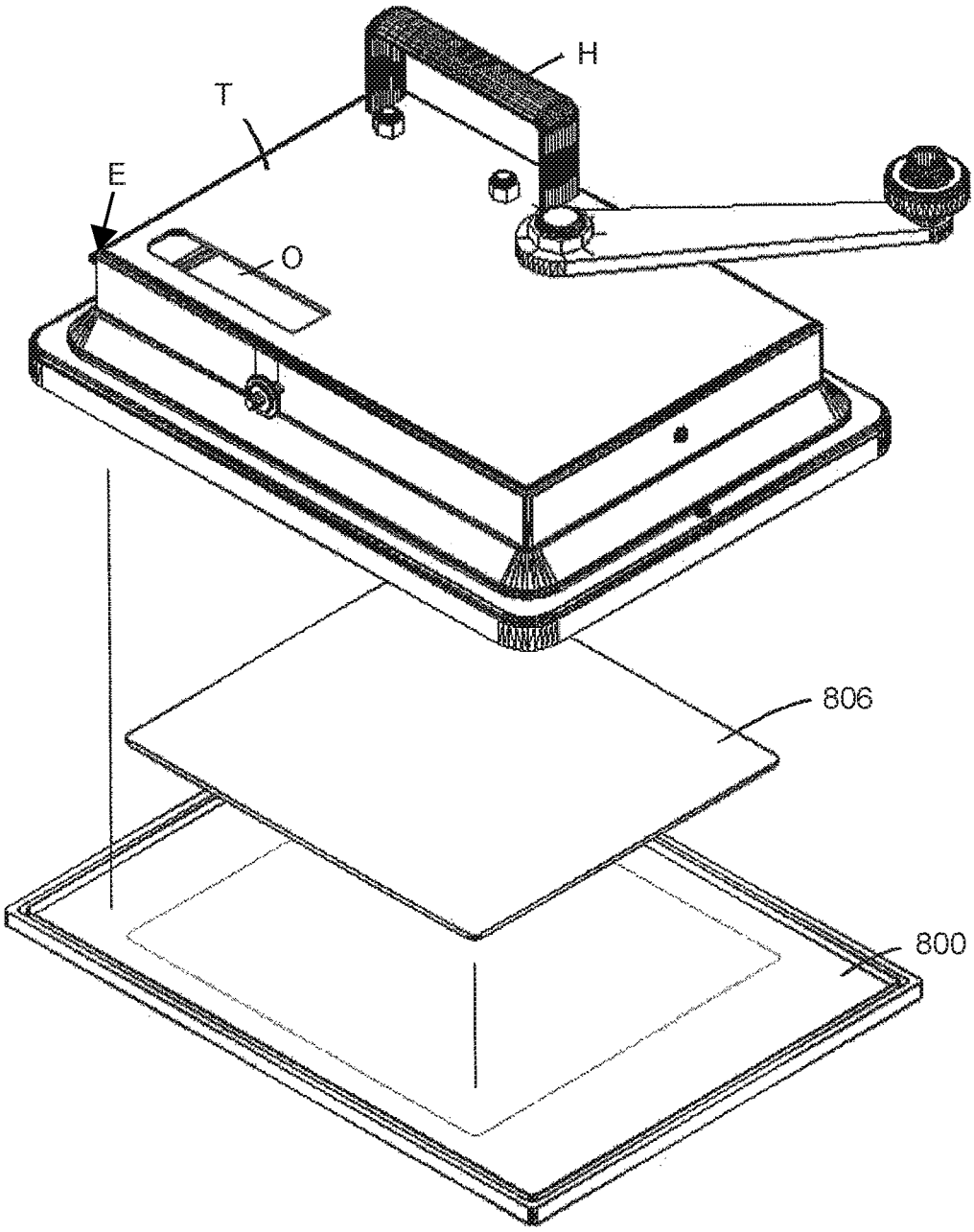
FIG. 37 is a perspective view of a folded top tobacco hopper and a tobacco rolling machine and a full base adhering mechanism.

FIG. 37 is a perspective view of a tobacco rolling machine T and a full base adhering mechanism. Illustrated in FIG. 37 are the tobacco rolling machine T, the handle H, the chamber opening O, and the exit chamber E. As illustrated, the full base adhering mechanism 806 aligns with the base of the tobacco rolling machine T. The full base adhering mechanism 806 can be adhered or fastened to the base of the tobacco rolling machine T. Any adhering material or fastener may be used such as tape, glue, staple, or any other commercially available material. The full base adhering mechanism 806 may also be used in conjunction with any screws, bolts, nuts, and handle of the tobacco rolling machine to ensure a more secure or permanent fit. Furthermore, the full base adhering mechanism 806 may be constructed from a magnetic material, and thus employs magnetic force as a means to secure the tobacco rolling machine to a metal base. In another embodiment, the full base adhering mechanism may also be constructed from other adhesive or fastening materials such as velcro or adhesive tape. In yet another embodiment, the full base adhering mechanism may also be placed to the underside of the removable rubber base of the tobacco rolling machine.

Figure 38:
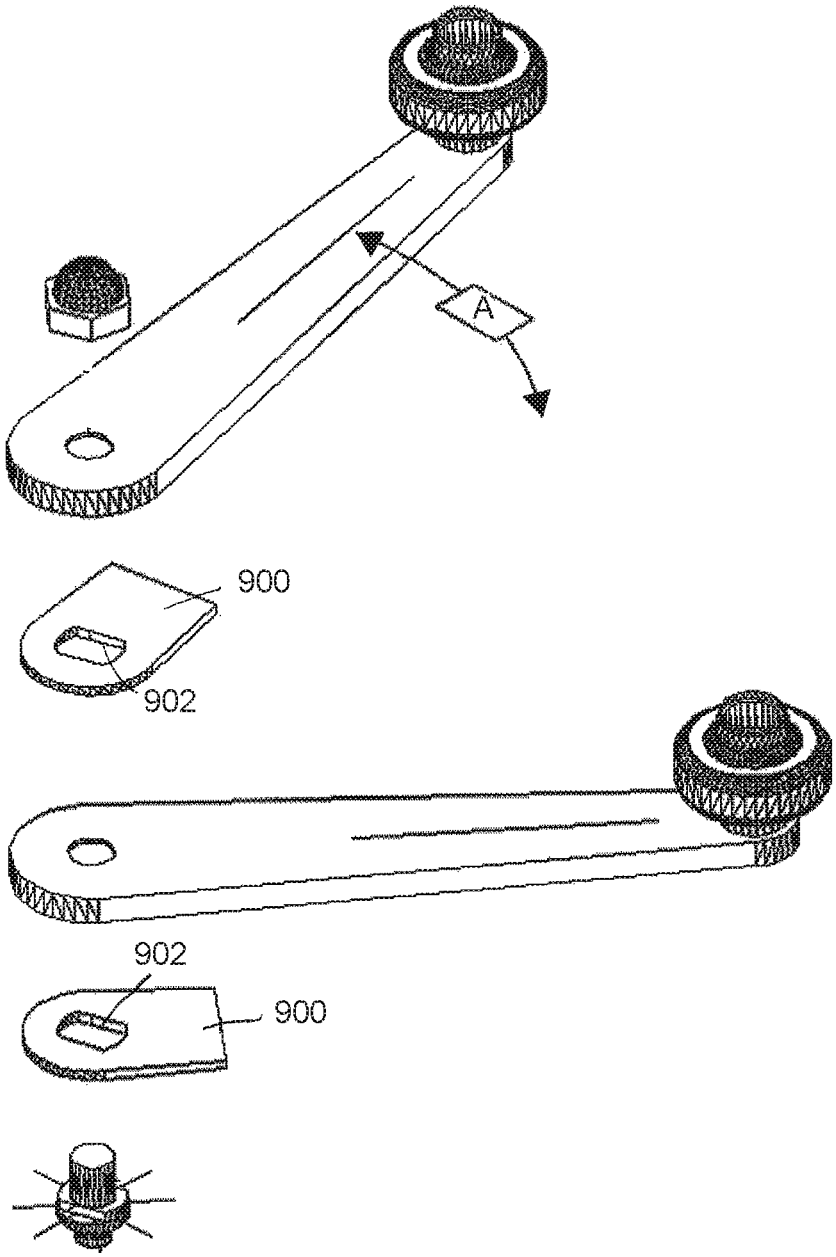
FIG. 38 is a perspective view of the lever arm of a tobacco rolling machine and an adjustment adapter.

FIG. 38 is a perspective view of the lever arm of a tobacco rolling machine and an adjustment adapter. The adapter allows for the lever arm of a tobacco hopper to be reoriented from a first position to a second position. This allows for flexibility in the position of the lever arm so as to accommodate various top tobacco hopper sizes and varying sizes of lever arms of a tobacco rolling machine. The adjustment adapter 900 has an adjustment opening 902 that allows for rotation of the lever arm to a preferred angle A.

Figure 39:
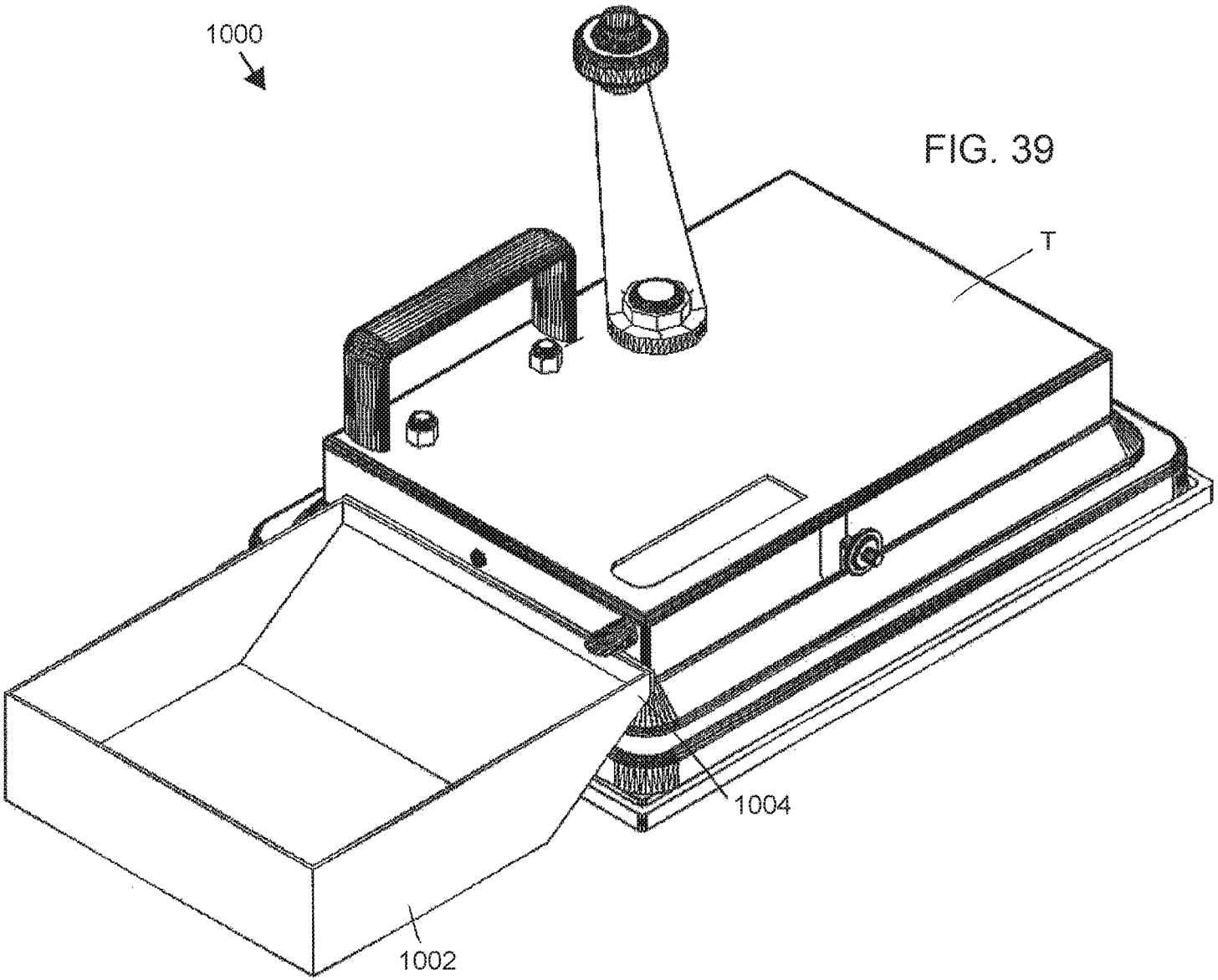
FIG. 39 is a perspective view of a folded side tobacco hopper positioned next to a tobacco rolling machine.

FIG. 39 is a perspective view of a folded side tobacco hopper positioned next to a tobacco rolling machine. As illustrated in FIG. 39, the tobacco hopper system 1000 includes a side tobacco hopper 1002. Also illustrated in FIG. 39 is a tobacco rolling machine T. In this embodiment, the side tobacco hopper 1002 is adhered to the tobacco rolling machine T through an adhering mechanism. In one embodiment, the adhering mechanisms are magnetic strips that are placed beneath the protruding end of the side tobacco hopper. The magnetic strips are not visible in FIG. 39. Another variation of the adhering mechanism may be a screw or ball and lock that fit into the side of the tobacco rolling machine T or other adhesive or fastening material such as velcro or adhesive tape. In another embodiment, the side tobacco hopper 1002 is already in its final shape. The side tobacco hopper 1002 may be constructed from pre-cut metal, paper, cardboard, or vacu-formed plastic. Other construction material may also be possible. The tobacco rolling machine T may be an already commercially available machine. The side tobacco hopper 1002 may also be positioned at an overhang 1004 from the edge of the tobacco rolling machine, such that the overhang runs along the corner of the tobacco rolling machine. In yet another embodiment, the side tobacco hopper may employ an add-on flat rectangular base that extends outward and under the tobacco rolling machine such that the weight of the tobacco rolling machine would secure the side tobacco hopper in place.

FIGS. 40-53 are a perspective view of another embodiment of a side tobacco hopper and illustrate the process of assembling the side tobacco hopper.

Figure 40:
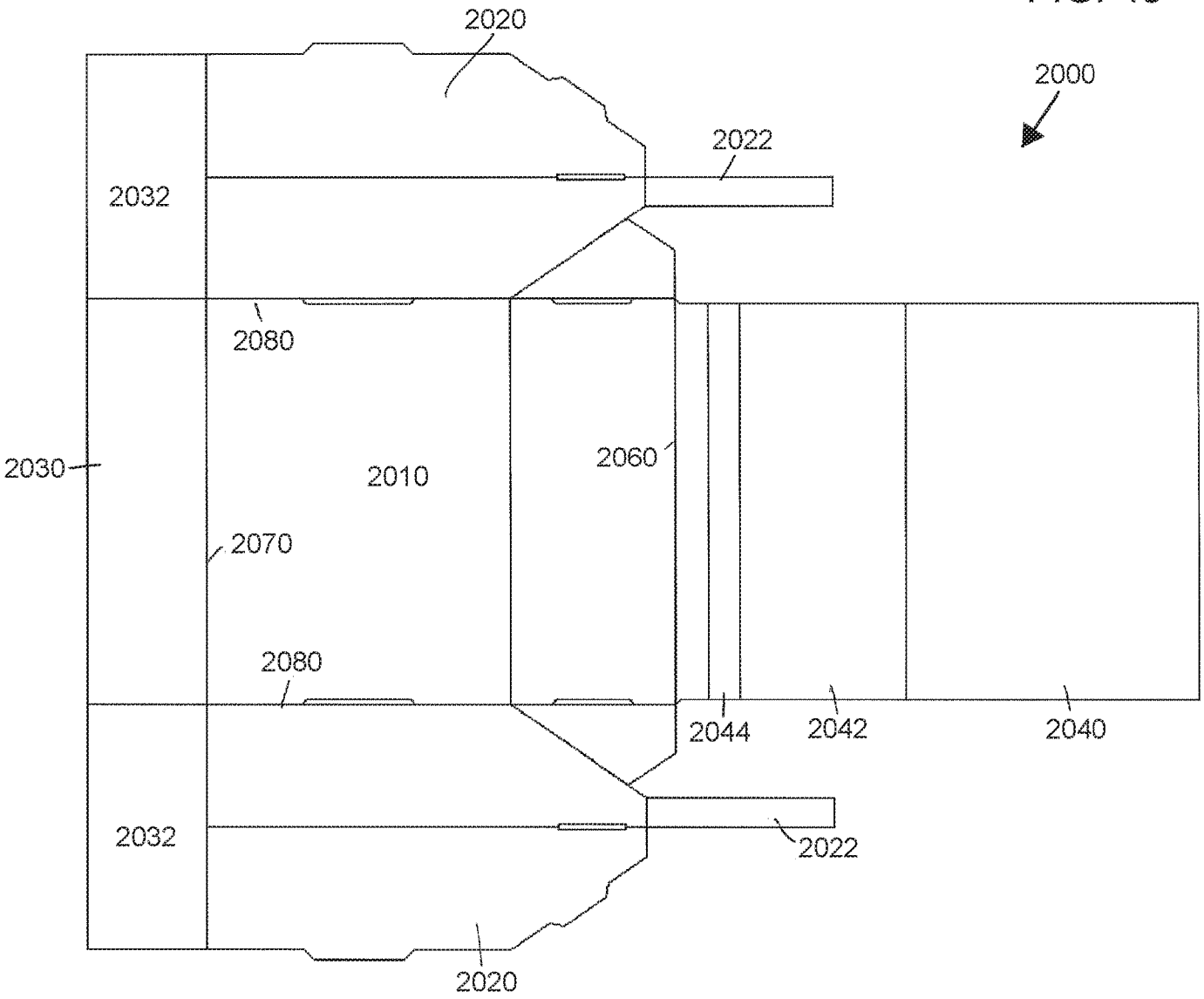
FIG. 40 is a perspective view of another embodiment of a side tobacco hopper and illustrate the process of assembling the side tobacco hopper.
Figure 41:
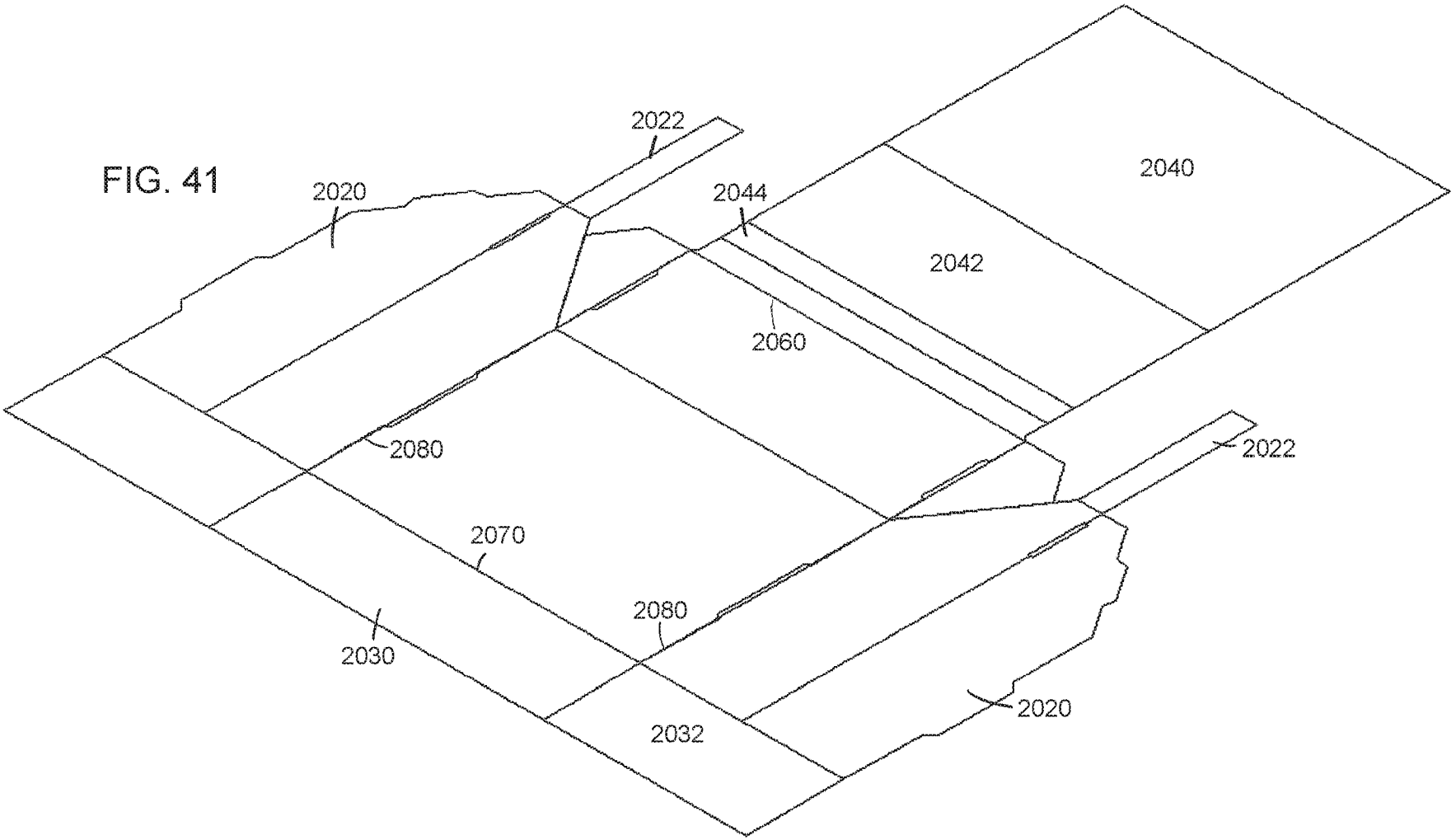
FIG. 41 is another perspective view of the embodiment of a side tobacco hopper and illustrates the process of assembling the side tobacco hopper from FIG. 40.
Figure 42:
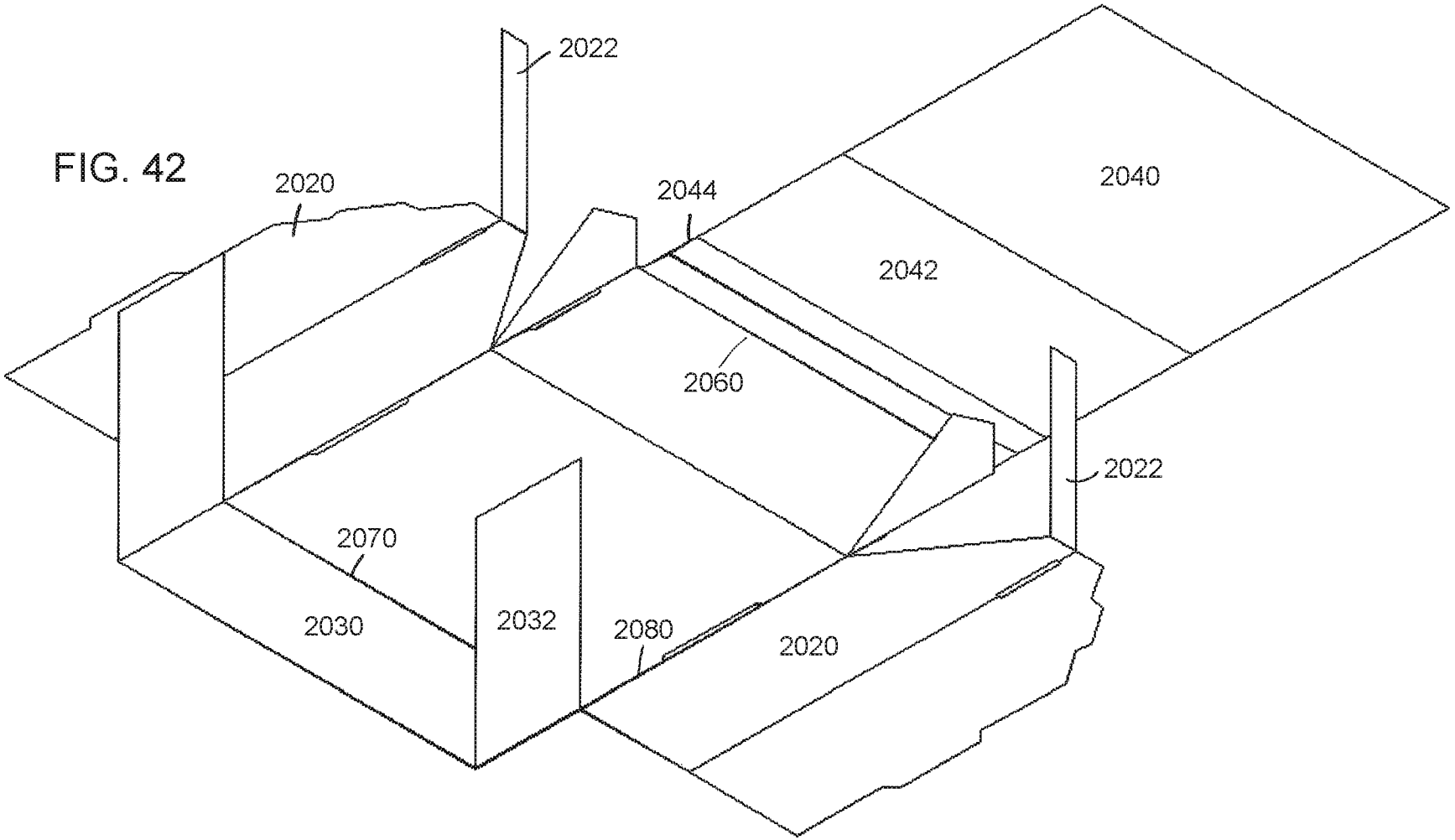
FIG. 42 is another perspective view of the embodiment of a side tobacco hopper and illustrates the process of assembling the side tobacco hopper from FIG. 40.
Figure 43:
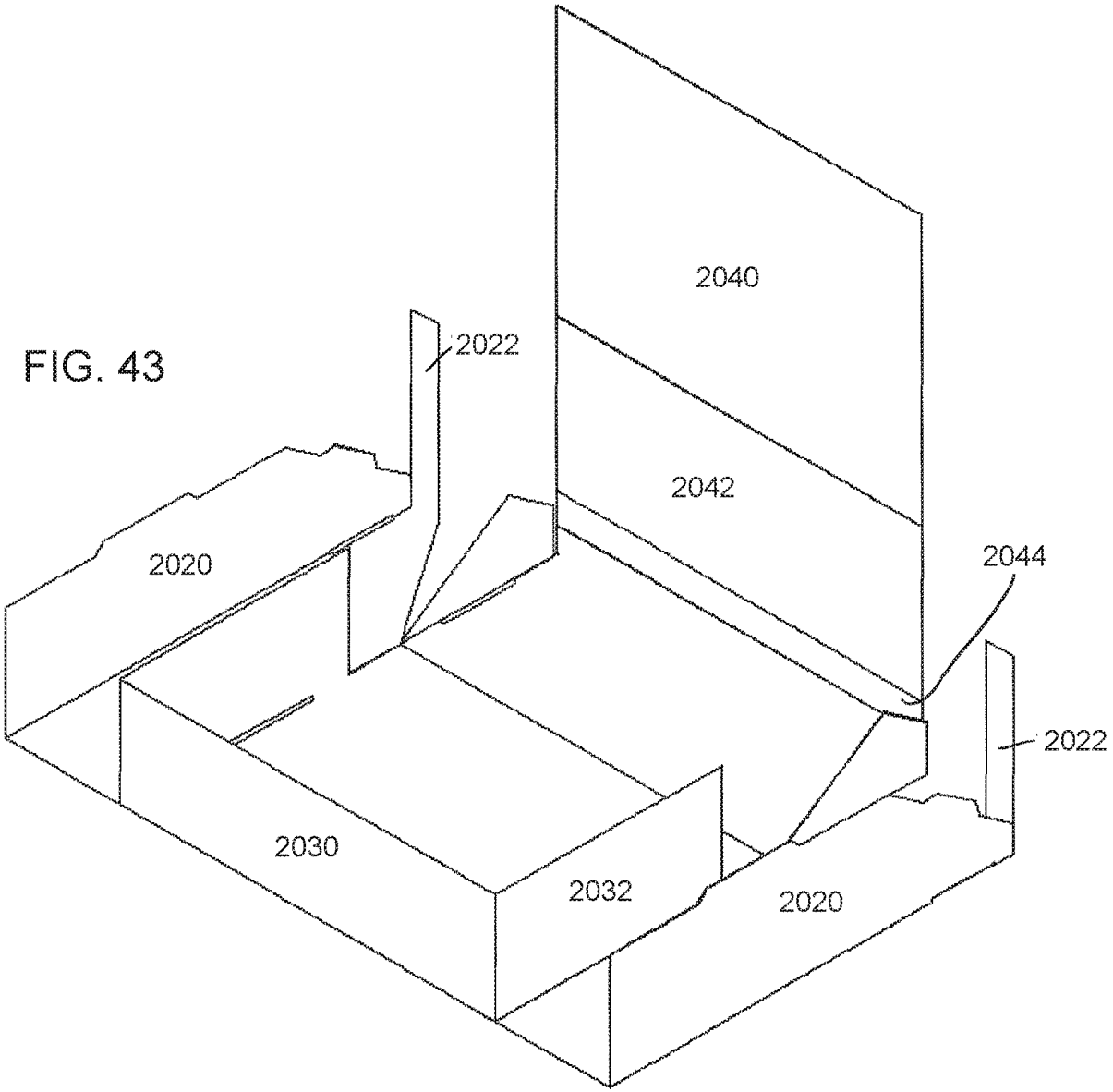
FIG. 43 is another perspective view of the embodiment of a side tobacco hopper and illustrates the process of assembling the side tobacco hopper from FIG. 40.
Figure 44:
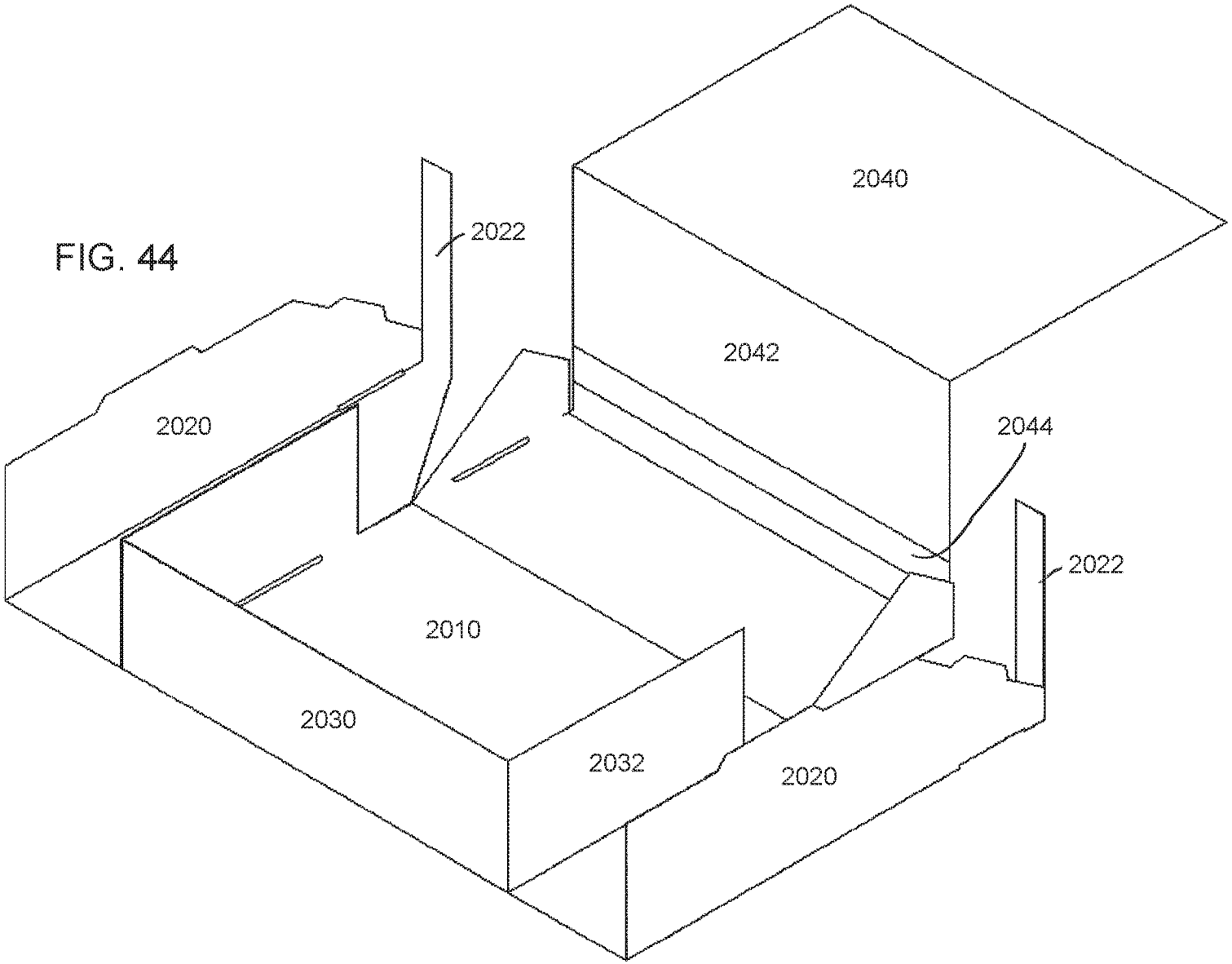
FIG. 44 is another perspective view of the embodiment of a side tobacco hopper and illustrates the process of assembling the side tobacco hopper from FIG. 40.
Figure 45:
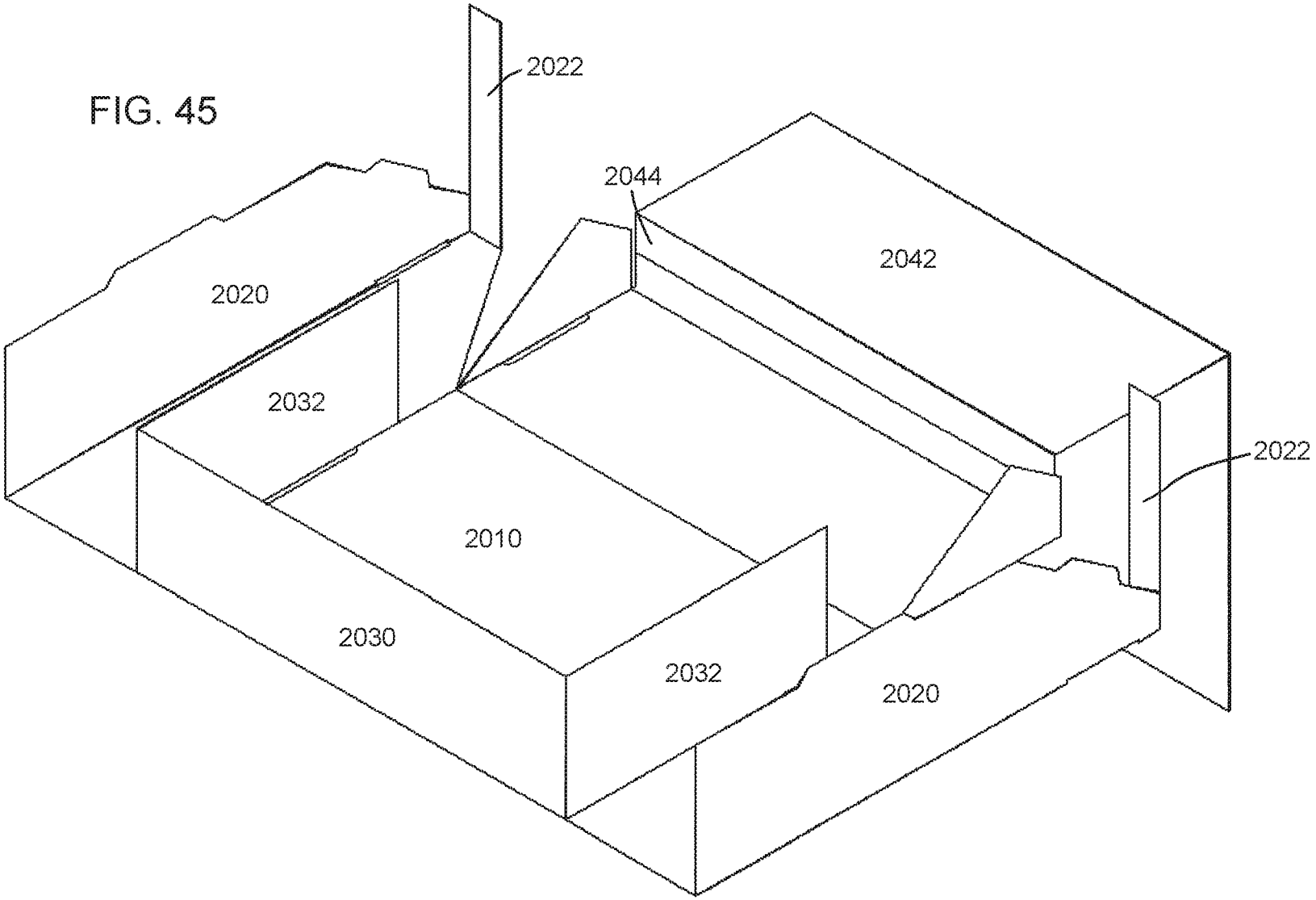
FIG. 45 is another perspective view of the embodiment of a side tobacco hopper and illustrates the process of assembling the side tobacco hopper from FIG. 40.
Figure 46:
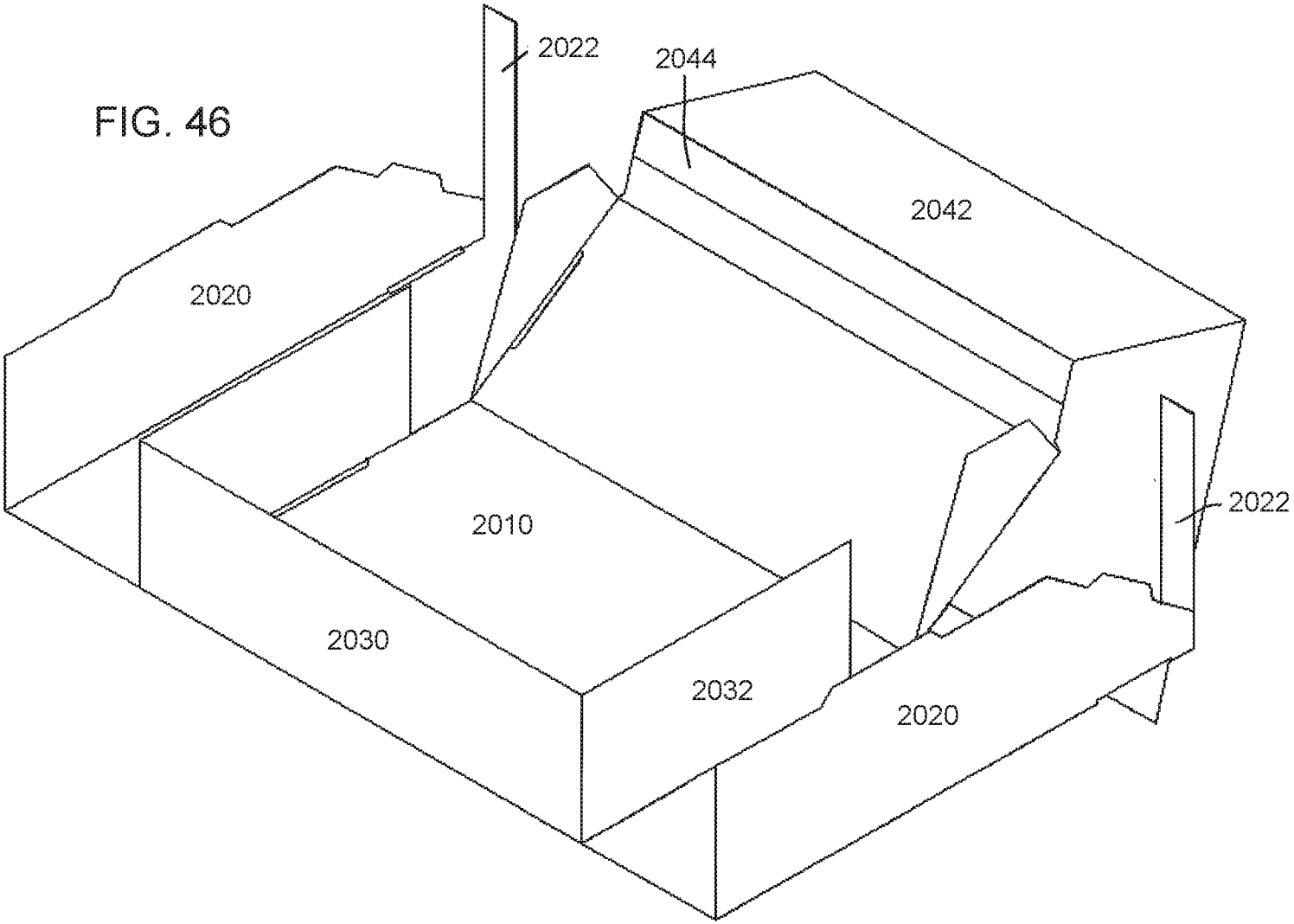
FIG. 46 is another perspective view of the embodiment of a side tobacco hopper and illustrates the process of assembling the side tobacco hopper from FIG. 40.
Figure 47:
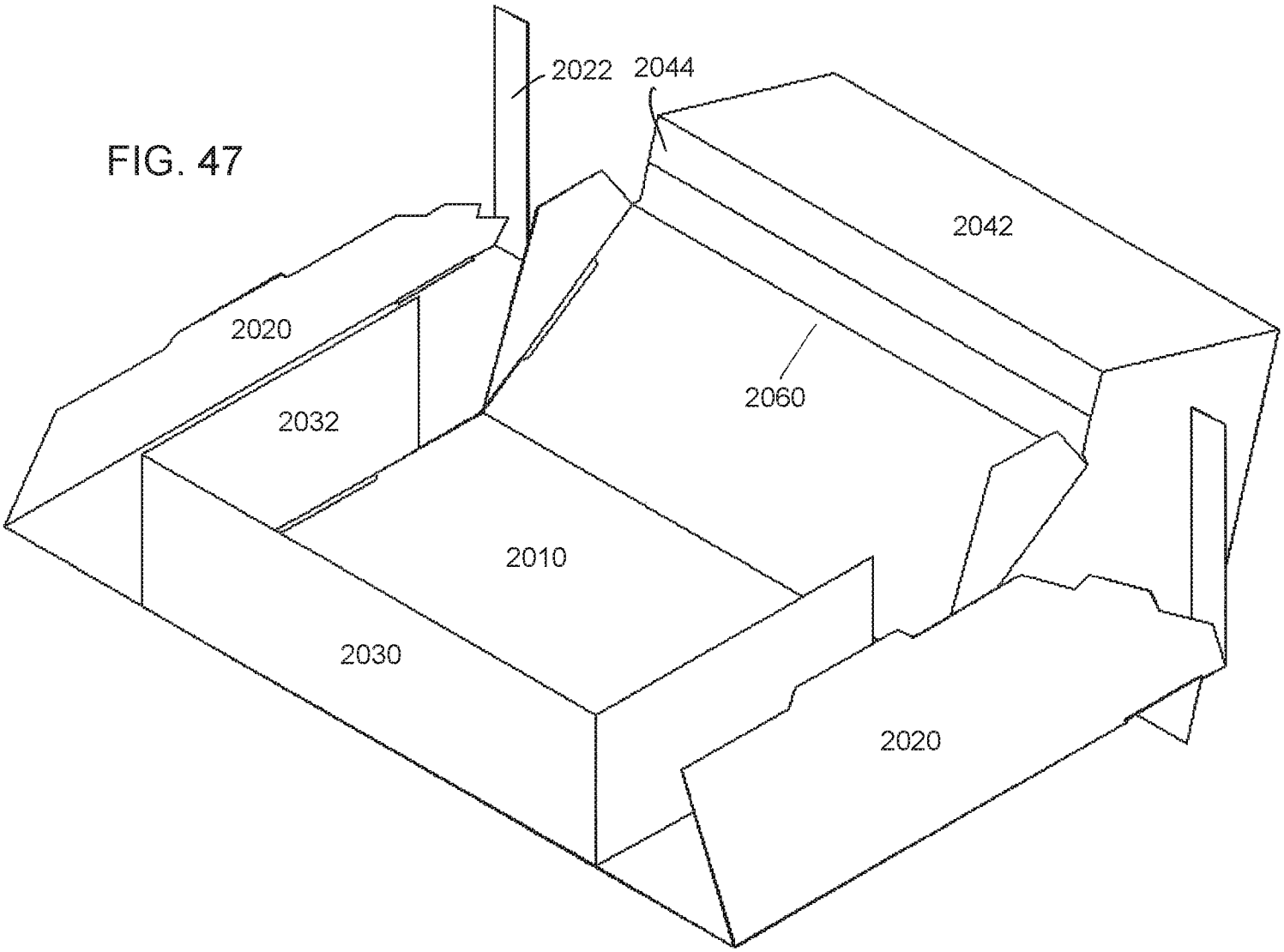
FIG. 47 is another perspective view of the embodiment of a side tobacco hopper and illustrates the process of assembling the side tobacco hopper from FIG. 40.
Figure 48:
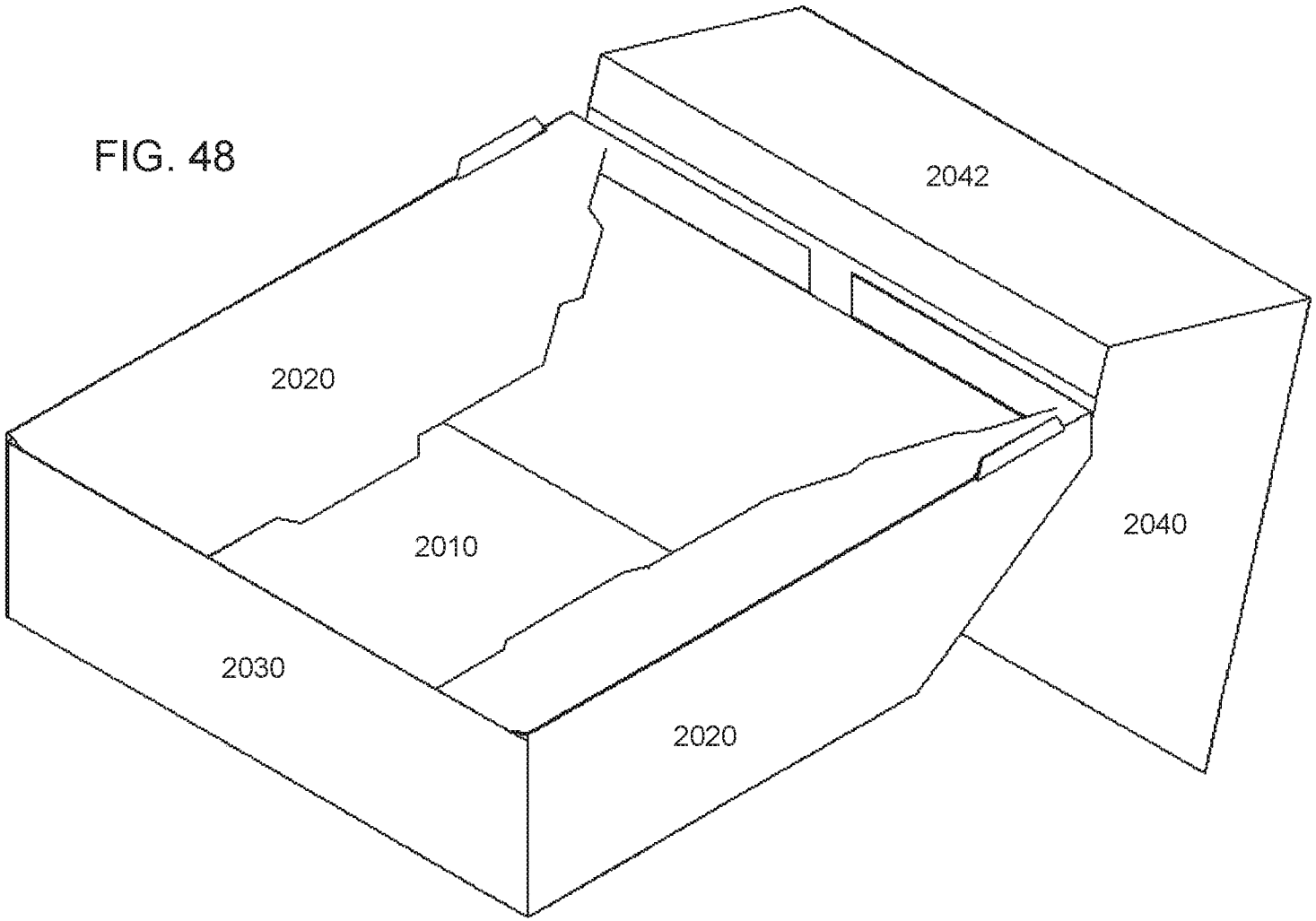
FIG. 48 is another perspective view of the embodiment of a side tobacco hopper and illustrates the process of assembling the side tobacco hopper from FIG. 40.
Figure 49:
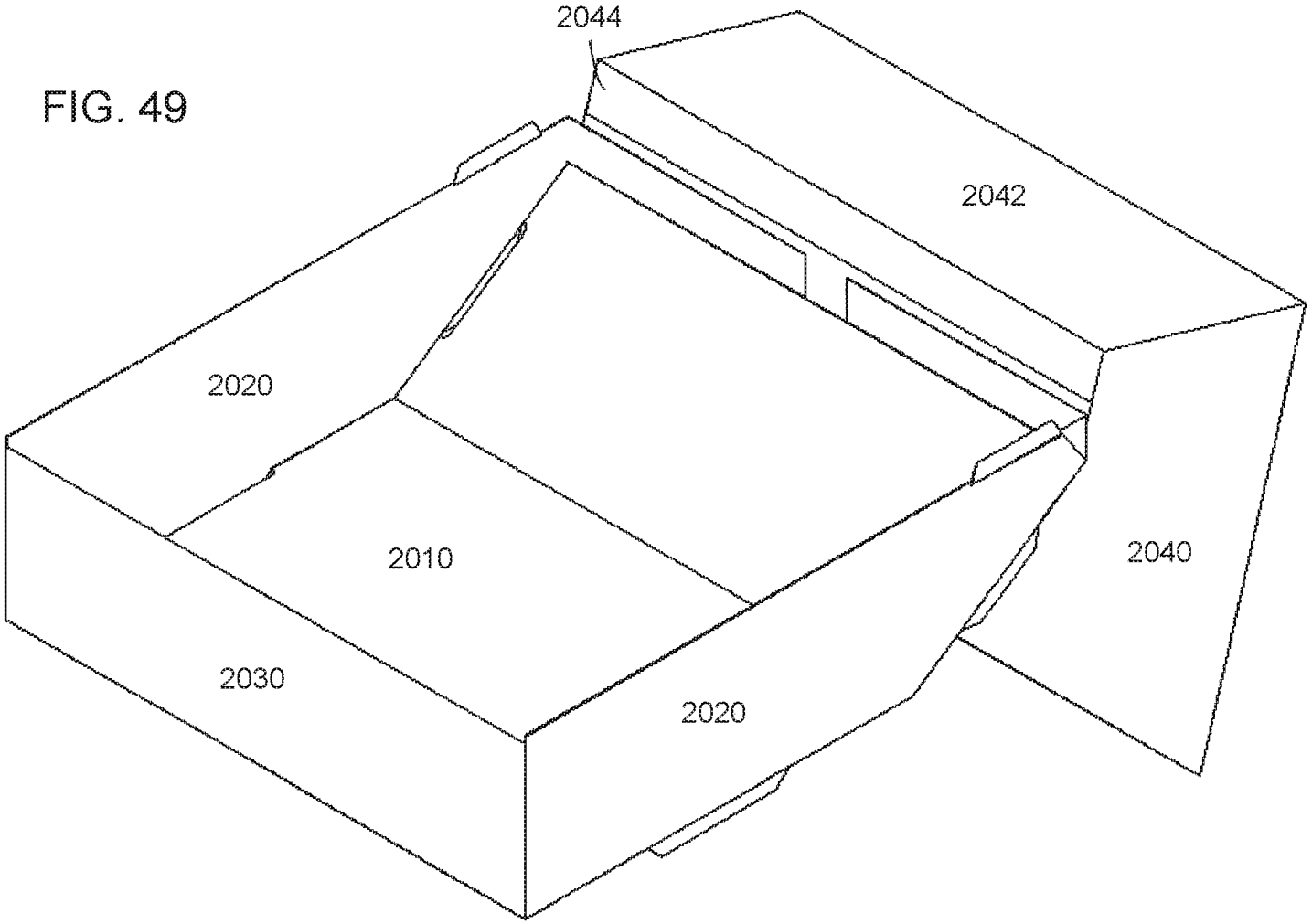
FIG. 49 is another perspective view of the embodiment of a side tobacco hopper and illustrates the process of assembling the side tobacco hopper from FIG. 40.
Figure 50:
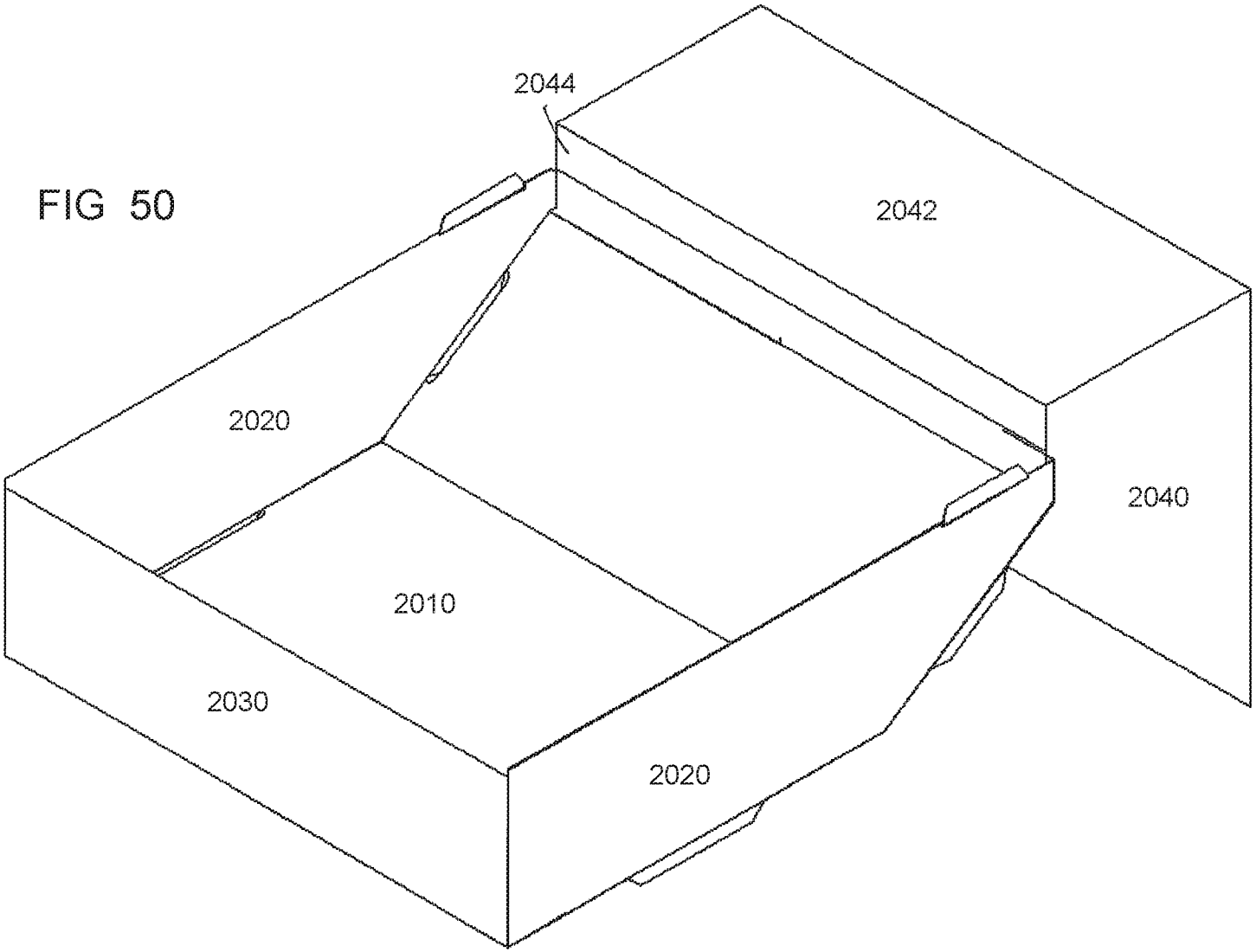
FIG. 50 is another perspective view of the embodiment of a side tobacco hopper and illustrates the process of assembling the side tobacco hopper from FIG. 40.
Figure 51:
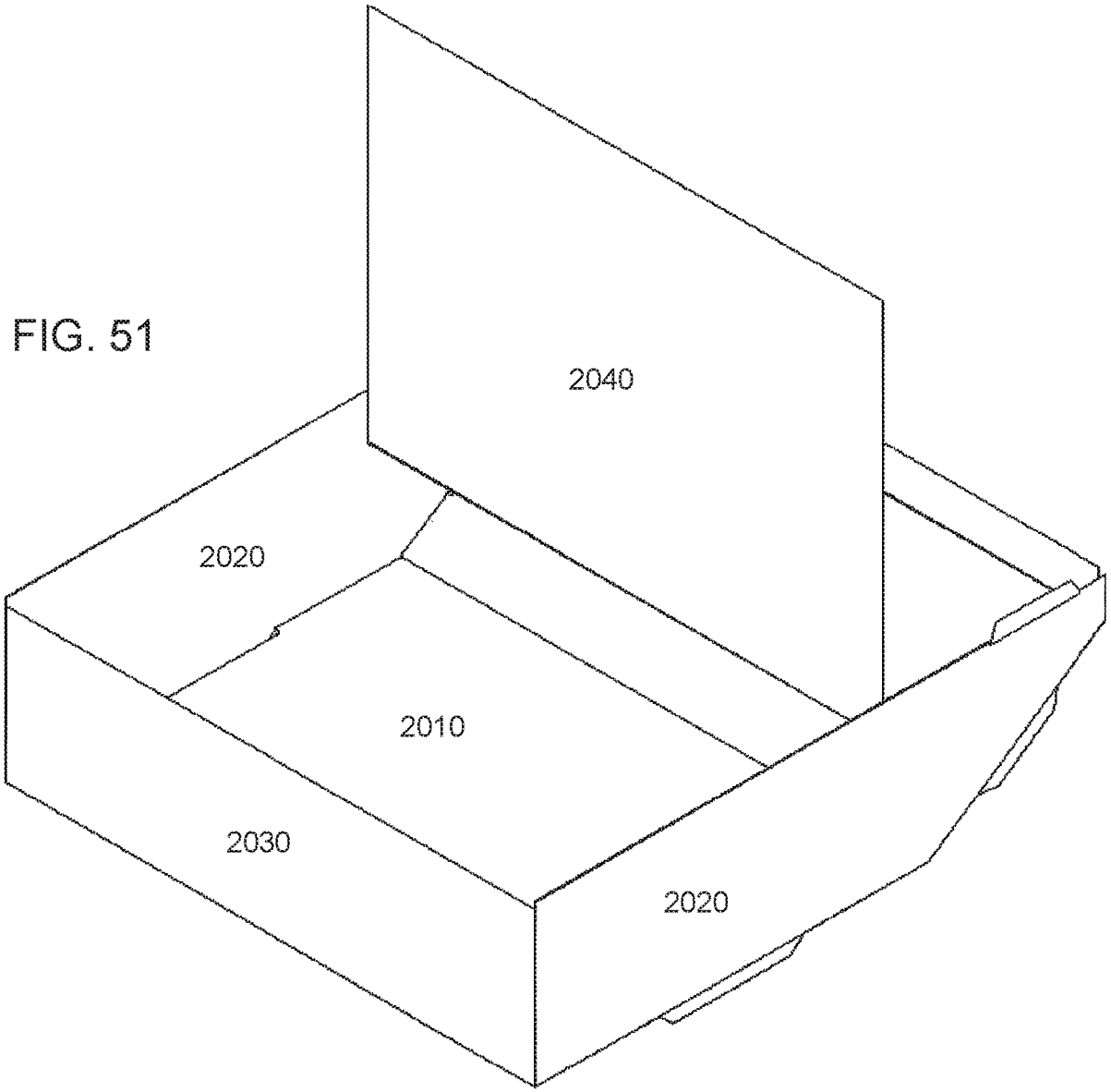
FIG. 51 is another perspective view of the embodiment of a side tobacco hopper and illustrates the process of assembling the side tobacco hopper from FIG. 40.
Figure 52:
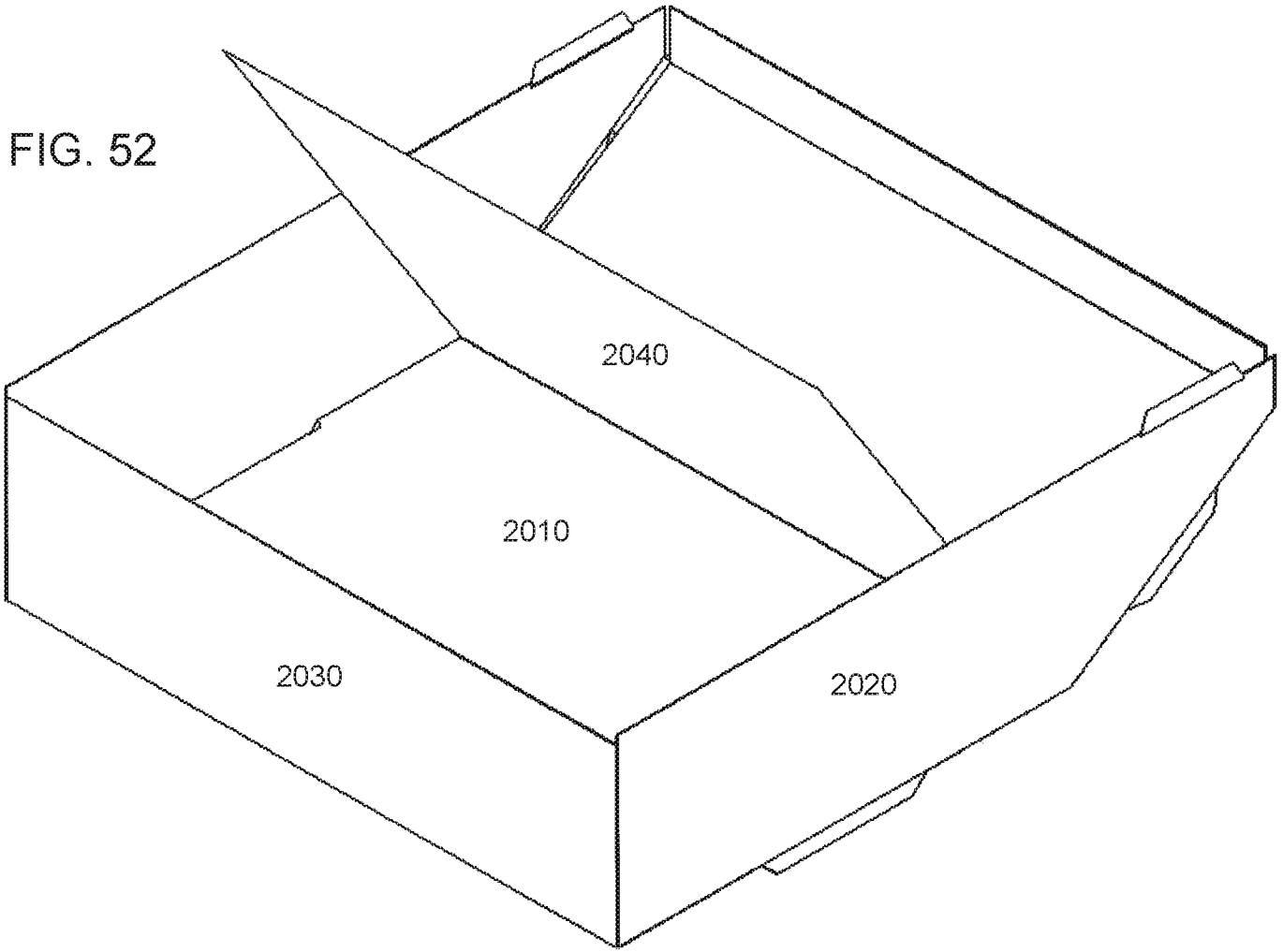
FIG. 52 is another perspective view of the embodiment of a side tobacco hopper and illustrates the process of assembling the side tobacco hopper from FIG. 40.
Figure 53:
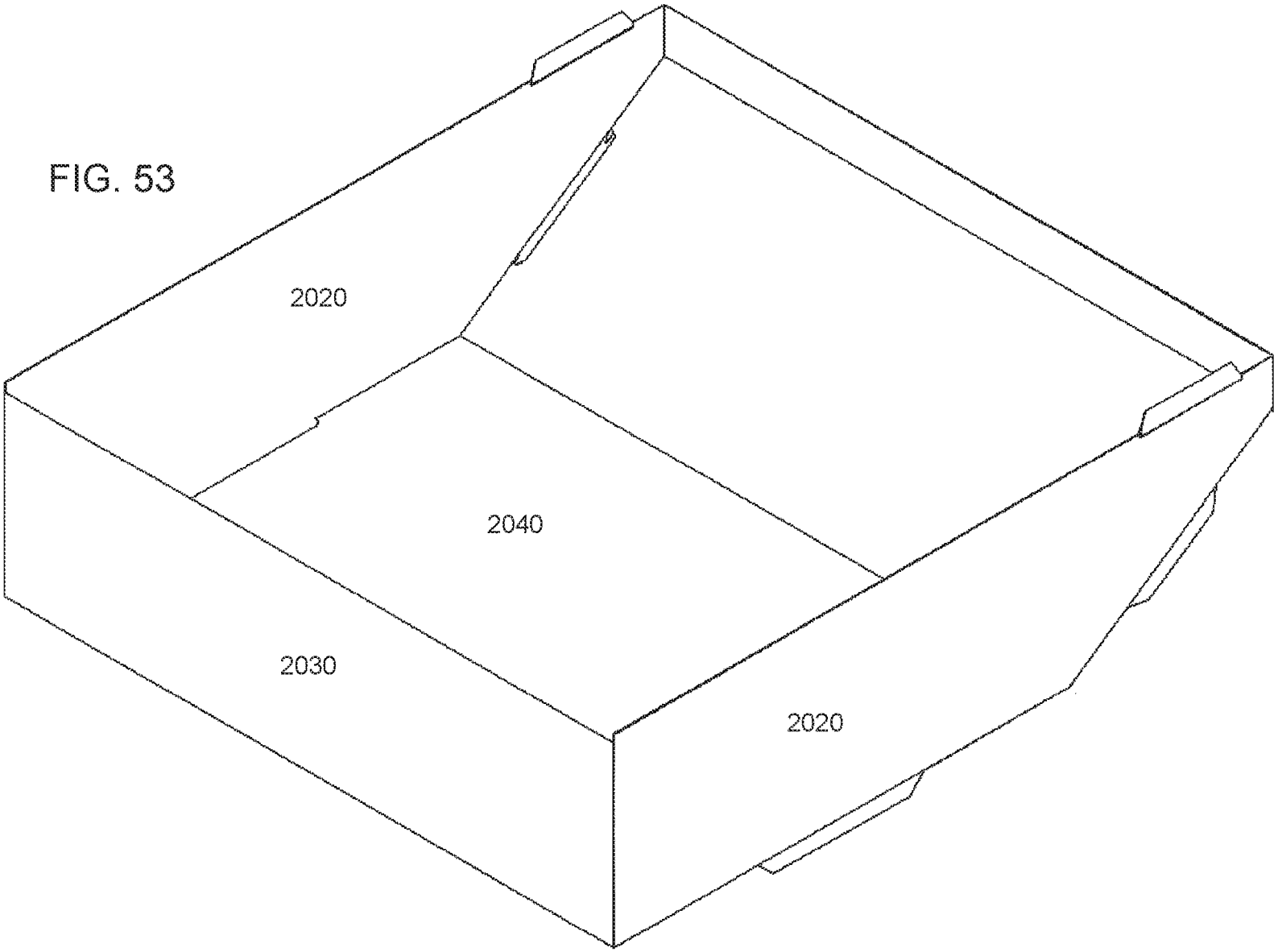
FIG. 53 is another perspective view of the embodiment of a side tobacco hopper and illustrates the process of assembling the side tobacco hopper from FIG. 40.

FIG. 40 is a top view of a pre-folded side tobacco hopper. In this exemplary embodiment, the side tobacco hopper 2000 includes a base 2010, side flanges 2020, side flange tips 2022, rear flange 2030, rear flange tips 2032, front flange 2040, 2042, and 2044, a front edge 2060, a rear edge 2070, and a side edge 2080. The side tobacco hopper and its components will be described in greater detail below.

The side tobacco hopper 2000 is folded from and made from the components illustrated in FIGS. 40-53. Each flange is integrated along an edge of the base 2010. The side flanges 2020 are folded up and along the side edges 2080. The rear flange 2030 is folded up and along the rear edge 2070. The front flange 2040 is folded up and along the front edge 2060. Once the front, side, and rear flanges are folded up and along their respective edges, the side flange tips 2022 can be folded and interlocked into the space between the front flanges 2040, 2042, and 2044. Any adhering material or fastener may be used such as tape, glue, staple, or any other commercially available material. The flanges may also support themselves without fastener because once they are interlocked, they can support the correct configuration of the hopper. In addition, the side tobacco hopper 2000 may be constructed from a base with a perforated pattern; the perforated pattern indicating where the flanges and flange tips are to be folded. Furthermore, the edges of the flange tips may contain self-adhesive such as two-sided tapes that can fasten the side tobacco hopper 300 into its proper shape and into a complete and full configuration. In yet another embodiment, the base may be constructed with a non-slip material so as to create a non-slip base for the side tobacco hopper 2000. Examples of a non-slip base may be rubber, polypropylene, plastic, non-slip polyester etc.

Figure 54:
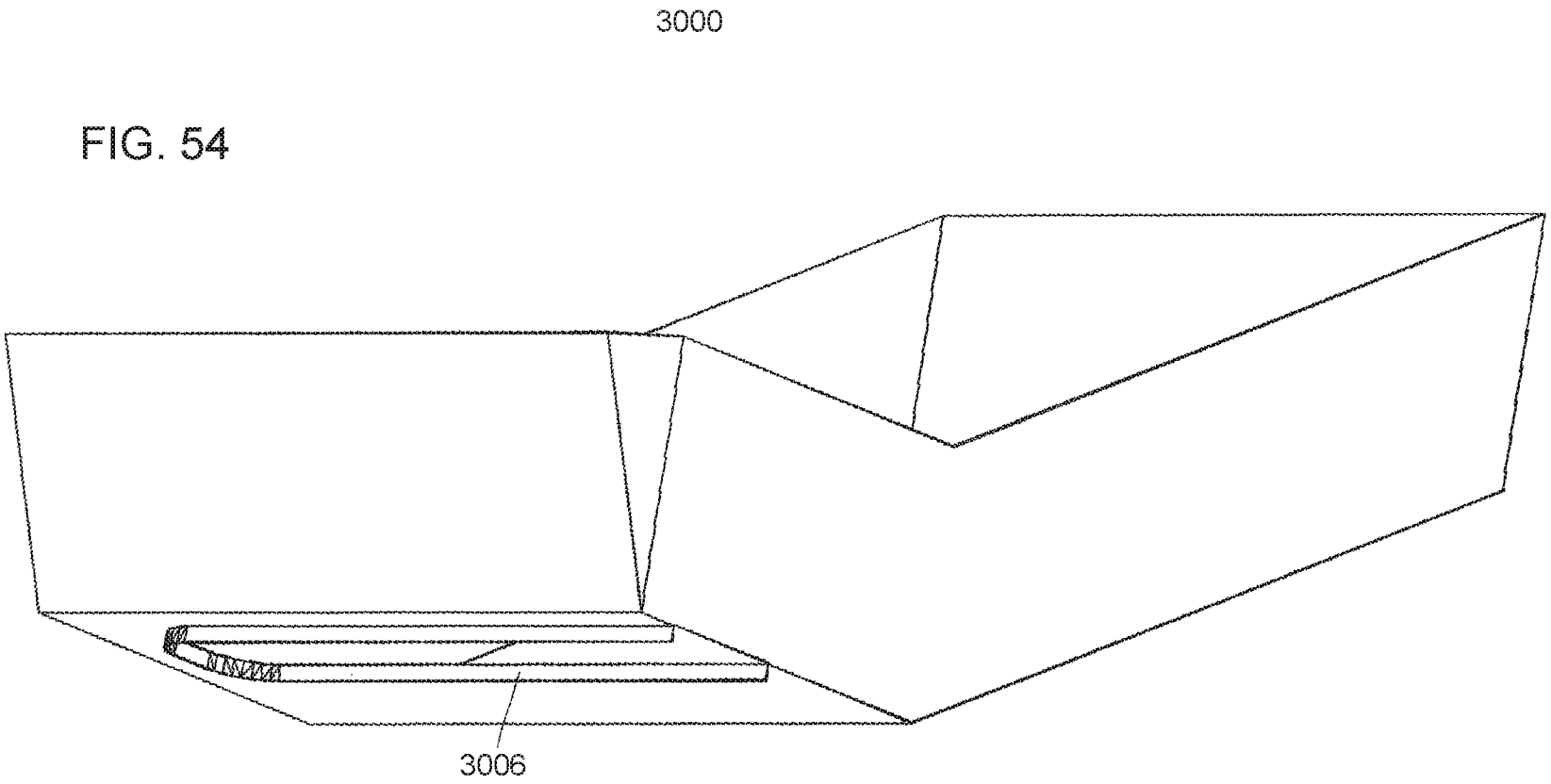
FIG. 54 is a perspective view of a top tobacco hopper with a snap in top adhering mechanism.

FIG. 54 is a perspective view of a top tobacco hopper with a snap in top adhering mechanism. As illustrated in FIG. 54, the top hopper is already configured. The adhering mechanism 3006 mirrors the opening of a tobacco rolling machine and is able to snap into the opening and form a secure fit of the top hopper to the tobacco rolling machine. The top adhering mechanism may also be constructed from a magnetic material, and thus employs magnetic force as a means to secure the top tobacco hopper to the tobacco rolling machine. Furthermore, the top adhering mechanism may also be constructed from other adhesive or fastening materials such as velcro or adhesive tape.

Some embodiments include an easily attachable and detachable hopper tray that uses magnetic or Velcro or various other types of fasteners for loading and or catching ejected tobacco filled cigarette tubes for manual rolling tobacco machines.

Some embodiments include an easily attachable and detachable hopper tray that is used for manual rolling tobacco machines.

Some embodiments are for keeping wholesale loose tobacco organized in the process of creating a rolled cigarette.

Some embodiments include an attachable and detachable hopper tray that is used to organize wholesale loose tobacco in the process of rolling cigarette with a manual rolling tobacco machine.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A tobacco hopper kit for use on a tobacco rolling machine, comprising:

a base having a floor, the floor including an opening corresponding to a tobacco chamber of the tobacco rolling machine;

side flanges integrated along side edges of the base;

a front flange integrated along a front edge of the base, the front flange configured to be folded and interlocked with a portion of the side flanges;

a rear flange integrated along a rear edge of the base, the rear flange configured to be folded and interlocked with a portion of the side flanges; and wherein the side flanges, the front flange, and the rear flange are configured to be folded into a hopper configuration.

2. The tobacco hopper kit of claim 1, wherein at least the base is made of paper.

3. The tobacco hopper kit of claim 1, further comprising side inserts for the side flanges, the side inserts being placed into the side flanges to provide structural support.

4. The tobacco hopper kit of claim 1, wherein a rear portion of the base is inclined at an angle with respect to a front portion of the base.

5. The tobacco hopper kit of claim 1, wherein the base is made out of a biodegradable material.

6. The tobacco hopper kit of claim 1, further comprising an adhesive magnetic strip, the magnetic strip being adhered to the bottom of the base and magnetically binding the foldable tobacco hopper to the tobacco rolling machine.

7. The tobacco hopper kit of claim 1, further comprising a lever arm adapter for adjusting an operating range of a lever arm of the tobacco rolling machine, the lever arm including a keyed coupler, a lever arm having a first end and a second end, and a knob at the second end, the lever arm adapter comprising:

a body configured for insertion into the first end of the lever arm; and an adjustment opening positioned in the body and configured to receive a keyed feature of the keyed coupler for connecting the lever arm and lever arm adapter to the tobacco rolling machine, the adjustment opening positioned in the body to position the second end of the lever arm and the knob rearward of the tobacco rolling machine and substantially aligned with an axis extending along the forward and backward directions when the lever arm and knob are assembled on the tobacco rolling machine and at a rest position; and wherein the knob and lever arm are rotatable to a position in which the second end of the lever arm and the knob are forward the tobacco rolling machine and substantially aligned with the axis extending along the forward and backward directions.

8. The kit of claim 7, wherein the lever arm adapter has an external profile that fits within a corresponding receptacle arranged in a lower surface of the lever arm at the first end of the lever arm.

9. The kit of claim 1, further comprising a fastening mechanism configured to connect a tobacco hopper formed from the tobacco hopper kit to one or more of: a top surface of the tobacco rolling machine, a side surface of the tobacco rolling machine, a bottom surface of the tobacco rolling machine, or a tray arranged below the tobacco rolling machine.

10. The kit of claim 9, wherein the fastening mechanism is one of: a magnet, a hook and loop fastener, and adhesive tape.

11. A tobacco hopper comprising:

sidewalls;

a back wall;

a front wall;

wherein the sidewalls, the back wall, and the front wall connect to form a ridge barrier surrounding an opening, wherein the opening is sized and shaped to surround a tobacco input port of a tobacco chamber of a tobacco rolling machine when the tobacco hopper is arranged on a top surface of the tobacco rolling machine; and an adhering mechanism configured to secure the tobacco hopper to the tobacco rolling machine.

12. The tobacco hopper of claim 11, further comprising a base.

13. The tobacco hopper of claim 11, wherein the adhering mechanism comprises an adhesive material.

14. The tobacco hopper of claim 11, wherein the adhering mechanism is one of: a magnetic strip, double-sided tape, and a pressure fitting.

15. The tobacco hopper of claim 11, wherein the adhering mechanism is made from a non-slip substance.

16. A tobacco hopper comprising:

sidewalls;

a back wall;

a front wall; and a base having a front portion and a rear portion, wherein the front portion includes an opening sized and shaped to surround a tobacco input port of a tobacco chamber of a tobacco rolling machine when the tobacco hopper is arranged on a top surface of the tobacco rolling machine, and wherein the rear portion is inclined at an angle with respect to the front portion;

wherein the sidewalls, the back wall, and the front wall connect to form a ridge barrier.

* * * * *